US012622455B2

(12) United States Patent
Li et al.

(10) Patent No.: US 12,622,455 B2
(45) Date of Patent: May 12, 2026

(54) BANDED PAPERS, SMOKING ARTICLES AND METHODS

(71) Applicant: Philip Morris USA Inc., Richmond, VA (US)

(72) Inventors: Ping Li, Glen Allen, VA (US); Firooz Rasouli, Midlothian, VA (US); Rajesh K. Garg, Richmond, VA (US); Randall E. Baren, Glen Allen, VA (US); Marc W. Rose, Mechanicsville, VA (US); Peter J. Lipowicz, Midlothian, VA (US); Tony A. Phan, Richmond, VA (US); Timothy S. Sherwood, Midlothian, VA (US); Szu-Sung Yang, Midlothian, VA (US); Donald E. Miser, Chesterfield, VA (US); Milton E. Parrish, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 579 days.

(21) Appl. No.: 18/151,592

(22) Filed: Jan. 9, 2023

(65) Prior Publication Data

US 2023/0146735 A1 May 11, 2023

Related U.S. Application Data

(60) Continuation of application No. 15/995,599, filed on Jun. 1, 2018, now Pat. No. 11,547,140, which is a (Continued)

(51) Int. Cl.

| | |
|---|---|
| ***A24D 1/02*** | (2006.01) |
| ***A24D 1/10*** | (2006.01) |
| ***D21H 17/28*** | (2006.01) |

(52) U.S. Cl.
CPC ..... *A24D 1/025* (2013.01); *A24D 1/10* (2013.01); *D21H 17/28* (2013.01)

(58) Field of Classification Search
None
See application file for complete search history.

(56) References Cited

U.S. PATENT DOCUMENTS 1,555,320 A 9/1925 Weil
1,581,451 A 4/1926 Knapp
(Continued)

FOREIGN PATENT DOCUMENTS

BE 779470 A 6/1972
BR P107092164 A2 12/2011
(Continued)

OTHER PUBLICATIONS

U.S. Notice of Allowance dated Jun. 14, 2023 for corresponding U.S. Appl. No. 16/658,741.
(Continued)

*Primary Examiner* — Dionne W. Mayes

(57) ABSTRACT

Wrapper for cigarette manufacture includes transversely extending band regions applied by a printing technique, such as gravure printing. The band regions comprise starch, an anti-wrinkling agent such as 1,2 propylene glycol or glycerin, and optionally calcium carbonate. Any suitable printing technique can be used to apply the aqueous solution to the banded regions. The pattern of banded regions may be bands, stripes, two-dimensional arrays, undulated regions, and the like along and/or around the tobacco rod. The pattern can be applied in one or more layers. The pattern may be configured so that when a smoking article is placed on a substrate, at least two longitudinal locations along the length
(Continued)

of the tobacco rod have film-forming compound located only on sides of the smoking article not in contact with the substrate.

19 Claims, 41 Drawing Sheets

Related U.S. Application Data division of application No. 13/828,802, filed on Mar. 14, 2013, now Pat. No. 10,028,524, which is a continuation of application No. 12/153,783, filed on May 23, 2008, now Pat. No. 8,925,556, which is a continuation-in-part of application No. PCT/IB2007/002118, filed on Apr. 2, 2007.

(60) Provisional application No. 61/064,438, filed on Mar. 5, 2008, provisional application No. 60/935,751, filed on Aug. 29, 2007, provisional application No. 60/929,452, filed on Jun. 28, 2007, provisional application No. 60/924,825, filed on Jun. 1, 2007, provisional application No. 60/924,676, filed on May 25, 2007, provisional application No. 60/924,666, filed on May 24, 2007, provisional application No. 60/787,540, filed on Mar. 31, 2006.

(56) References Cited

U.S. PATENT DOCUMENTS 1,581,619 A 4/1926 Sulzberger
1,909,924 A 5/1933 Schweitzer et al.
1,996,002 A 3/1935 Seaman
1,999,222 A 4/1935 WeinBerger
1,999,223 A 4/1935 WeinBerger
1,999,224 A 4/1935 Miles
2,013,508 A 9/1935 Seaman
2,020,646 A 11/1935 Homestein
2,022,004 A 11/1935 Larson
2,049,320 A 7/1936 Ruben et al.
2,098,619 A 11/1937 Finnell
2,149,896 A 3/1939 McArdle et al.
2,246,929 A 6/1941 Seney
2,307,088 A 1/1943 Whiteley
2,580,568 A 1/1952 Mathews et al.
2,580,608 A 1/1952 Schur et al.
2,666,437 A 1/1954 Lattof
2,718,889 A 9/1955 Claussen
2,733,720 A 2/1956 Schur et al.
2,754,207 A 7/1956 Schur et al.
2,886,042 A 5/1959 Hoover et al.
2,976,190 A 3/1961 Meyer
2,998,012 A 8/1961 Lamm
3,030,963 A 4/1962 Cohn
3,106,210 A 10/1963 Reynolds
3,370,593 A 2/1968 Owaki
3,395,714 A 8/1968 Kahane
3,409,021 A 11/1968 Owaki
3,477,440 A 11/1969 Licis
3,511,247 A 5/1970 Tamol
3,517,672 A 6/1970 Michelson
3,526,904 A 9/1970 Tamol
3,633,589 A 1/1972 Kahane et al.
3,640,285 A 2/1972 Briskin et al.
3,667,479 A 6/1972 Sanford et al.
3,699,973 A 10/1972 Tamol et al.
3,705,588 A 12/1972 Tamol et al.
3,722,515 A 3/1973 Reynolds et al.
3,782,393 A 1/1974 Michelson
3,805,799 A 4/1974 Stewart, Jr. et al.
3,903,899 A 9/1975 Musillo
3,908,671 A 9/1975 Cogbill, II
3,911,932 A 10/1975 Houck, Jr. et al.
4,020,850 A 5/1977 Cogbill, II
4,038,992 A 8/1977 Ogasa et al.
4,044,778 A 8/1977 Cohn
4,061,147 A 12/1977 Falchi
4,077,414 A 3/1978 Baker et al.
4,088,142 A 5/1978 Horsewell et al.
4,129,134 A 12/1978 Hind et al.
4,146,040 A 3/1979 Cohn
4,149,550 A 4/1979 Green et al.
4,187,862 A 2/1980 Cohn
4,193,409 A 3/1980 Wahle et al.
4,225,636 A 9/1980 Cline et al.
4,230,131 A 10/1980 Simon
4,231,377 A 11/1980 Cline et al.
4,236,532 A 12/1980 Schweizer et al.
4,239,591 A 12/1980 Blake
4,277,301 A 7/1981 McIntyre et al.
4,286,605 A 9/1981 Goslin et al.
4,295,478 A 10/1981 Yeatts
4,326,543 A 4/1982 Martin et al.
4,340,074 A 7/1982 Tudor
4,371,571 A 2/1983 McIntyre et al.
4,406,295 A 9/1983 Sanford et al.
4,411,279 A 10/1983 Martin et al.
4,450,847 A 5/1984 Owens
4,452,259 A 6/1984 Norman et al.
4,453,553 A 6/1984 Cohn
4,480,650 A 11/1984 Weinert
4,489,738 A 12/1984 Simon
4,590,955 A 5/1986 Dixit
4,607,647 A 8/1986 Dashley et al.
4,615,345 A 10/1986 Durocher
4,619,278 A 10/1986 Smeed et al.
4,619,289 A 10/1986 Tsuru et al.
4,622,983 A 11/1986 Mathews et al.
4,679,575 A 7/1987 Yamaguchi et al.
4,691,717 A 9/1987 Ikeda et al.
4,716,912 A 1/1988 Leonard
4,730,628 A 3/1988 Townsend et al.
4,739,775 A 4/1988 Hampl, Jr.
4,776,355 A 10/1988 Stevenson et al.
4,784,163 A 11/1988 Adams et al.
4,784,164 A 11/1988 Adams et al.
4,889,145 A 12/1989 Adams et al.
4,924,883 A 5/1990 Perfetti et al.
4,924,888 A 5/1990 Perfetti et al.
4,941,486 A 7/1990 Dube et al.
4,942,888 A 7/1990 Montoya et al.
4,945,932 A 8/1990 Mentzel et al.
4,998,542 A 3/1991 Kallianos et al.
4,998,543 A 3/1991 Goodman et al.
5,060,675 A 10/1991 Milford et al.
5,072,744 A 12/1991 Luke et al.
5,074,321 A 12/1991 Gentry et al.
5,085,228 A 2/1992 Mooney et al.
5,092,353 A 3/1992 Montoya et al.
5,094,253 A 3/1992 St. Charles et al.
5,101,839 A 4/1992 Jakob et al.
5,101,840 A 4/1992 Riehl, Jr.
5,103,844 A 4/1992 Hayden et al.
5,105,836 A 4/1992 Gentry et al.
5,105,838 A 4/1992 White et al.
5,107,866 A 4/1992 Aronoff et al.
5,109,876 A 5/1992 Hayden et al.
5,129,408 A 7/1992 Jakob et al.
5,143,098 A 9/1992 Rogers et al.
5,144,964 A 9/1992 Demain
5,144,966 A 9/1992 Washington
5,144,967 A 9/1992 Cartwright et al.
5,152,304 A 10/1992 Bokelman et al.
5,154,191 A 10/1992 Owens, Jr.
5,155,140 A 10/1992 Marten et al.
5,168,884 A 12/1992 Baldwin et al.
5,170,807 A 12/1992 Kasbo et al.
5,178,167 A 1/1993 Riggs et al.
5,191,906 A 3/1993 Myracle, Jr.
5,220,930 A 6/1993 Gentry
5,244,530 A 9/1993 Collins et al.
5,263,500 A 11/1993 Baldwin et al.

(56) References Cited

U.S. PATENT DOCUMENTS 5,263,999 A 11/1993 Baldwin et al.
5,271,419 A 12/1993 Arzonico et al.
5,329,004 A 7/1994 Eden et al.
5,342,484 A 8/1994 Cutright et al.
5,345,950 A 9/1994 Adebahr et al.
5,396,911 A 3/1995 Casey, III et al.
5,415,186 A 5/1995 Casey, III et al.
5,417,228 A 5/1995 Baldwin et al.
5,450,862 A 9/1995 Baldwin et al.
5,450,863 A 9/1995 Collins et al.
5,464,028 A 11/1995 Takeda et al.
5,465,739 A 11/1995 Perfetti et al.
5,474,095 A 12/1995 Allen et al.
5,490,875 A 2/1996 Wermers et al.
5,490,876 A 2/1996 Warmerdam et al.
5,492,568 A 2/1996 Warmerdam et al.
5,497,793 A 3/1996 Kubica
5,498,224 A 3/1996 Kauffman et al.
5,507,304 A 4/1996 Maheras et al.
5,523,036 A 6/1996 Luke et al.
5,529,619 A 6/1996 Warmerdam et al.
5,534,114 A 7/1996 Cutright et al.
5,538,018 A 7/1996 Chan et al.
5,538,019 A 7/1996 Bullwinkel et al.
5,540,242 A 7/1996 Chao et al.
5,589,034 A 12/1996 Hultman et al.
5,595,196 A 1/1997 Salonen et al.
5,598,868 A 2/1997 Jakob et al.
5,613,505 A 3/1997 Campbell et al.
5,641,349 A 6/1997 Koubek et al.
5,690,787 A 11/1997 Hultman et al.
5,702,555 A 12/1997 Caudal et al.
5,709,227 A 1/1998 Arzonico et al.
5,730,840 A 3/1998 Hampl, Jr. et al.
5,732,718 A 3/1998 Douglas et al.
5,820,998 A 10/1998 Hotaling et al.
5,824,190 A 10/1998 Guerro et al.
5,830,318 A 11/1998 Snow et al.
5,878,753 A 3/1999 Peterson et al.
5,878,754 A 3/1999 Peterson et al.
5,882,755 A 3/1999 Igarashi et al.
5,888,348 A 3/1999 Hampl, Jr.
5,893,372 A 4/1999 Hampl, Jr.
5,911,224 A 6/1999 Berger
5,921,249 A 7/1999 Hampl, Jr.
5,966,218 A 10/1999 Bokelman et al.
5,974,732 A 11/1999 Saito
5,985,323 A 11/1999 Augello et al.
5,992,420 A 11/1999 Moriyama
5,997,691 A 12/1999 Gautam et al.
6,020,969 A 2/2000 Struckhoff et al.
6,095,152 A 8/2000 Beven et al.
6,129,087 A 10/2000 Wallace et al.
6,198,537 B1 3/2001 Bokelman et al.
6,305,382 B1 10/2001 Hampl, Jr.
6,397,852 B1 6/2002 McAdam
6,568,403 B2 5/2003 Hampl, Jr. et al.
6,584,981 B2 7/2003 Hampl, Jr.
6,596,125 B2 7/2003 Garg et al.
6,606,999 B2 8/2003 Crooks et al.
6,645,605 B2 11/2003 Hammersmith et al.
6,676,806 B1 1/2004 Butt, Sr.
6,705,325 B1 3/2004 Hicks et al.
6,725,867 B2 4/2004 Peterson et al.
6,779,530 B2 8/2004 Kraker
6,779,531 B1 8/2004 Biggs et al.
6,789,548 B2 9/2004 Bereman
6,799,578 B2 10/2004 Snaidr et al.
6,823,872 B2 11/2004 Hampl, Jr.
6,837,248 B2 1/2005 Zawadzki et al.
6,929,013 B2 8/2005 Ashcraft et al.
6,959,712 B2 11/2005 Bereman et al.
6,976,493 B2 12/2005 Chapman et al.
6,997,190 B2 2/2006 Stokes et al.
7,047,982 B2 5/2006 Seymour et al.
7,073,514 B2 7/2006 Barnes et al.
7,077,145 B2 7/2006 Seymour et al.
7,115,085 B2 10/2006 Deal
7,116,750 B1 10/2006 Iaquinta et al.
7,117,871 B2 10/2006 Hancock et al.
7,195,019 B2 3/2007 Hancock et al.
7,234,471 B2 6/2007 Fitzgerald et al.
7,237,558 B2 7/2007 Clark et al.
7,237,559 B2 7/2007 Ashcraft et al.
7,240,678 B2 7/2007 Crooks et al.
7,275,548 B2 10/2007 Hancock et al.
7,275,549 B2 10/2007 Hancock et al.
7,276,120 B2 10/2007 Holmes
7,281,540 B2 10/2007 Barnes et al.
7,290,549 B2 11/2007 Banerjee et al.
7,296,578 B2 11/2007 Read, Jr.
7,363,929 B2 4/2008 Fagg et al.
8,701,682 B2 4/2014 Sherwood et al.
2002/0179105 A1 12/2002 Zawadzki et al.
2002/0179106 A1 12/2002 Zawadzki et al.
2003/0131860 A1 7/2003 Ashcraft et al.
2003/0136420 A1 7/2003 Kraker
2003/0145869 A1 8/2003 Kitao et al.
2003/0217757 A1 11/2003 Edelmann
2004/0025894 A1 2/2004 Beven et al.
2004/0074508 A1 4/2004 McAdam et al.
2004/0099280 A1 5/2004 Stokes et al.
2004/0122547 A1 6/2004 Seymour et al.
2004/0123874 A1 7/2004 Zawadzki et al.
2004/0129281 A1 7/2004 Hancock et al.
2004/0134631 A1 7/2004 Crooks et al.
2004/0168695 A1 9/2004 Snaidr et al.
2004/0173229 A1 9/2004 Crooks et al.
2004/0177856 A1 9/2004 Monsalud et al.
2004/0182407 A1 9/2004 Peterson et al.
2004/0231685 A1 11/2004 Patel et al.
2004/0237978 A1 12/2004 Barnes et al.
2004/0238136 A1 12/2004 Patel et al.
2004/0255966 A1 12/2004 Kraker
2004/0261805 A1 12/2004 Wanna et al.
2004/0261806 A1 12/2004 Cagigas
2005/0000528 A1 1/2005 Bereman
2005/0000529 A1 1/2005 Bereman et al.
2005/0000531 A1 1/2005 Shi
2005/0005947 A1 1/2005 Hampl et al.
2005/0016556 A1 1/2005 Ashcraft et al.
2005/0022833 A1 2/2005 Gedevanishvili et al.
2005/0039767 A1 2/2005 Mua et al.
2005/0051185 A1 3/2005 Rasouli et al.
2005/0056293 A1 3/2005 Zawadzki et al.
2005/0056294 A1 3/2005 Wanna et al.
2005/0066980 A1 3/2005 Crooks et al.
2005/0066982 A1 3/2005 Clark et al.
2005/0066984 A1 3/2005 Crooks et al.
2005/0076925 A1 4/2005 Fagg et al.
2005/0076929 A1 4/2005 Fitzgerald et al.
2005/0081869 A1 4/2005 Biggs et al.
2005/0087202 A1 4/2005 Norman et al.
2005/0103355 A1 5/2005 Holmes
2005/0115575 A1 6/2005 Seymour et al.
2005/0115579 A1 6/2005 Beven et al.
2005/0166936 A1 8/2005 Snaidr et al.
2005/0172977 A1 8/2005 Jadot et al.
2005/0178399 A1 8/2005 Shafer et al.
2005/0211259 A1 9/2005 Gedevanishvili
2005/0241659 A1 11/2005 Ashcraft et al.
2005/0241660 A1 11/2005 Ashcraft et al.
2006/0005847 A1 1/2006 Chapman et al.
2006/0011207 A1 1/2006 Chapman et al.
2006/0021625 A1 2/2006 Nyffeler
2006/0021626 A1 2/2006 Mua
2006/0037621 A1 2/2006 Bereman et al.
2006/0124146 A1 6/2006 Stokes et al.
2006/0174904 A1 8/2006 Wanna
2006/0207617 A1 9/2006 Seymour et al.
2006/0231114 A1 10/2006 Oglesby et al.
2006/0237024 A1 10/2006 Reich et al.
2006/0243290 A1 11/2006 Reich et al.
2007/0029060 A1 2/2007 Murray et al.

(56) References Cited

U.S. PATENT DOCUMENTS

| | | | |
|---|---|---|---|
| 2007/0051381 | A1 | 3/2007 | Hancock et al. |
| 2007/0056600 | A1 | 3/2007 | Coleman et al. |
| 2007/0084475 | A1 | 4/2007 | Oglesby |
| 2007/0095357 | A1 | 5/2007 | Besso et al. |
| 2007/0102017 | A1 | 5/2007 | Sherwood et al. |
| 2007/0137668 | A1 | 6/2007 | Borschke et al. |
| 2007/0144545 | A1 | 6/2007 | Long et al. |
| 2007/0157940 | A1 | 7/2007 | Mua et al. |
| 2007/0169786 | A1 | 7/2007 | Li et al. |
| 2007/0175058 | A1 | 8/2007 | Bengi |
| 2007/0295348 | A1 | 12/2007 | Wanna |
| 2008/0011312 | A1 | 1/2008 | Matsufuji et al. |
| 2008/0295854 | A1 | 12/2008 | Li et al. |
| 2011/0155158 | A1 | 6/2011 | Li et al. |
| 2011/0297168 | A1 | 12/2011 | Li et al. |
| 2011/0297169 | A1 | 12/2011 | Li et al. |
| 2011/0297736 | A1 | 12/2011 | Li et al. |
| 2011/0300299 | A1 | 12/2011 | Li et al. |
| 2011/0303233 | A1 | 12/2011 | Li et al. |
| 2012/0031417 | A1 | 2/2012 | Li et al. |
| 2012/0285477 | A1 | 11/2012 | Sherwood et al. |

FOREIGN PATENT DOCUMENTS

| | | | |
|---|---|---|---|
| BR | PI07092164 | | 12/2011 |
| CA | 952656 | A1 | 8/1974 |
| FR | 2136767 | A5 | 12/1972 |
| WO | WO-0237991 | A1 | 5/2002 |
| WO | WO-03088771 | A1 | 10/2003 |
| WO | WO-2005/002370 | A3 | 3/2005 |
| WO | WO-2006/004343 | A1 | 1/2006 |
| WO | WO-2006/098153 | A1 | 9/2006 |
| WO | WO-2007/020532 | A1 | 2/2007 |
| WO | WO-2007/031965 | A2 | 3/2007 |
| WO | WO-2007/113693 | A2 | 10/2007 |

OTHER PUBLICATIONS

International Search Report on Patentability issued Dec. 1, 2009 for PCT/IB2008/001840.
International Search Report and Written Opinion mailed Apr. 20, 2009 for PCT/IB2008/001840.
International Preliminary Report on Patentability dated Sep. 30, 2008 for PCT/IB2007/002118.
International Search Report and Written Opinion mailed Dec. 23, 2008 for PCT/IB2008/002399.
International Preliminary Report on Patentability issued Nov. 24, 2009 for PCT/IB2008/002399.
Partial International Search Report mailed Mar. 6, 2009 for PCT/IB2008/002394.
International Search Report and Written Opinion mailed Jan. 5, 2009 for PCT/IB2008/001839.
International Preliminary Report on Patentability issued Dec. 1, 2009 for PCT/IB2008/001839.
Partial International Search Report mailed Jun. 10, 2009 for PCT/IB2008/002635.
International Search Report and Written Opinion mailed Aug. 19, 2009 for PCT/IB2008/002635.
International Search Report and Written Opinion mailed Apr. 23, 2009 for PCT/IB2008/002994.
International Search Report and Written Opinion mailed Dec. 23, 2008 for PCT/IB2008/002463.
International Preliminary Report on Patentability issued Dec. 1, 2009 for PCT/IB2008/002463.
International Preliminary Report on Patentability issued Jan. 5, 2010 for PCT/IB2008/002635.
International Preliminary Report on Patentability issued Feb. 2, 2010 for PCT/IB2008/002394.
Glogan, T., "Making fire-safe cigarettes a hot topic", Tobacco Journal International, vol. 2004, No. 2, Mar. 1, 2004, pp. 64-65.
Rossel, Stefanie, "Canada's burning issue", Tobacco Journal International, vol. 2005, No. 4, Aug. 1, 2005, pp. 88-91, XP002562192.
International Preliminary Report on Patentability issued Mar. 11, 2010 for PCT/IB2008/002994.
Communication Pursuant to Rule 114(2) EPC issued Apr. 15, 2010 for European Appln. No. 07789552.2-2313.
Communication Pursuant to Article 94(3) EPC dated Sep. 14, 2011 for European Appln. No. 08 807 078.4-2302.
Chapman, Simon et al., "Reduction-Ignition Propensity Cigarettes," Aug. 25, 2004, XP55006441, http://www. health .gov.au/internet/main/publishing.nsf/Contenl/1526AD854C903649CA256F8E0011ACBE/$File/smoking_rip.pdf [retrieved on Sep. 7, 2011].
Official Action issued Nov. 2, 2011 for corresp. Chinese Appln. No. 200880017648.2.
Official Action issued Nov. 10, 2011 for corresp. Chinese Appln. No. 200880024668.2.
"Standard Test Method for Measuring the Ignition Strength of Cigarettes", ASTM International, Designation E2187-4, pp. 1-8, published Aug. 2004.
"Standard Test Method for Measuring the Ignition Strength of Cigarettes", ASTM International, Designation E2187-09, pp. 1-8, published Jan. 2010.
Norman, Alan B. et al., "Measurement of Gas Diffusion Capacity of Cigarette Papers", Beitrage zur Tabakforschung International/Contributions to Tobacco Research, vol. 21, No. 8, pp. 425-434.
Commonly Owned U.S. Appl. No. 61/064,439, filed Mar. 8, 2009.
Office Action mailed Feb. 26, 2018 in corresponding Brazilian Patent Application No. PI0812305-5 with English Translation, 4 pages.
Office Action mailed Jul. 2, 2019 in corresponding European Patent Application No. 13163630.0, 13 pages.
Health Canada/Sanle Canada, "Cigarette Ignition Propensity Regulations", Internet, Sep. 30, 2005, p. 1, XP002697884, http:lwww.hc-sc.gc.ca/hc-ps/alt_formals/hecs-secs/pdf/pubs/lobac-labac/ignition-incend/ignitionncend-eng.pdf, print dale May 29, 2013.
Commonly Owned U.S. Appl. No. 13/324,747, filed Dec. 13, 2011.
Chapman, Simon et al., "Reduction-Ignition Propensity Cigarettes," Aug. 25, 2004, XP55006441, http://www.health.gov.au/internet/main/publishing.nsf/Content/1526AD854C9-03649CA256F8E0011ACBE/$File/smoking.sub.--rip.pdf [retrieved on Sep. 7, 2011].
International Preliminary Report on Patentability issued Feb. 2, 2010 for PCT/IB32008/002394.
Communication Pursuant to Rule 114(2) EPC issued Apr. 15, 2010 for European Appin. No. 07789552.22313.
International Search Report on Patentability dated Dec. 1, 2009 for PCT/IB2008/001840.
International Search Report and Written Opinion dated Apr. 20, 2009 for PCT/IB2008/001840.
International Search Report and Written Opinion dated Dec. 23, 2008 for PCT/IB2008/002399.
International Preliminary Report on Patentability dated Nov. 24, 2009 for PCT/IB2008/002399.
Partial International Search Report dated Mar. 6, 2009 for PCT/IB2008/002394.
International Search Report and Written Opinion dated Jan. 5, 2009 for PCT/IB2008/001839.
International Preliminary Report on Patentability dated Dec. 1, 2009 for PCT/IB2008/001839.
Partial International Search Report dated Jun. 10, 2009 for PCT/IB2008/002635.
International Search Report and Written Opinion dated Aug. 19, 2009 for PCT/IB2008/002635.
International Search Report and Written Opinion dated Apr. 23, 2009 for PCT/IB2008/002994.
International Search Report and Written Opinion dated Dec. 23, 2008 for PCT/IB2008/002463.
International Preliminary Report on Patentability dated Dec. 1, 2009 for PCT/IB2008/002463.
International Preliminary Report on Patentability dated Jan. 5, 2010 for PCT/IB2008/002635.
International Preliminary Report on Patentability dated Feb. 2, 2010 for PCT/IB2008/002394.

(56) References Cited

OTHER PUBLICATIONS

International Preliminary Report on Patentability dated Mar. 11, 2010 for PCT/IB2008/002994.
Communication Pursuant to Rule 114(2) EPC dated Apr. 15, 2010 for European Appln. No. 07789552.2-2313.
Chapman, Simon et al., "Reduction-Ignition Propensity Cigarettes," Aug. 25, 2004, XP55006441, http://www.health.gov.au/internet/main/publishing.nsf/Content/1526AD854C9-03649CA256F8E0011ACBE/$File/smoking_rip.pdf [retrieved on Sep. 7, 2011].
Official Action dated Nov. 2, 2011 for corresp. Chinese Appln. No. 200880017648.2.
Official Action dated Nov. 10, 2011 for corresp. Chinese Appln. No. 200880024668.2.
International Preliminary Report on Patentability dated Dec. 1, 2009 for PCT/IB2008/001840.
Office Action dated Feb. 26, 2018 in corresponding Brazilian Patent Application No. PI0812305-5 with English Translation, 4 pages.
Office Action dated Jul. 2, 2019 in corresponding European Patent Application No. 13163630.0, 13 pages.
Health Canada/Sante Canada, "Cigarette Ignition Propensity Regulations", Internet, Sep. 30, 2005, p. 1, XP002697884, http:/www.hc-sc.gc.ca/hc-ps/alt_formats/hecs-secs/pdf/pubs/tobac-tabac/ig- nition-incend/ignition-incend-eng.pdf, print date May 29, 2013.
U.S. Office Action dated Aug. 23, 2021 for corresponding U.S. Appl. No. 15/995,599.
U.S. Office Action dated Mar. 3, 2022 for corresponding U.S. Appl. No. 15/995,599.
U.S. Office Action dated Aug. 13, 2022 for corresponding U.S. Appl. No. 16/658,741.
U.S. Notice of Allowance dated Aug. 29, 2022 for corresponding U.S. Appl. No. 15/995,599.

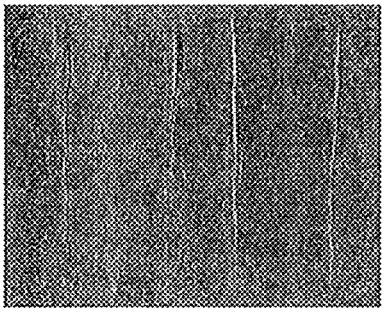
FIG. 60A
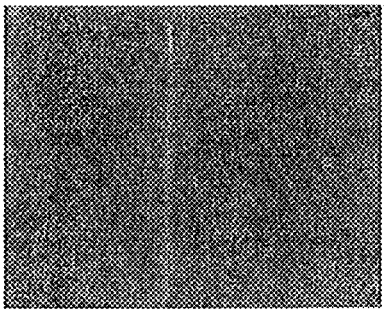
FIG. 60D
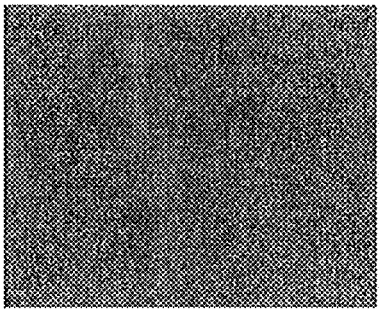
FIG. 60G
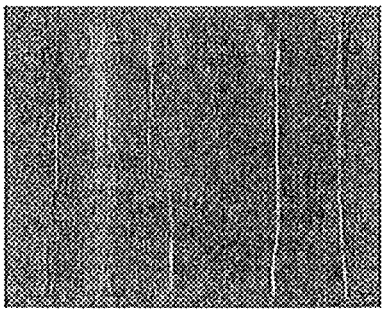
FIG. 60B
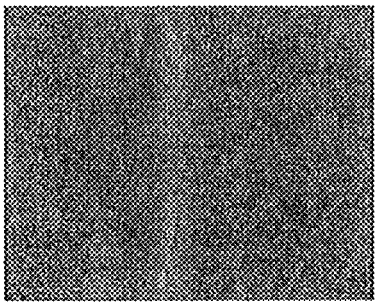
FIG. 60E
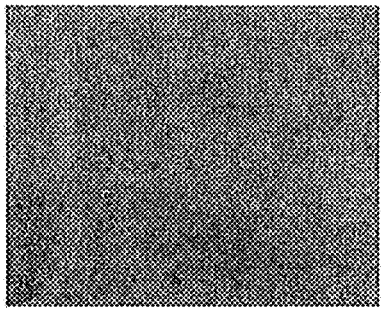
FIG. 60H
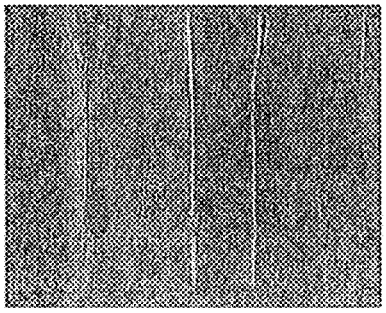
FIG. 60C
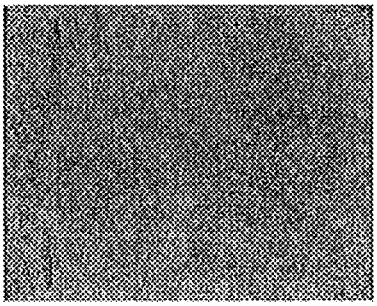
FIG. 60F
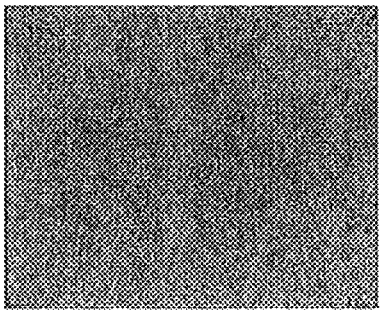
FIG. 60I
FIG. 60

BANDED PAPERS, SMOKING ARTICLES AND METHODS

CROSS-REFERENCES

This application is a continuation application of U.S. patent application Ser. No. 15/995,599, filed Jun. 1, 2018, which is a divisional application of U.S. patent application Ser. No. 13/828,802, filed Mar. 14, 2013, which is a continuation application of U.S. Ser. No. 12/153,783, filed May 23, 2008, now U.S. Pat. No. 8,925,556, issued on Jan. 6, 2015, which claims priority from U.S. Provisional Patent Application 61/064,438, filed Mar. 5, 2008; U.S. Provisional Patent Application 60/935,751, filed on Aug. 29, 2007; U.S. Provisional Patent Application 60/929,452, filed Jun. 28, 2007; U.S. Provisional Patent Application 60/924,825, filed Jun. 1, 2007; U.S. Provisional Patent Application 60/924,676, filed May 25, 2007; and U.S. Provisional Patent Application 60/924,666, filed May 24, 2007; and which is a continuation-in-part of International Patent Application No. PCT/IB2007/002118, filed Apr. 2, 2007, which claims priority from U.S. Provisional Patent Application 60/787,540 filed Mar. 31, 2006, the entire contents of each identified application is hereby incorporated by reference.

FIELD OF THE DISCLOSURE

This disclosure relates generally to a smoking article and, more particularly, a banded wrapper for use in cigarette manufacturing, related materials, processes, and methods. Anti-wrinkling agents, specially formulated oxidized starch material, smoking articles and wrappers which exhibit a low ignition propensity and/or low self-extinguishment characteristics, and patterns for banded regions are disclosed.

BACKGROUND

As part of efforts to reduce the incidence of accidental fires resulting from untended smoking articles, various jurisdictions have imposed, are imposing, and may impose in the future limitations on the burning characteristics of smoking articles. One measure of the tendency of a smoking article to cause ignition of an underlying substrate is the Ignition Propensity value. To satisfy those increasingly common governmental requirements, the Ignition Propensity value, or IP value, for a smoking article should preferably be no greater than about 25%. More preferably, the IP value should be no greater than about 20%; and even more preferably no greater than about 10%. Accordingly, efforts meet such limits are undertaken by various manufacturers of smoking articles.

Reduced IP values typically are associated with a tendency for the smoking article to self-extinguish during smoldering between puffs. Generally speaking, consumers do not like to re-light a cigarette during their smoking experience. A measure of the tendency for a smoking article to self-extinguish during, free burn has been developed and is known as the Self-Extinction value. The Self-Extinction or SE value has been found to be a useful indicia to evaluate the likelihood of consumer satisfaction for a smoking article where various techniques for IP reductions have been employed. The average Self-Extinction Average value for a smoking article should preferably be no greater than about 80% and/or the Self-Extinction at 0 value should be no greater than about 50%, and more preferably no greater than about 25%.

Ignition Propensity ("IP")

Ignition Propensity or IP is a standard test conducted as set forth in ASTM E 2187-04, "Standard Test. Method for Measuring the Ignition Strength of Smoking articles", which is incorporated herein in its entirety by this reference thereto. Ignition propensity measures the probability that a smoking article, when smoldering and placed on a substrate, will generate sufficient heat to maintain smoldering of the tobacco rod. Low values for IP are desirable as such values correlate with a reduced likelihood that a smoldering smoking article, when inadvertently left unattended upon a substrate, will cause combustion in the substrate.

Self Extinguishment ("SE")

Self-Extinguishment or SE herein is a reference to smoldering characteristics of a smoking article under free burn conditions. To evaluate SE, a laboratory test is conducted at a temperature of 23° C.±3° C. and relative humidity of 55%±5%, both of which should be monitored by a recording hygrothermograph. Exhaust hoods) remove combustion products formed during testing. Prior to testing, smoking articles to be tested are conditioned at 55% 5% relative humidity and 23° C.±3° C. for 24 hours. Just prior to testing, the smoking articles are placed in glass beakers to assure free air access.

SE testing takes place within an enclosure or test box. A single port smoking machine or an electric lighter is used to ignite the smoking articles for the test. During testing, an apparatus or "angle holder" holds the smoking articles to be tested by holding an end at angles of 0° (horizontal), 45°, and/or 90° (vertical). Preferably, twenty (20) smoking articles are tested at each of the 0°, 45°, and 90° positions. If more than one apparatus is used, the apparatuses are preferably positioned such that the smoking articles face away from each other to avoid cross interference. If a smoking article goes out before the front line of the smoldering coal reaches the tipping paper, the outcome is scored as "self-extinguishment"; on the other hand, if the smoking article continues smoldering until the front line of the smoldering coal reaches the tipping paper, then the outcome is scored as "non-extinguishment". Thus, for example, an SE value of 95% indicates that 95% of the smoking articles tested exhibited self-extinguishment under free burn conditions; while an SE value of 20% indicates that only 20% of the smoking articles tested exhibited self-extinguishment under such free burn conditions.

The SE value may be referred to in terms of "Self-Extinction at 0° value", "Self-Extinction at 45° value", or "Self-Extinction at 90° value", each of which refers to the value of SE at the specified tested angle. In addition, the SE value may be referred to in terms of "Self-Extinction Average value", which refers to an average of the three angular positions: namely, an average of (i) the "Self-Extinction at 0° value" (ii) the "Self-Extinction at 45° value", and (iii) the "Self-Extinction at 90° value". A reference to "Self-Extinction value" or "SE value" does not distinguish between SE at 0°, SE at 45°, SE at 90°, or SE average values and may refer to any One of them.

In execution of multi-pass printing operations, the operator will typically establish a press at the very beginning to print registration marks. Accordingly, in understanding the description herein of "first pass", "second pass", "third pass" and so forth, it should be understood that typically such passes will be preceded with a pass (or print station) for establishing registration marks on the paper, which marks are used to maintain desired registration from pass to pass (print-station to print-station).

SUMMARY

Embodiments herein disclosed include banded papers and smoking articles constructed from such papers, wherein the add-on material comprises an aqueous starch solution (or system) that includes an anti-wrinkling agent as disclosed herein, such that the following are achievable:

- countermeasure against tendency of the aqueous solution to create wrinkles and creases in the paper;
- countermeasure against tendency of the aqueous solution to cause the paper to shrink transversely during printing operations so that print-registration can be more precisely maintained from print-station to print-station, especially in the transverse dimension of the paper;
- with the aforementioned countermeasures, printing of intricate patterns on base web with aqueous add-on systems at commercially viable printing speeds becomes possible;
- possibility of single pass, gravure-printed banded paper with an aqueous solution when coupled with sufficient drying capabilities;
- more precise multi-pass printing of banded paper with an aqueous solution; and
- improved stability of the solution, including a longer operational shelf-life, which reduces costs and waste during printing operations.

In addition there are teachings herein of embodiments that include banded papers and smoking articles constructed from such papers, wherein the add-on material comprises an aqueous, preferably starch solution that includes a chalk content sufficient to abate the tendency of the banded paper to cause self-extinguishments and to enhance appearance of the product to a consumer. Further teachings include embodiments which include features and provision for maintaining capability to machine vision inspect the banded paper during printing operations, despite the presence of the chalk content in the add-on material.

Furthermore, there are teachings herein of embodiments that include banded papers and smoking articles constructed from such papers, wherein the bands are established according to patters which help abate the statistical occurrences of self-extinguishments (SE) while maintaining desired IP performance.

In accordance with one aspect of this disclosure, a wrapper paper for a smoking article may have a base web to which add-on material is applied in a pattern using an aqueous starch solution that includes an anti-wrinkling agent. The wrapper paper may include regions of add-on material that include starch at about 1.5 gsm and 1,2 propylene glycol in the range of about 0.36 to about 0.90 gsm. As desired, the add-on material may also it de chalk or calcium carbonate in the range of about 0.64 to about 1.2 gsm.

In accordance with another aspect of this disclosure, a smoking article may include tobacco and a wrapper paper where the wrapper paper includes a pattern of add-on material applied as an aqueous starch solution containing an anti-wrinkling agent.

Another aspect of this disclosure involves a method of making or preparing a patterned wrapper paper by establishing a supply supplying of an aqueous starch solution incorporating an anti-wrinkling agent to a printing station through which a base web is passed so that the pattern can be applied using the aqueous starch solution.

Further aspects of this disclosure involve, without limitation, patterns for the add-on material, characteristics of the constituents of the add-on material. Further, the disclosure relates to resulting features of the smoking article including without limitation ignition propensity and self-extinction characteristics.

BRIEF DESCRIPTION OF THE DRAWINGS

Many objects and advantages of the present disclosure will be apparent to those skilled in the an when this specification is read in conjunction with the accompanying drawings, wherein like reference numerals are applied to like elements and wherein:

FIGS. 4A-4G join one another at the indicated match lines;

FIG. 60 is a collection of photographs showing the effect of anti-wrinkling agents on wrapper paper.

BACKGROUND DEFINITIONS

Figure 1:
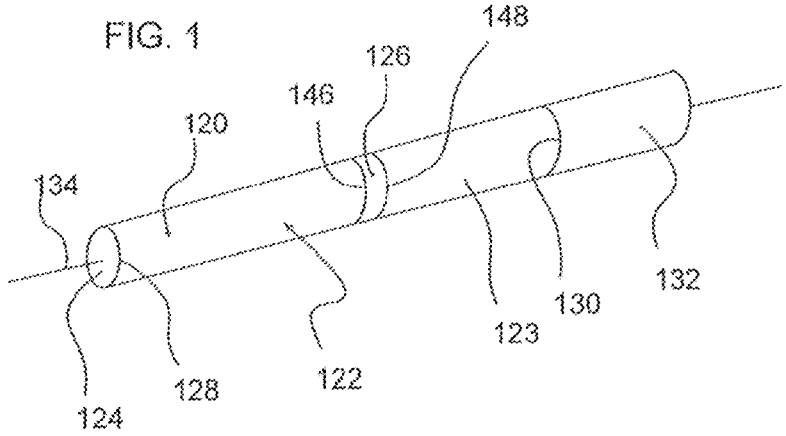
FIG. 1 is a schematic perspective view of a smoking article according to this disclosure.

Referring to FIG. 1, his disclosure concerns a smoking article 120, such as a cigarette, which preferably comprises a tobacco rod 122 and a filter 132 attached to the tobacco rod 122 with tipping paper 132. Preferably, the tobacco rod 122 comprises a column of shredded tobacco ("cut filler") and a wrapper 123 disposed about the column of tobacco, which wrapper 123 is constructed in accordance with teachings which follow. The tobacco rod 122 has a lightable or lit end 124 and a tipped end 130 (which in the case of non-filtered cigarettes, is referenced as the mouth end 130 of the cigarette 120). Cut filler tobacco, is an industry-standard designation. Further, the tobacco rod 122 typically has a generally circular cross section, although other oval cross section and other shapes are within the scope of this disclosure. The wrapper is sealed along a longitudinal seam to form the tobacco rod 122.

The tobacco rod has a nominal length measured from the edge 131 of the tipping paper to the free end of the tobacco rod along a longitudinal axis of smoking article. By way of example, that nominal length may lie in the range of about 60 to about 100 mm.

The "wrapper" paper 123 (see FIG. 2) typically includes a "base web" 140 that may be made from flax, wood pulp, cellulose fiber, or the like, and may have a plurality of banded regions 126 applied to one or both sides. Preferably, the banded region 126 is applied to the inside of the wrapper 123 in the sense of how the wrapper 123 surrounds a column of tobacco in the tobacco rod 122.

In the manufacture of base web suited for the construction of the various embodiments of print banded paper disclosed herein, such manufacture usually will include the production of a roll of base web of several feet across (usually about 3 feet across or in transverse dimension), which is then slit into bobbins. Printing operations are preferably conducted on the rolls, but could be conducted after slitting. Preferably, the bobbins themselves will have a transverse dimension equivalent to the width needed to make tobacco rods 122 or an integral number of such widths (e.g., 1, 2, or 4 of such widths). The bobbins are adapted for use with typical cigarette making machines. The wrapper preferably has a dimension in cross-direction that takes into account the nominal circumference of the tobacco rod and an overlapping seam. As a result, when the wrapper is slit, the smoking article formed therefrom always has a longitudinal seam with an exact overlap.

For purposes of this disclosure, "longitudinal" refers to the direction along the length of a tobacco rod (e.g., along the axis 134 in FIG. 1), or along the length of a base web 140

(e.g., arrow 142 in FIG. 2) used in the preparation of wrapper that, in turn, play be used to fabricate a tobacco rod.

For purposes of this disclosure, "transverse" refers to the direction circumferentially around a tobacco rod 122 (see FIG. 1), or transversely of a base web 140 (e.g., arrow 144 in FIG. 2) used in the preparation of wrapper that, in turn, may be used to fabricate a tobacco rod.

For purposes of this disclosure, a "banded region" or "zone" is an area 120 (see FIG. 2) on an underlying base web 140 to which an add-on material has been applied. The banded region typically exhibits a two-dimensional pattern or array on the base web 140. More specifically, the pattern or array may comprise repeating units in the longitudinal direction 142 of the base web 140, repeating units in the transverse direction 144 of the base web 123, and or units which repeat in both the transverse 144 and longitudinal 142 directions of the base web 140. The regions 126 of add-on material are applied to the wrapper 123 to obtain satisfactory or improved Ignition Propensity ("IP") characteristics and may also obtain improved Self-Extinguishment ("SE") characteristics.

The regions 126 of add-on material are spaced along the base web 140 such that at least one region of add-on material 126 is positioned between the First and second ends 128, 130 of the tobacco rod 122 in each finished smoking article, but more preferably at least two regions of add-on material appear on the tobacco rod 122. The region 120 of add-on material preferably extends in the circumferential direction at one or more spaced locations along the axis 134, extending around the tobacco rod 122 of the smoking ankle 120. While the region 126 of add-on material is depicted in this disclosure as being substantially continuous in its circumferential direction, other configurations for the add-on material are within the spirit and scope of this disclosure.

It is noted for sake of convention that, in describing dimensions of various embodiments herein, that band or zone "width" extends in a longitudinal direction 134 (see FIG. 1) of the tobacco rod 122, whereas a dimension in the circumferential direction will be expressed as "circumferential" or "transverse" or "in cross-direction."

Where the banded region 126 extends transversely of the base web 140 (or circumferentially around a tobacco rod), the "width" of the banded region 126 is measured in the longitudinal direction 142 from the leading edge 146 to the trailing edge 148 and is preferably lies in the range of from about 5 to about 9 mm (from the leading edge 146 to the trailing edge 148), more preferably from about 5.5 to about 7.5 mm, and even more preferably from about 6 to about 7 mm. Further, banded regions may have a 27 mm "phase" (i.e., the spacing from the leading edge 146 of one banded region. 126 to the leading edge 145 of the next adjacent banded region 126). Preferably, the banded regions of add-on material reduce permeability of the wrapper to the range of from about 0 to about 12 CORESTA, more preferably the range of from about 0 to about 10 CORESTA.

For purposes of this disclosure, "band spacing" refers to the distance between the trailing edge 148 of one banded region 126 and the leading edge 146 of an adjacent banded region 126 on the base web 140 from which a wrapper is fashioned.

Figure 6:
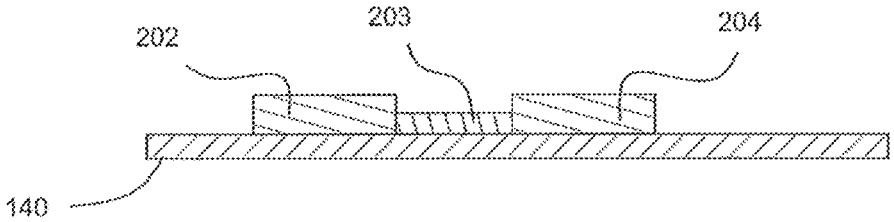
FIG. 6 is an enlarged partial cross-sectional view taken along the line 6-6 of FIG.

As used herein, the phrase "leading edge" refers to the edge 146 (see FIG. 1) of a banded region 126 that is closest to an approaching coal during smoldering of a smoking article 120 whose wrapper 123 contains the banded region 126, while the phrase "trailing edge" refers to the edge 148 of a banded region 126 that is farthest from an approaching coal during smoldering of a smoking article 120 whose wrapper 123 contains the banded region 126. In crenellated embodiments, the overall width "W" of the banded region is measured from the farthest forward extent of the leading edge to the farthest trailing extent of the trailing edge, as is illustrated in FIG. 6 with the width "W".

As used herein, the term "crenellated" refers to a pattern of multiple, spaced, geometrically shaped spaces removed from an otherwise substantially continuous solid banded region 126. A crenellated pattern or band can also be described as notched or appearing similar to a pulse wave. As used herein, "crenels" refer to openings, or valleys, in a crenellated edge, while "merlons" refer to raised portions, or plateaus of a crenellated edge, between crenels. The term "undulating" as used herein includes a crenellated edge as well as broader geometric shapes that exhibit a increasing and decreasing width characteristics.

For purposes of this disclosure, "layer" refers to a quantity of add-on material applied to a base web from which a wrapper is fabricated. A banded region 126 may be fashioned from one or More layers 150, 152 (see FIG. 3) that may be superimposed on one another. Each banded region 126 may be formed by applying one or more "layers" 150, 152 of an aqueous film forming composition to the base web 140 of the wrapper to reduce the permeability of the paper in the corresponding banded region. Alternatively, a cellulose material may also be used to form the banded regions.

Where a film-forming composition is used, that "film-forming composition" preferably may include water and a high concentration of an occluding agent, e.g., 14% to about 50% by weight. The film-forming compound can include one or more occluding agents such as starch, alginate, cellulose or gum and may also include calcium carbonate as a filler. Further, the film-forming composition preferably includes an anti-wrinkling agent. Where starch is the film-forming compound, a concentration of about 14% to about 26% may be particularly advantageous, and a concentration of about 16% is presently most preferred.

An "anti-wrinkling agent" is a material which inhibits transverse shrinkage of the base web 140 (see FIG. 2) during printing or other conversion operations. A suitable anti-wrinkling agent may be selected from the group consisting of 1,2 propylene glycol, propylene glycol, glycerin, and starch plasticizing agents.

The film-forming composition may be applied to the base web of the wrapper 140 using conversion technologies such as gravure printing, digital printing, coating or spraying using a template, or any other suitable technique, if desired, the banded regions 126 of add-on material can be formed by printing multiple, successive layers, e.g., two or more successive layers registered or aligned with one another. Given the tolerances in gravure printing equipment, for example, adjacent layers are considered to be in registry where their respective overlying edges are within about 0.4 mm of one another when measured in either the longitudinal or transverse direction of the base web 140. Furthermore, when layers are used to form the banded regions of add-on material, the material in adjacent layers may be the same or different. For example, one layer may be starch while the next layer may be starch and calcium carbonate.

When discussing application rates for add-on material applied using gravure printing techniques, often use values with "X" as a suffix to refer to a volumetric application rate. The table below sets out the volumetric equivalents for "X" in terms of billion cubic microns, or "BCM":

| Volume | BCM |
|---|---|
| 0.5X | 3.4 |
| 1.0X | 4.6 |
| 1.5X | 6.8 |
| 2.0X | 10 |
| 2.5X | 10.7 |
| 3.0X | 12.3 |
| 3.5X | 13.6 |
| 4.0X | 17.8 |
| 4.5X | 19.9 |
| 5.0X | 22.4 |
| 5.5X | 24.7 |
| 6.0X | 27.8 |

In this specification, the unit of measurement for basis weight, gram(s) per square meter, is abbreviated as "gsm".

When the phrase "weight ratio" is used herein with respect to the starch component of a starch solution, the "weight ratio" is the ratio of the weight of the additional material compared to the weight of starch used to prepare the starch solution. Moreover, for purposes of this disclosure, references to an "X % starch solution" refer to an aqueous starch solution in which the starch weight is X % of the solution weight (e.g. weight of starch divided by the sum of starch weight and aqueous component weight).

The wrapper includes a base web which typically is permeable to air. Permeability of wrapper is typically identified in CORESTA units. A CORESTA unit measures paper permeability m terms of volumetric flow rate (i.e., $cm^3$/sec) per unit area (i.e., $cm^2$) per unit pressure drop (i.e., cm of water). The base web of conventional wrapper also has well-known basis weights, measured in grams per square meter, abbreviated as "gsm". The permeability and basis weight for the base web of typical smoking article papers commonly used in the industry are set out in the table below:

| Permeability, CORESTA units | Basis Weight, gsm |
|---|---|
| 24 | 25 |
| 33 | 25 |
| 46 | 25 |
| 60 | 26 |

For purposes of this description, the base web of a preferred wrapper has a permeability of at least about 20 CORESTA units. Most preferably, the wrapper has a permeability greater than about 30 CORESTA, such as common base webs having nominal permeabilities of about 33 and about 46 CORESTA with a basis weight of about 25 gsm. For some applications, the base web may, have a permeability of greater than about 60 CORESTA, or greater than about 80 CORESTA, or even higher permeability values.

Schematic vs. Actual Depictions

Figure 3:
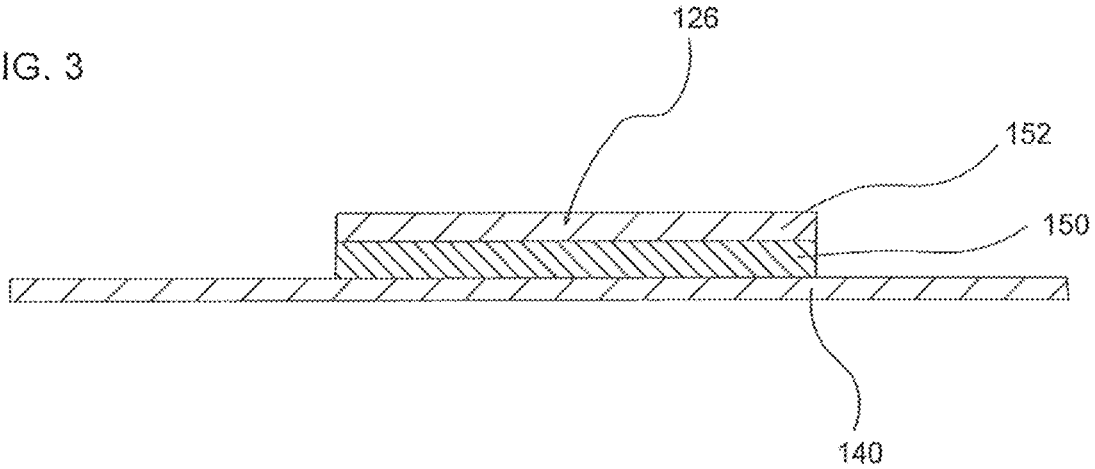
FIG. 3 is an enlarged partial cross-sectional view taken along the line 3-3 of FIG. 2.

Depictions of cross sections taken through a banded paper, such as FIG. 3, are believed to be useful schematic representations of a paper web having banded regions fashioned from one or more layered applications, and of the application processes by which such banded papers are fabricated. However, such schematic representations do not accurately depict the reality of the cross-section base web structures, or the reality of the cross-section of base web structures to which one or more layers of add-on material have been applied, or the reality of the cross-section of those layers of add-on material, in the final banded paper product.

More particularly, FIGS. 4A-4G are a mosaic of photomicrographs taken of a cross-section of a handed wrapper of the type discussed above and elsewhere in this disclosure. The photomicrographs of FIGS. 4A-4G cover an actual length of wrapper measuring about 2.1 mm in length, to which add-on material has been applied in two layers—one layer containing starch and calcium carbonate, and one layer having starch but no calcium carbonate. Match lines are applied to the different sheets of the FIGS. 4A-4G mosaic so that the relationship between different portions of FIGS. 4A-4G are readily apparent.

The individual photomicrographs of FIGS. 4A-4G enlarge the actual paper sample 2500 times. Procedurally, actual banded paper was cut into sections several millimeters long and embedded into Spurr™ epoxy. The embedded paper was then cut into 5 μm (micrometers) thick cross sections using a Leica Ultracut UCT Ultramierotome equipped with a glass knife. The sample was mounted on a carbon adhesive disk attached to an aluminum stub, and sputter coated with 15 nm (nanometers) of Au—Pd using a Cressington 208HR Sputter Coater operating in argon. The sample was imaged in adjacent overlapping portions using an FEI XL30 Environmental Scanning Electron Microscope (ESEM) operating at 15 kV in Hi-Vac mode.

Figure 4A:
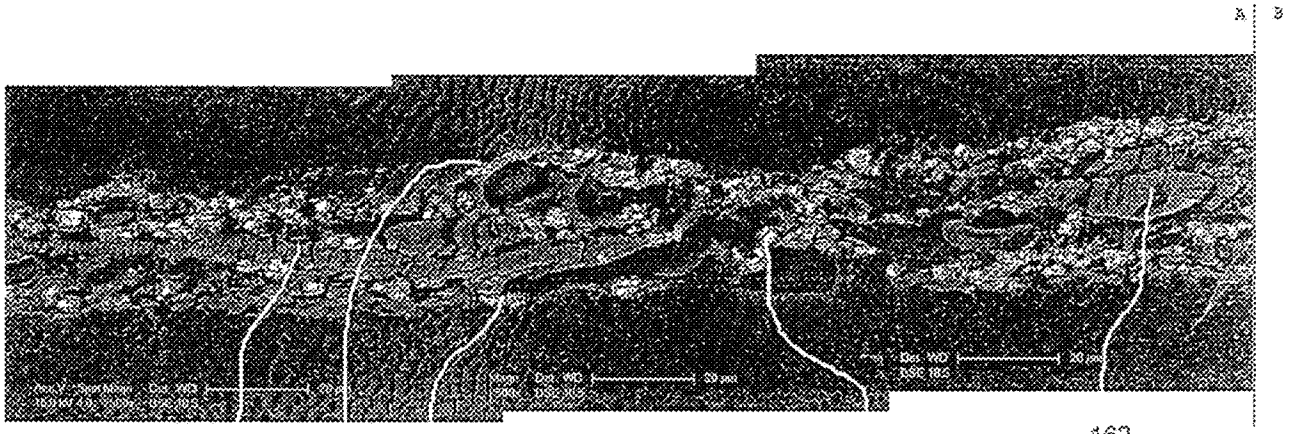
FIGS. 4A-4G are a mosaic of photomicrographs taken of actual wrapper with two layers of add-on material.
Figure 4B:
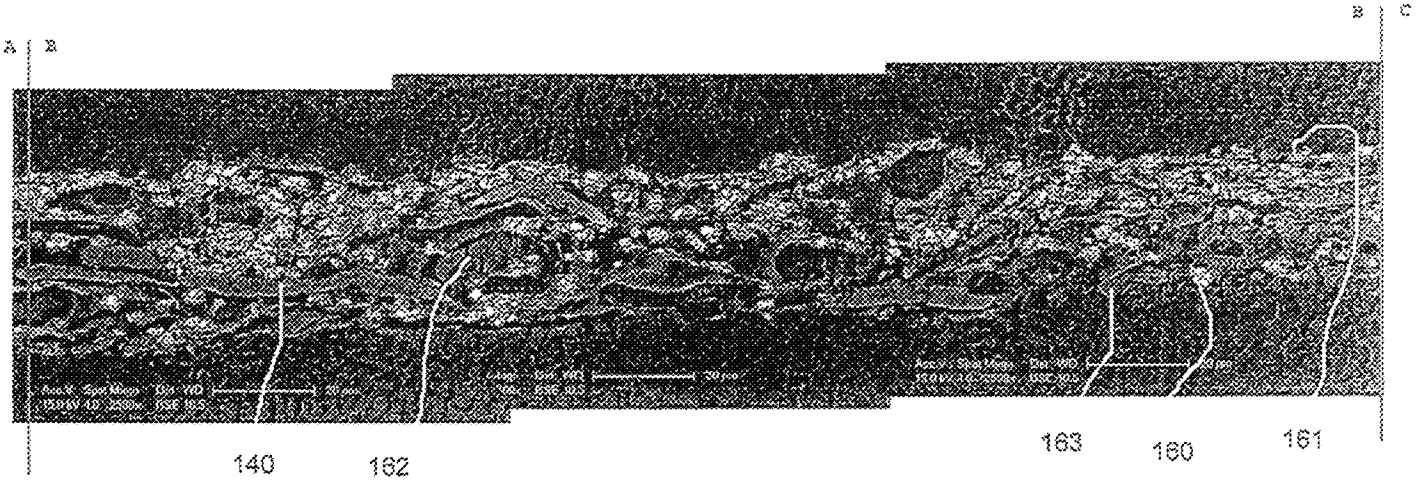

FIGS. 4A, 4B depict a portion of the base web 140 which is free of any add-on material. The base web 140 includes a multiplicity of randomly dispersed, light areas (e.g., 160) which represent calcium carbonate particles incorporated into the base web during paper formation. The base web 140 also includes a multiplicity of darker shapes 162 some of which are elongated, others of being rounded, which are cuts through fibers used in the paper making process. The base web 140 has a pair of surfaces 161, 163, that can be characterized as having random roughness at this level of magnification, and having both calcium carbonate particles and fibers randomly distributed along the surface regions. The base web 140 itself exhibits a thickness which, at best, may also be characterized as random, but having some statistically average or nominal value.

Figure 4C:
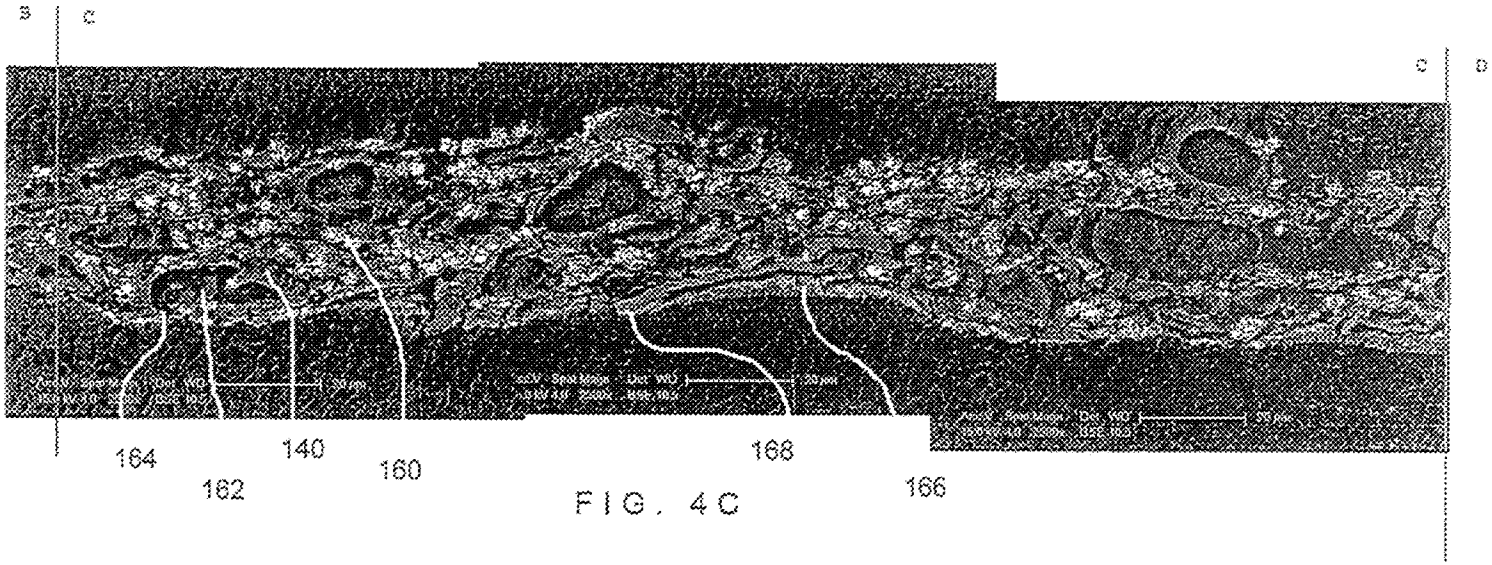
Figure 4D:
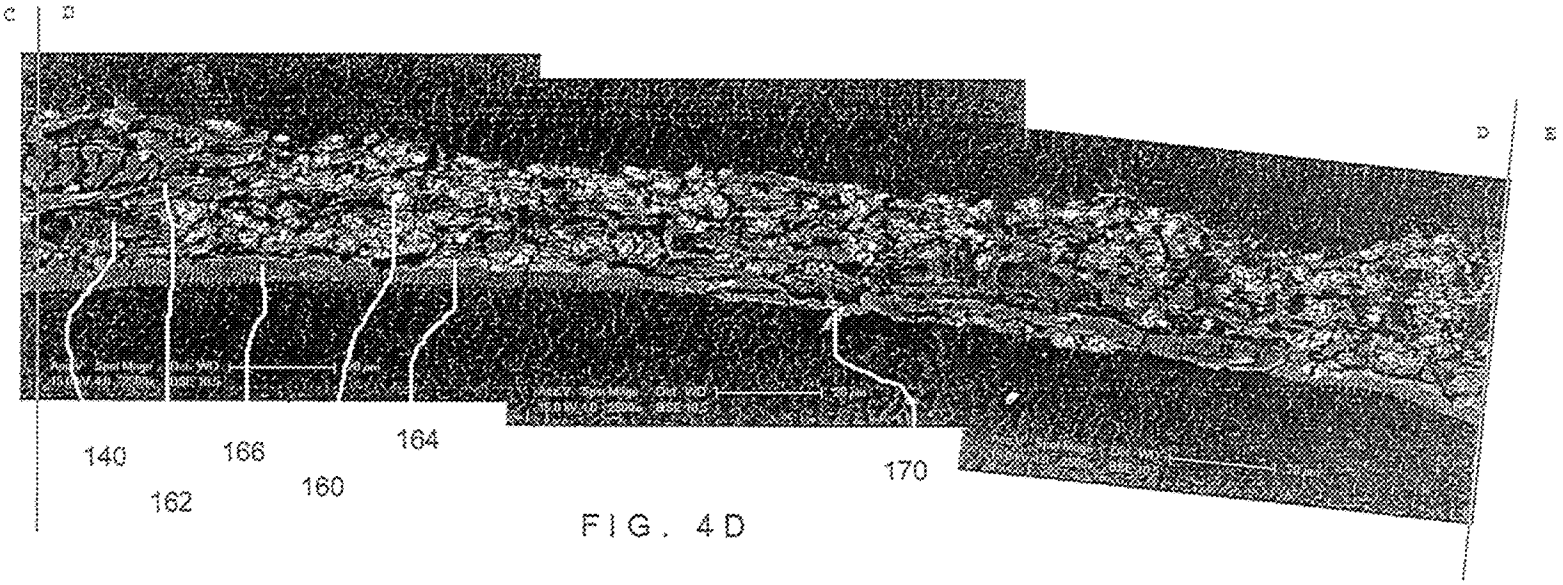
Figure 4E:
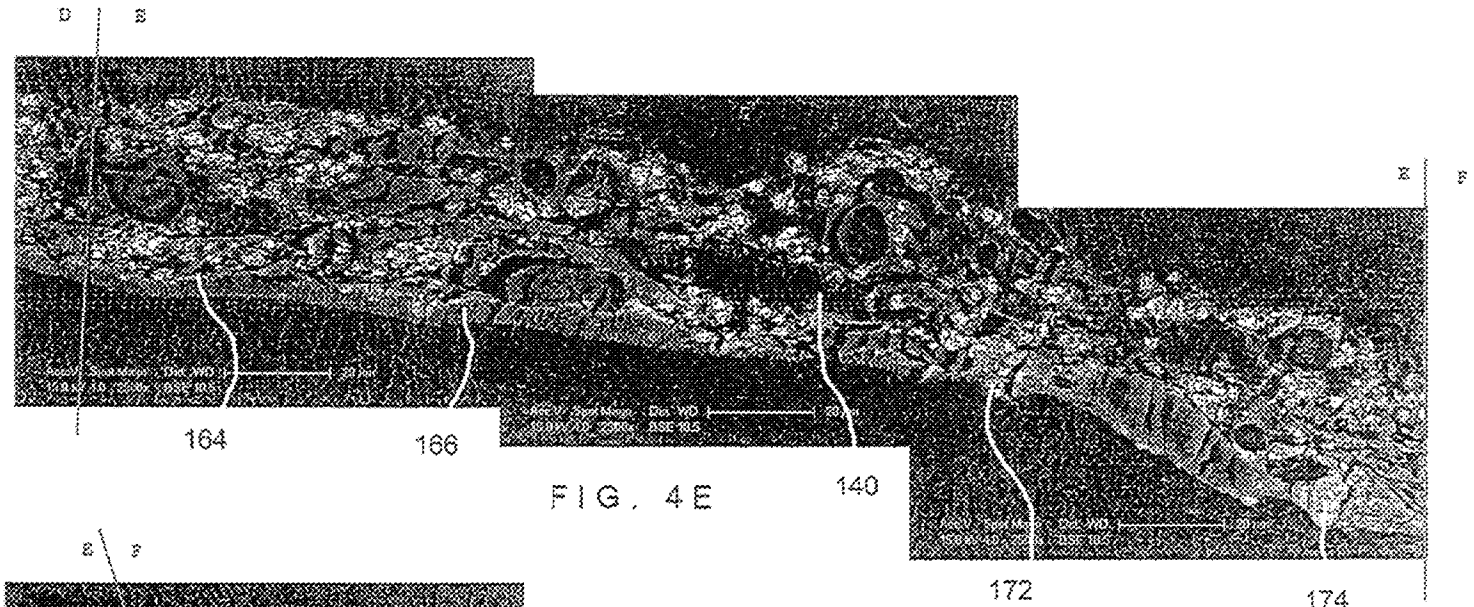
Figure 4F:
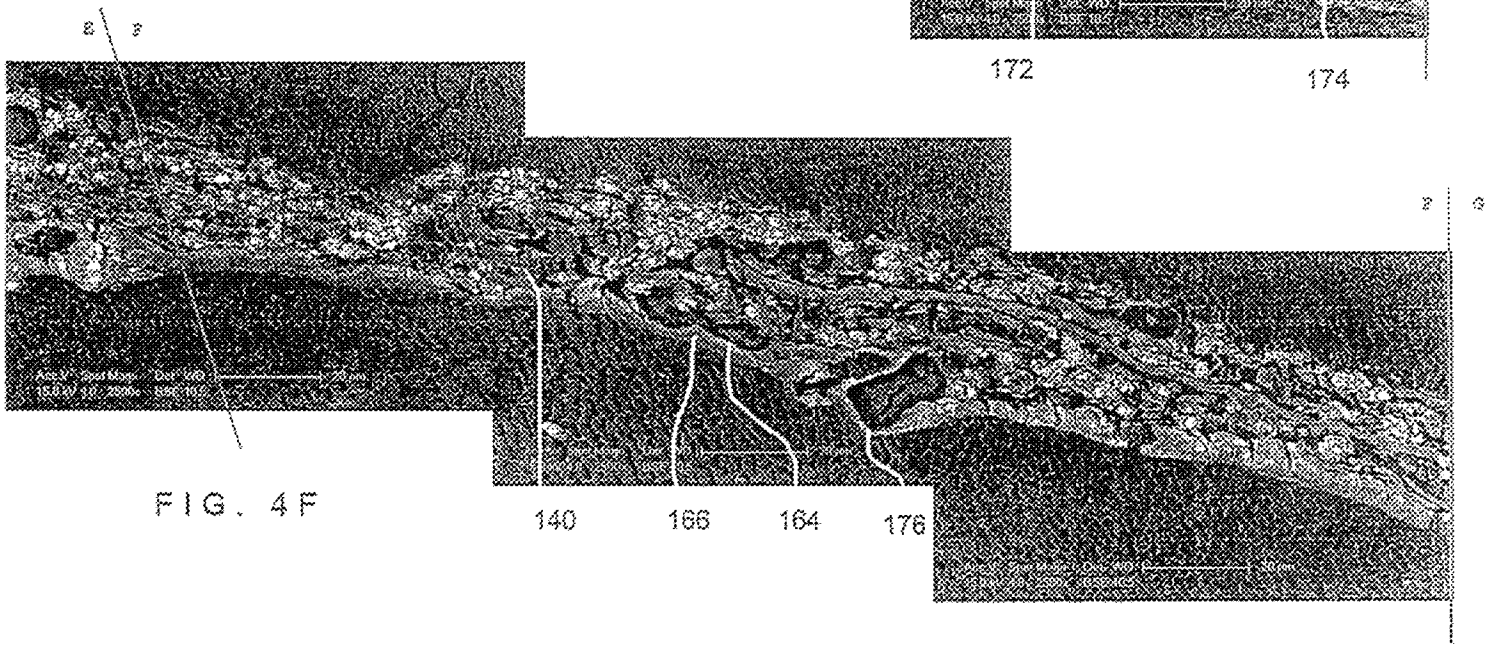
Figure 4G:
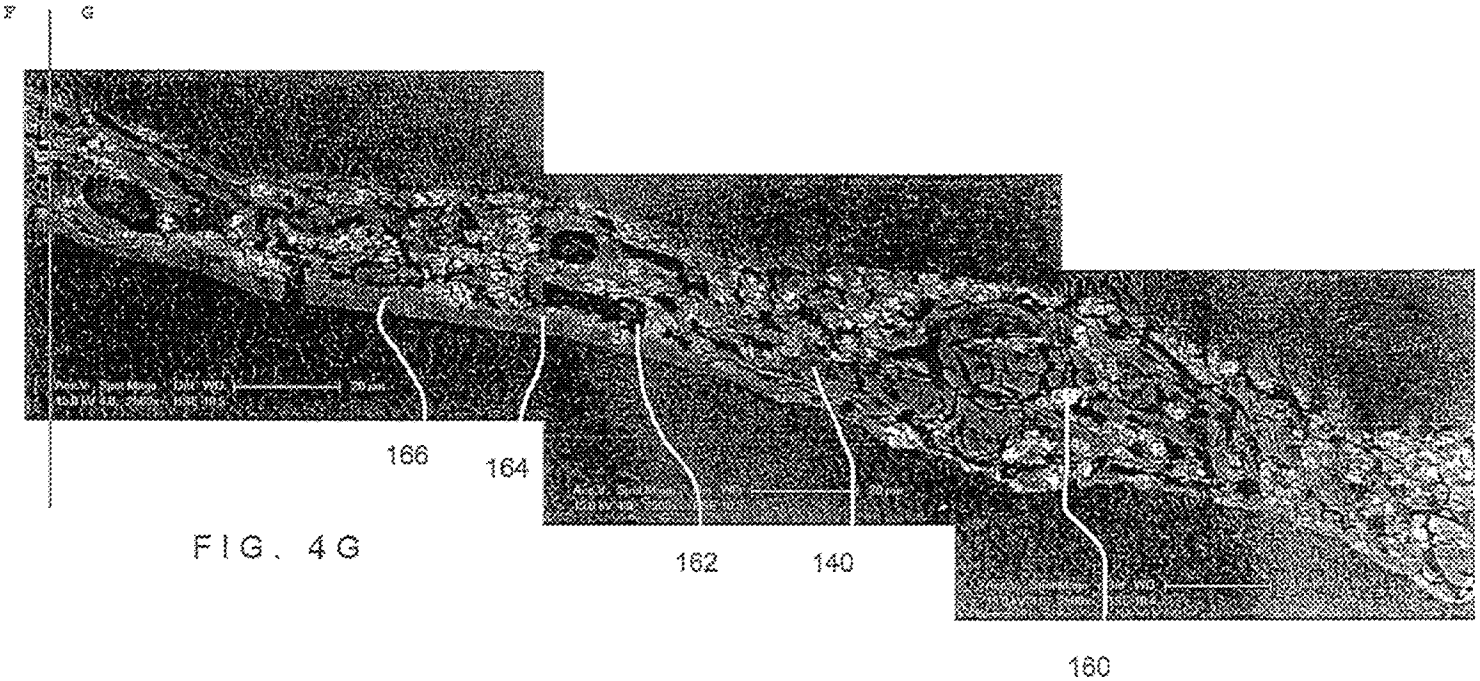

When the first portion or layer of add-on material 164 is applied (see FIG. 4C), the add-on material shows on the surface of the base web 140 due principally to the presence of chalk (or calcium carbonate) in the material. In the sample which has been magnified in FIGS. 4A-4G, the second portion or layer of add-on material 166 is applied (see FIG. 4C) on the surface of the base web 140 and is positioned on the first layer 164. The second layer 166 begins at about the location 168 (FIG. 4C). While it appears that the second layer 166 is not aligned so as to start at the same location as the first layer 164, the tolerances involved in application techniques such as printing effectively do not allow the layers to be controlled within a tolerance of any less than about 0.3 mm. From the scale of magnification shown on the images of the FIGS. 4A-4G mosaic, the distance between the beginning of the first layer and the beginning of the second layer is about 0.12 mm—a distance well within the minimum tolerance noted above.

Examining the first layer as it extends across FIGS. 4C-4G, several observations can be made about the first layer 164 containing starch and calcium carbonate:

(i) the layer 164 is not continuous in the direction of the base web 140;
(ii) the layer 164 does not have uniform thickness;
(iii) the layer 164 has non-uniform thickness;
(iv) the layer 164 does not have a smooth surface; and
(v) the actual thickness of the first layer 164 can be greater than the actual thickness of the second layer 166, even though the second layer is usually thicker than the first layer.

A similar examination of the second layer 166, which does not include starch, as that layer extends across FIGS. 4C-4G permits several similar observations:

(i) the second layer 166 is not continuous in the direction of the base web 140;

(ii) the second layer 166 does not ha e a uniform thickness;

(iii) the second layer 166 has a non-uniform thickness;

(iv) the second layer 166 tends to have a smooth surface, but the base web (paper) has areas—e.g., 170 (FIG. 4D), 172, 174 (FIG. 4E), and 176 (FIG. 4F)—which are devoid of the add-on material constituting the second layer 166.

Differences such as those discussed above demonstrate that the schematic descriptions of paper with one or more layers of add-on material are at significant variance with the real world results of applying one or more layers of add-on material to a base web 140. Accordingly, while the schematic representations of add-on layers fairly show the process application rates, as might be used as a guide to etch application zones of a gravure print cylinder or the like, those schematic representations do accurately represent the structure of the finished wrapper prepared by applying one or more layers of add-on material to a base web.

An Illustrative Embodiment—Solid Sand Pattern

Figure 10:
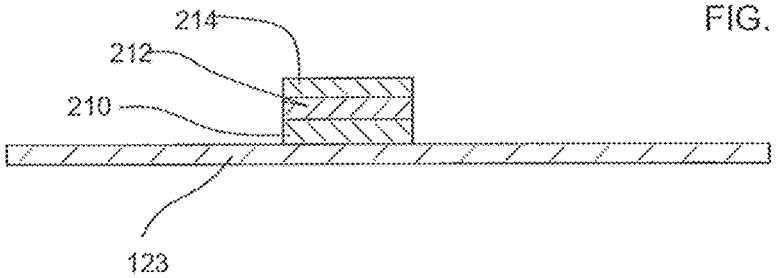
FIG. 10 is a schematic cross-sectional view, similar to FIG. 9, of a multi-layer band construction.

Referring now to FIG. 10, in a presently preferred embodiment of multi-layered application of add-on material to construct a solid band configuration from a multi-application of add-on, material and having a band width in the range of approximately 6 to 7 mm. A first layer 210 of the band may be applied at a rate of 4X and may comprise an aqueous solution containing approximately 16% starch, 60% chalk or calcium carbonate, and 60% 1,2 propylene glycol. The second layer 212 may be applied as a smaller rate of 3.5X and may comprise the same solution as the first layer. The third layer 214 may be applied at an even lower rate of 3X and may comprise an aqueous solution containing 16% starch, and 60% 1,2 propylene glycol. In this formulation, the 60% value for starch and propylene glycol means that the weight of those components is included at 60% of the weight of the starch in the aqueous solution. After the various layers have dried, the resulting base web has regions of add-on material in which starch is present at about 1.5 gsm, 1,2 propylene glycol is present in the range of about 0.36 to about 0.90 gsm, and calcium carbonate is present in the range of about 0.64 to about 12 gsm.

With inclusion of the propylene glycol in this embodiment as described, one may achieve the associated advantages summarized above (in the Summary) and detailed further in the description which follows.

With inclusion of the chalk in this embodiment as described, one may abate the tendency of the banded paper cigarettes to self-extinguish, enhance appearance of the product to a consumer and achieve these and other associated advantages summarized above (in the Summary) and detailed further in the description which follows.

Likewise, with application of a third layer 214 using a composition of little or no chalk content, machine vision inspection of banded paper during printing operations is made possible and practicable, despite the presence of the chalk content in the add-on material of first and second layers 210 and 212. This feature contribute to these and other associated advantages as summarized above (in the summary) and detailed further in the description which follows.

It is also to be appreciated that with the solid band construction as described in reference to FIG. 10 one achieves a wrapper which is capable of contributing a desirable IP performance, including in many applications, an IP performance of at or about zero (0).

Difficulties Encountered with Applying Aqueous, Preferably Starch, Add-on Solutions There are advantages with the concept of using aqueous starch solutions as add-on material for making banded wrapper to control IP characteristics of smoking articles manufactured using such banded wrapper. However, the application of aqueous starch solutions to a base web creates difficulties For example, aqueous starch solutions have a tendency to penetrate the irregular, rough, and porous surface of the base web 140, and a tendency to cause transverse shrinking of the base web in the vicinity of the banded regions. As to the last point, it has been observed that when applying an aqueous starch solution to a base web about 36 inch in transverse dimension, the web may shrink about from 0.50 inch to 0.75 inch or more upon drying. This degree of shrinking would frustrate maintaining proper registration through printing and other conversion operations.

Since shrinkage is localized to the banded regions, the transverse width of the base web in the space between adjacent banded regions is greater than the transverse width of the base web in the banded regions. That disparity in transverse width gives rise to transverse waviness in the base web in those spaces between banded regions.

Such waviness in the wrapper adversely affects both the subsequent handling of the wrapper and the manufacture of smoking articles from the wrapper. For example, when wrapper with waviness is wound on a spool, or slit and wound on bobbins, the winding process flattens the waviness causing creases in the wrapper. When the creased wrapper is used to manufacture smoking articles, thole creases in the wrapper are carried into the smoking articles resulting in visually unacceptable smoking articles.

Anti-Wrinkling Agent

Surprisingly, applicants have discovered that the inclusion of an anti-wrinkling agent (preferably, such a propylene glycol) M an aqueous starch solution used to make banded wrapper in a manner consistent with the teaching herein can reduce transverse shrinkage to operationally manageable levels, alleviate pronounced wrinkling and essentially eliminate creasing problems that first presented themselves. Inclusion of an anti-wrinkling agent has been found to have additional benefits, too. For example, when an anti-wrinkling agent is incorporated into the aqueous starch solution, the anti-wrinkling agent functions as a plasticizer so that the starch is more elastic during the drying process and in the finished paper. Cracking and flaking at banded regions was alleviated. In addition, the presence of the anti-wrinkling agent appears to cause the starch solution to reside more on the surface of the base web with less penetration into that material, and thus enhance film formation. Shrinkage of the wrapper in the vicinity of banded regions formed from an aqueous starch solution that includes an anti-wrinkling agent has been observed to be in the range of about 0.0625 to 0.125 inch for a 36 inch wide base web—a range which does not result in creasing nor excessive waviness. Further, inclusion of an anti-wrinkling agent in the aqueous starch solution has been found to make possible the application of add-on material to be applied to the base web in a single application, printing pass, or the like, provided that sufficient drying capability is established with such practices. Moreover, the inclusion of an anti-wrinkling agent in the aqueous starch solution to be applied in patterns exhibiting more intricacy than solid band regions, because print registration can be more precisely maintained from print station to print station. In addition, the pot life of the aqueous starch solution is materially improved by the inclusion of an anti-wrinkling agent as disclosed herein.

Figure 2:
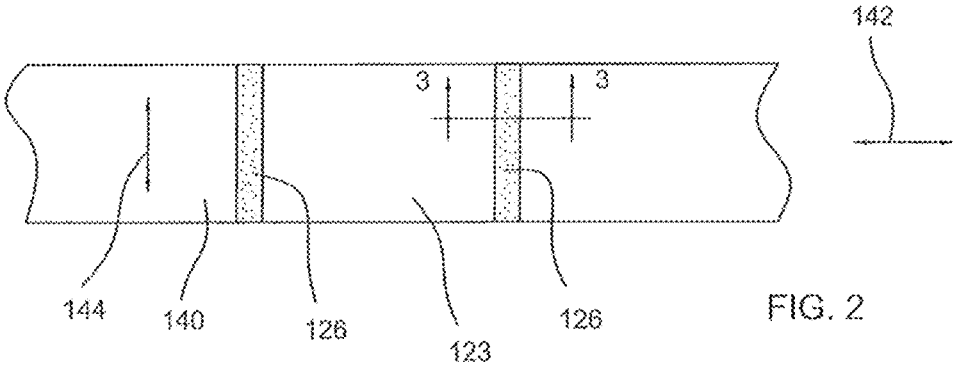
FIG. 2 is a schematic view of a wrapper paper according to this disclosure.

The foregoing advantages will be better understood by those skilled in the art from the following teachings. Referring now to FIG. 2, the regions 126 of add-on material determine and regulate the IP and SE characteristics of the smoking article. Those regions 126 of add-on material are applied to a base web 140 (see FIG. 2) of the wrapper 123 and then formed into a tobacco rod in conventional cigarette making equipment. Nominal permeability of the base web 140 may be in the range of about 25 to about 100 CORESTA. Currently, the preferred nominal permeability of the base web lies in the range of about 33 to about 65 CORESTA, with the most preferred nominal permeabilities being about 33 and about 60. The base web 140 has a longitudinal direction 142 extending along the length of the wrapper 123 and transverse direction 144 extending transversely across of the wrapper 123 so as to be generally perpendicular or transverse to the longitudinal direction 142.

Those regions 126 of add-on material may be applied to the base web 140 preferably by a printing technique. While one or more printing technique (selected from the group consisting of direct printing, offset printing, inkjet printing, gravure printing, and the like) may be used to apply the region 126, preferably a gravure printing be used. Gravure printing provided ample control over deposition rates, deposition patterns, and the like, and is suitable for high-speed printing on the base web 140. For purposes of this disclosure, "high-speed" printing refers to printing processes where the base web 140 advances through the printing process at a linear speed greater than about 300 feet/min. For cigarette manufacturing purposes, base web printing speeds greater than 450 feet/min, are preferred, and speeds greater than 500 feet/minute or more are even more preferred. In this regard, the rates of deposition for add-on material, as well as the quality of the pattern of deposited add-on material, can vary considerably when wrapper prepared by high-speed printing processes is compared with wrapper prepared by low-speed printing processes. Higher-speed printing operations can achieve both desirable IP values (performance) and desired SE values (performance).

Remarkably, it has been found that a base web may be converted (printed) to include bands in accordance with the embodiment described with reference to FIG. 10 at 1000 feet per minute, with acceptable paper appearance (i.e., without quality defects) and without elevated or unacceptable statistical occurrences of creases or wrinkles.

One object of this description is to provide wrappers 123 (see FIG. 2) produced at commercial-scale high-speed which, when formed into a tobacco rod, exhibit IP values no greater than 25% and SE values no greater than 50%. Accordingly, deposit rates acid characteristics of the resulting printed regions are important features of high-speed printing here. While those IP and SE values are considered to be adequate at this time, even more preferred is an IP value for the resulting smoking article no greater than about 15%; and the most preferred IP value for the resulting smoking article is no greater than about 10%. Lower SE values are also desired. In this connection, a more preferred SE value is less than about 25%; while the most preferred SE value is less than about 10%.

The materials used for the regions of add-on material can be important in the IP and SE performance of a smoking article manufactured using the wrapper discussed herein. In one embodiment, the regions of add-on material may be printed with a starch solution that includes an anti-wrinkling agent. While an aqueous starch solution is presently preferred as the aqueous component is readily dried, use of a non-aqueous starch solution is also within the spirit and scope of this disclosure. In another embodiment, the regions of add-on material may be printed with a solution comprising a mixture of calcium carbonate (or chalk) particles, starch, and an anti-wrinkling agent. As with the starch and anti-wrinkling agent solution, the solution comprising a mixture of calcium carbonate (or chalk) particles, starch, and an anti-wrinkling agent preferably is applied as an aqueous solution, but a non-aqueous solution also fills within the spirit and scope of this disclosure.

This disclosure contemplates that various anti-wrinkling agents are suitable to attain the desired characteristics described herein. In particular, the anti-wrinkling agent is selected from the group consisting of glycerin, propylene glycol, and 1,2 propylene glycol. Glycerin is a preferred member of the anti-wrinkling agent group. Presently, however, 1,2 propylene glycol is the most preferred member of the anti-wrinkling agent group.

Generally speaking, this disclosure contemplates that either (i) an anti-wrinkling agent or (i) a combination of anti-wrinkling agent and calcium carbonate will be added to a nominal aqueous starch solution to obtain the add-on solution to be used for printing. For the nominal aqueous starch solutions used in this description, the starch may comprise from about 10% to about 28%, by weight, of the nominal solution. Preferably, the starch may comprise from about 14% to about 26%, by weight of the nominal solution. Most preferably, starch may comprise about 16%, by weight, of the nominal solution.

An anti-wrinkling agent is preferably added to the nominal starch solution, with the weight of the anti-wrinkling agent being in the range of about 10% to about 120% of the weight of the starch in the nominal starch solution. When the anti-wrinkling agent is 1,2 propylene glycol, the weight of the anti-wrinkling agent is more preferably in the range of about 40% to about 120% of the weight of the starch in the nominal starch solution; even more preferably in the range of about 40% to about 80%; and most preferably in the range of about 55% to about 65%. Where the anti-wrinkling agent is glycerin, the weight of the anti-wrinkling agent is more preferably in the range of about 10% to about 45% of the weight of the starch in the nominal starch solution; even more preferably in the range of about 20% to about 40%; and most preferably about 20% to about 30%. Where glycerin is used as the anti-wrinkling agent at about 40 to about 45%, the glycerin appears to adversely affect the drying quality of the add-on solution.

EXAMPLES

The following illustrative, non-limiting examples are intended to provide further explanation. The results provided in Tables I and II compare the initial viscosity and time stability of a printing solution without an anti-wrinkling agent additive and to the initial viscosity and time stability of a printing solution with an anti-wrinkling agent additive. The observations recorded in Table I (for 1,2 propylene glycol) and Table II (for glycerin) show that a printing solution containing an anti-wrinkling agent such as 1,2 propylene glycol or glycerin is less viscous initially and more stable in that it has a lower viscosity for a much longer period of time.

TABLE I

| | Viscosity of 24% starch solution + 80% $CaCO_3$[1] | Viscosity of 24% starch solution + 80% $CaCO_3$ + 100% 1,2 propylene glycol[2] |
|---|---|---|
| Day 1 | 65 centipoises (cp) | 50 |
| Day 2 | 71 | 51 |
| Day 3 | 77 | 50 |
| Day 4 | 88 | — |
| Day 6 | — | 52 |
| Day 7 | 147 | 58 |
| Day 8 | — | 61 |
| Day 9 | — | 66 |
| Day 10 | 225 | 70 |
| Day 16 | — | 114 |

[1]$CaCO_3$ added to a solution of 24% dry starch in water; ratio by weight of added $CaCO_3$ to dry starch present in the solution is 0.8:1.0.

[2]$CaCO_3$ added to a solution of 24% dry starch in water; ratio by weight of added 1,2 propylene glycol to added $CaCO_3$ to dry starch present in the solution is 1.0:0.8; 1.0.

TABLE II

| | Viscosity of 20% starch solution + $CaCO_3$[1] | Viscosity of 20% starch solution + $CaCO_3$ + glycerin[2] |
|---|---|---|
| Day 1 | 51 centipoises (cp) | 41 cp |
| Day 2 | 50 cp | — |
| Day 5 | 66 cp | 52 cp |
| Day 6 | 78 cp | — |
| Day 7 | 102 cp | — |
| Day 8 | — | 55 cp |
| Day 12 | — | 62 cp |
| Day 14 | — | 72 cp |

[1]$CaCO_3$ added to a solution of 20% dry starch in water; ratio by weight of added $CaCO_3$ to dry starch present in the solution is 1:1.
[2]$CaCO_3$ and glycerin added to a solution of 20% dry starch in water; the ratio by weight of added glycerin to added $CaCO_3$ to dry starch present in the solution is 1:5:5.

The foregoing Tables demons rate that the useful shelf-life of the printing solution using anti-wrinkling agent, as measured by its viscosity, essentially doubles the shelf-life of a printing solution without the anti-wrinkling agent. The addition of an anti-wrinkling agent in the material applied to the add-on regions thus improves rheological properties of the printing solution used to form the regions of add-on material.

When the add-on material is applied with a printing technique, viscosity of the applied material is important. Where the viscosity of the applied material increases over time, the add-on material has a finite shelf life, or pot life, after which the material loses its usefulness. As Table I demonstrates, with the addition of an anti-wrinkling agent to the applied material formulation, the initial viscosity of add-on material can be reduced by about 20%. Moreover, the shelf life, or pot life, of the add-on material increases by a factor of at least two or more compared to material not having an anti-wrinkling agent.

The results provided in Tables III and IV indicate that addition of an anti-wrinkling agent to the printing solution reduces free-burn SE without unacceptably affecting IP performance (i.e., while maintaining an acceptable IP levels). For purposes of the information presented in Table III, batches of 40 cigarettes were tested to obtain the IP performance, while batches of 20 cigarettes were tested at each angular position to Obtain the SE performance.

TABLE III

| Print solution with 22% Starch + 100% 1,2 propylene Glycol[1] + $CaCO_3$ | | | | | | |
|---|---|---|---|---|---|---|
| $CaCO_3$ % | Width, mm | IP % | SE(0°) | SE(45°) | SE(90°) | SE(Avg) |
| 40 | 7 | 0 | 40 | 85 | 100 | 75 |
| | 7 | 0 | 35 | 90 | 100 | 75 |
| | 6 | 0 | 75 | 100 | 100 | 92 |
| | 6 | 5 | 0 | 60 | 100 | 53 |
| 60 | 7 | 0 | 10 | 80 | 100 | 63 |
| | 7 | 0 | 10 | 75 | 95 | 60 |
| | 6 | 5 | 25 | 85 | 100 | 70 |
| | 6 | 10 | 5 | 40 | 50 | 32 |
| 80 | 7 | 7.5 | 5 | 60 | 90 | 51 |
| | 7 | 5 | 0 | 65 | 85 | 50 |
| | 6 | 25 | 0 | 45 | 50 | 32 |

[1]1,2 propylene glycol added to a solution of 22% dry starch in water; 1,2 propylene glycol added to the starch solution with the ratio of 1,2 propylene glycol to dry starch being 1.0:1.0; and $CaCO_3$ being added to the starch solution in the weight percentage stated, measured relative to the weight of dry starch used in the solution.

From Table III, certain conclusions can be drawn. For example, the IP stayed well under the 25% target value for 7 mm bands. In addition the IP stayed well under the 25% target value when $CaCO_3$ weight was less than 80% of the starch weight. Further, the average SE values was less than or equal to 70% when $CaCO_3$ weight was greater than 40% of the starch weight; and SE at 0° was less than or equal to 25 when $CaCO_3$ weight was greater than 40% of the starch weight.

For purposes of the information presented in Table IV, smaller groups of cigarettes were tested, namely groups of five. The cigarettes tested for the results in Table IV were prepared with two hand-brushed bands using the add-on material solution as indicated in Table IV.

TABLE IV

| Solution | IP | SE (at 0°) |
|---|---|---|
| 20% starch solution | 0 out of 5 | 3 out of 5 |
| 20% starch solution + glycerin[1] Weight ratio of glycerin to dry starch = 1:5 | 0 out of 5 | 1 out of 5 |

[1]Glycerin added to a solution of 20% dry starch in water; ratio by weight of added glycerin to dry starch present in the solution is 1:5.

For both solutions containing an anti wrinkling agent, all of the cigarettes self-extinguished before the coal reached the filter line in the IP test. However, in the SE test (at 0°), for the solution without an anti-wrinkling agent, 60% of the cigarettes self-extinguished before the filter line, whereas for the solution containing an anti-wrinkling agent, only 20% of the cigarettes self-extinguished before the filter line. The self-extinguishment thus remains below a common target of 25%. The ignition propensity performance was excellent, with the resulting value of 0% being well below target values of 10%, 15%, or 25% often used. Thus, the addition or inclusion of an anti-wrinkling agent in the regions of add-on material reduces free-burn self-extinguishment (SE) without adversely affecting ignition propensity (IP) performance.

Inclusion of an anti-wrinkling agent in the add-on material also enhances characteristics of the resulting banded wrapper. More particularly, an anti-wrinkling agent has been found to increase flexibility of add-on material when dried on the wrapper (i.e., it acts as a plasticizer). As a result, bands of add-on material are less prone to separate from the base web during handling and use than bands on wrapper Where an anti-wrinkling agent is not used in the formulation. Furthermore, as noted above, incorporation of an anti-wrinkling agent in the add-on material gives rise to improved SE performance in a smoking article fabricated from wrapper having bands of add-on material including an anti-wrinkling agent—but without degradation of IP performance.

While the operation of the anti-wrinkling agent in the starch solution is not fully understood, it appears that the anti-wrinkling agent also functions as a plasticizer in the starch solution. A starch solution, without an anti-wrinkling agent capable of also functioning as a plasticizer tends to infiltrate the top surface of the paper structure. Moreover, without the agent, a starch solution tends shrink or contract when it dries. That shrinkage and/or contraction causes the underlying web to also shrink or contract, in the area underlying the banded region. By way of example, observations have shown that the width of a 36 inch wide paper web may shrink by as much as about 0.5 to about 0.75 inches in the banded region—in other words by about 1 to about 2%. Such shrinkage may create difficulties, such as in maintaining proper registration among multiple print stations when using multi pass printing, among others.

Since the underlying web, between banded regions, does not experience the shrinkage, the region between the banded regions exhibits waviness, where the waves extend in the longitudinal direction of the underlying web and the undulations of the waves occur in the cross-web or transverse direction of the underlying web. After the underlying web is slit longitudinally into portions sized to manufacture cigarettes, each of those longitudinal portions of the paper web is wound tightly OD a corresponding bobbin. Accordingly, the undulations described above sometimes result in creases in the unbanded regions where the paper folds on itself to adjust to the width reduction caused by shrinkage in the banded regions. Such creases in the wrapper are generally unacceptable for tobacco rod production. The effect of that shrinkage can be easily seen in FIGS. 60A, 60B, 60C. Those figures are optical microscope images of the wrinkled region between print banded regions where a single application of film-forming material is applied at 5.5X. The film-forming material used contained 22% starch and 40% chalk or calcium carbonate.

Thus, the shrinkage of the banded regions appears to be a cause of wrinkling in the unbanded, or imprinted, area of the wrapper. Again, the mechanisms are not fully understood, but the addition of an anti-wrinkling agent to the starch solution appears to cause the printed layer or banded region to be more flexible. That flexibility may result from the printed starch layer being more elastic. That flexibility may also result from the printed layer hay reduced infiltration into the paper structure such that the printed layer lies more on the surface of the paper web. Regardless of whether those mechanisms, a combination of those mechanisms, or some other mechanism is active, observations indicate that, when the wrapper flexes, the enhanced elasticity of the layer or banded region reduces the likelihood that the layer Or banded region will separate from the wrapper. Moreover, the elasticity of the layer or banded region appears to allow the layer or banded region to dimensionally conform to the underlying paper as the applied solution dries—hence shrinkage in the banded region is reduced and, simultaneously, wrinkling and/or puckering between the banded regions is also reduced. Accordingly, incorporating the anti-wrinkling agent in the starch solution counteracts the wrinkling described above.

The effect of adding an anti-wrinkling agent to a film-forming material may be easily seen in FIGS. 60D, 60E, 60F, 60G, 60H, 60I, which are photographs taken through an optical microscope of the region between print banded regions under the same conditions as FIGS. 60A-C. In FIGS. 60D-60F, glycerin was used as an anti-wrinkling agent. The film-forming material was applied at 5.5X, and contained 22% starch, 40% chalk, and 20% glycerin. FIGS. 60G-60I, 1,2 propylene glycol was used as an anti-wrinkling agent. In these figures, the film-forming material was applied at 5X. and container 22% starch, 40% chalk, and 100% propylene glycol, FIG. 60 demonstrates the surprising impact on print banded paper obtained by adding an anti-wrinkling agent to the film-forming material.

A further advantage of the anti-wrinkling agent be herein disclosed concerns the film-forming attributes of the solution. More particularly, inclusion of the anti-wrinkling agent in the add-on material seems to enhance the film-forming characteristic of the add-on material with respect to the surface of the base web to which the add-on material is applied. That improved film-forming characteristic is believed to enhance the IP performance of banded wrappers constructed from the add-on material. Moreover, the film-forming characteristic enhances the desired, occlusive effect of the layer sufficiently such that it may be possible to reduce the number of multi-pass applications that may have been needed with solutions not having the anti-wrinkling agent. With the anti-wrinkling agent, single pass operation may be possible with addition of adequate drying capability.

Some further advantage has been observed when 1,2 propylene glycol is used as the anti-wrinkling agent. Specifically, 1,2 propylene glycol can be effectively used where the ratio of 1,2 propylene glycol weight to starch weight in the solution is about 100%. By contrast, glycerin can be effectively used when the ratio of glycerin weight to starch weight in the solution is less than 40% because at that ratio the drying time for the starch-and-starch-plasticizer solution becomes unacceptable. That difference in drying time may result from the difference in boiling point for glycerin (290° C.) and the boiling point for 1,2 propylene glycol (187.3° C.)—a difference of about 100° C. For 1,2 propylene glycol, the boiling point is closer to the boiling point of an aqueous solvent than is the boiling point of glycerin.

With the addition of an anti-wrinkling agent to the starch solution, permeability of the banded region is improved, i.e., the permeability is more uniform and is lower than permeability for a band that does not use plasticizer. This phenomenon is significant because it permits the required quantity of starch solution to be applied or printed in a single printing step. Those skilled in the art will appreciate that, in the past, multiple printing steps were typically needed to effect the necessary permeability reduction in the banded regions. Of course, it may still be desirable—for other reasons—continue use of multi layer printing operations.

Calcium Carbonate

Calcium carbonate, or chalk, is preferably added to the nominal starch solution in addition to the anti-wrinkling agent, the weight of chalk may lie in the range of 0% to about 100% of the weight of starch in the nominal solution; preferably in the range of about 40% to about 100%; and most preferably in the range of about 40% to about 80%, with a preferred target level of approximately 60%. Chalk may be added to the nominal starch solution to adjust the reflectance of the resulting add-on material so as to be comparable to the reflectance of the uncoated base web material. With such reflectance, banded regions constructed from the add-on material are less visible to the casual observer.

The $CaCO_3$-to-starch ratio may also be a significant factor in determining IP and SE performance of a smoking article fashioned from the wrapper of this disclosure, when prepared by high-speed printing. The $CaCO_3$-to-starch ratio is determined as the ratio, by weight, of calcium carbonate to starch for the region of add-on material. More specifically, a $CaCO_3$-to-starch ratio of less than about 0.8 is preferred to obtain desired IP performance together with improved SE (at 0°) performance less than about 25%. CaCO3 is included in the make-up of the embodiment described with reference to FIG. 10 to enhance its SE performance, among the other reasons set forth herein.

From the foregoing description and the attached drawings, those skilled in the art will understand that a method of manufacturing a banded wrapper for smoking articles has been described. In that process, banded regions 126 (see FIG. 2) of add-on material are established as spaced locations on one surface of the base web 123. Spacing of those banded regions 126 may be selected so as to be substantially greater than the width of those banded regions 126 in the longitudinal direction 142 of the base web 140. The width of the banded regions 126 may be selected to lie in the range of about 5 to about 10 mm (millimeters); and the spacing between those banded regions 126 (that spacing being measured as the distance from the trailing edge of one banded region to the leading edge of the next adjacent banded region) may be in the range of about 12 to about 40 mm.

Preferred Starch Compositions and Their Preparation

Banded regions of this disclosure preferably comprise an aqueous solution containing starch, chalk or $CaCO_3$, and an anti-wrinkling agent. While many types of starch are contemplated, tapioca starch is presently preferred for the starch component of the layers 210, 212, 214 (FIG. 10). A suitable commercially available starch is FLO-MAX8 available from National Starch & Chemical Co.

Unexpectedly, it has been found that certain, characteristics of the starch material give rise to predetermined patterns that yield very low Ignition Propensity values when the patterned base paper is formed into smoking article. Even more surprising has been the realization that within the standard specifications for some well-known starch materials, batch-to-batch variations in material properties can affect the Ignition Propensity of the resulting smoking articles. By way of example, the specifications of an oxidized tapioca starch commercially offered by National Starch & Chemical Co. as Flo-Max 8 indicate a pH in a 1% solution lying in the range of 4.5 to 6.5, with particles having molecular weights in excess of 10,000. Surprisingly, when a predetermined pattern was applied to a base web with a batch of Flo-Max 8 having a pH in the range of about 6 to about 6.5, IP has been found to be much improved when compared to other batches of Flo-Max 8 for which the pH was less than about 6 but still within the manufacturer's specifications.

Various balances or trade offs need to be made in selection of starch parameters for use in applying films to wrapper. For example, while high molecular weight starch may give rise to effective permeability, reduction, such high molecular weight starches must be used in low concentrations, resulting in a solution having a very high water content. But high-water-content films are much more difficult to effectively dry on porous wrapper. Moreover, it has been found that surface tension of the starch solution affects the retention of small bubbles of air-low surface tension allows smaller bubbles to remain in the solution, whereas high surface tension causes bubbles to agglomerate and separate out of the solution giving a more uniform and consistent material for application to the wrapper.

Although not fully understood, the preferred pH range of the oxidized starch is believed to reflect a lower degree—or less complete—oxidation of the starch polymer chains giving more, longer polymer chains than the more acidic (i.e., lower pH) starches.

Furthermore, longer polymer chains yield a solution having a higher viscosity. Higher viscosity for the starch solution translates to better control when applied to a wrapper in a printing process.

Based on these understandings, it has been found that marked improvement in the IP of patterned, wrapper results for starch solutions having particular, and improved, characteristics. Those characteristics for an aqueous solution including oxidized starch include a pH in the range of about 6 to about 6.5; a surface tension of at least about 65 dynes/centimeter; a room temperature viscosity of no greater than about 50 centipoises; and a particle size distribution in the range of about 4 to about 40 microns for dry particles, with about 90% also being in the range of about 10 to about 100 microns when wet. Furthermore, the particles preferably have a molecular weight such that the solution can have starch concentrations in the range of about 14% to about 24%. Preferably, the starch comprises an oxidized tapioca starch.

The aqueous starch solutions used for application to the base web or wrapper ire typically prepared by making a starch/water mixture by first mixing the desired weight of dry starch powder with the desired weight of room temperature water (i.e., at about 15° C. to about 25° C.) to obtain a starch/water mixture having the reselected concentration. For example, to prepare a starch/water solution with a reselected concentration of 20%, 20 parts by weight of starch are mixed with 80 parts by weight of water. The stanch/water solution is then heated to an elevated sub-boiling temperature in the range of about 90° C. to about 95° C.—i.e., below the boiling temperature. The starch/water solution is held at the elevated temperature for about 20 to about 30 minutes for thermal soaking. Then, the starch/water solution is cooled to room temperature. That cooling step can occur by passively, such as by naturally occurring heat transfer processes; or the cooling step can be active (or forced) such as by immersion in a cooling bath or by use of a conventional mechanical cooling system. Throughout the mixing step, the heating step, the thermal soaking step, and the cooling step, the starch/water mixture is stirred. The stirring can be continuous Or substantially continuous. If additional constituents, such as calcium carbonate, are to be incorporated into the starch/water solution, those constituents should be added after the starch/water solution returns to room temperature following the thermal soaking step.

Aqueous starch solutions having the characteristics specified above and prepared in the manner described above can be applied to a base web using any of a multitude of printing techniques including, by way of example and without limitation, the group consisting of gravure priming, offset printing, inkjet printing, spraying, and die printing. Other printing processes may also be suitable and are intended to lie within the teachings of this specification. Preferably, however, gravure printing may be used to apply the starch solution to a base web to obtain a patterned wrapper.

Surprisingly, it has been found that the $CaCO_3$/starch ratio is a significant factor in determining IP and SE performance of a smoking article fashioned from the wrapper of this disclosure prepared by high-speed printing. The $CaCO_3$/starch ratio is determined as the ratio, by weight, of calcium carbonate to starch for the region 126 of add-on material, i.e., for both layers. More specifically, a $CaCO_3$/starch ratio of at least about 35% is preferred to obtain IP and SE(0) performance less than about 25%. Even more preferred is a $CaCO_3$/starch ratio of at least about 45% to obtain IP and SE(0) performance less than about 20%.

If desired, the layer 150 printed on the base web 140 (see FIG. 3) may be the starch layer, and the layer 152 may be the layer comprising a mixture of starch and calcium carbonate. A presently preferred arrangement, however, places the mixture of starch and calcium carbonate in the first layer 150 and applies only starch in the other layer 152.

It has been observed that (i) the optical reflectance of the base web 140 and (ii) the optical reflectance of the mixture of starch and calcium carbonate are quite similar. In fact, those two reflectances are sufficiently similar that optical inspection equipment can have operational difficulty. On the other hand, (i) the optical reflectance of the base web 40 and (ii) the optical reflectance of a layer comprising starch have been observed to be substantially different.

The different reflectance characteristics of the layers 150, 152 are advantageously used to enhance the optical inspection characteristics of the wrapper of this disclosure. With the starch layer deposited on top of the starch-calcium-carbonate layer, optical inspection of the wrapper is materially enhanced. More particularly, as the base web 140 advances from a supply bobbin through the gravure printing apparatus to the take-up bobbin, the web 140 may also pass through an inspection station. In the inspection station, a light source is focused on the moving web 140. A light beam emanating from the light source reflects from the surface of the moving base web 140 such that the reflected light is collected by a sensor. As each region 126 of add-on material moves through the inspection station, the region 126 interrupts the light beam and modulates the quantity of light reflected to the sensor. Because the reflectance of the starch layer is different from the reflectance of the base web 140, the sensor can be constructed to sense the presence or absence of a region 126. When coupled with an input related to the speed of the base web through the inspection station, an even more sophisticated sensor can determine the width of the region 126 in the longitudinal direction of the base web 140, as well as longitudinal spacing between adjacent regions, for quality control and manufacturing consistency. In connection with inspection of banded regions, please also see commonly assigned U.S. Pat. Nos. 5,966,218 and 6,198,537 which are incorporated herein by this reference thereto.

Surprisingly, as calcium carbonate levels are increased in the banded regions 126 exposed to the optical inspection, or machine vision, systems, those systems have been observed to become less reliable. That reduced reliability appears to result from increased reflectivity of the surface of the banded regions 126. Such increased reflectivity overwhelms, or "blinds", the inspection systems—a phenomenon perhaps resulting because the reflectance of banded regions 126 with high calcium carbonate levels is comparable to, and may be substantially equivalent to, the reflectance of the base web itself. That reflectance parity seems to result when the calcium carbonate level in the surface region of the handed regions 126 is greater than about 80% of the starch level in the surface region of the banded regions 126.

That reflectance parity problem can be alleviated by establishing at structure for the banded regions 126 in which the surface region has a reflectance which is sufficiently different from the reflectance of the base web that the inspection systems consistently identify the reflectance variation to identify parameters related to the banded regions 126, including by way of example presence of the reflectance variation (beginning or end of banded region 126), absence of the reflectance variation (a missing banded region 126, or a misplaced banded region 126), and longitudinal extent of a banded region 126 or spacing between banded regions 126 (e.g., how long a particular reflectance continues for a sensed velocity or speed of the base web through the inspection station). One way of establishing a desired structure for the banded regions 126 is to provide the increased calcium carbonate layer in a position more remote from the inspection system than the layer having essentially starch. Stated differently, by superposing the starch layer on the calcium-carbonate-containing layer efficacy of optical inspection systems will not be impeded, but will continue to be effective.

Such an arrangement of layers in the banded region 126 provides another surprising and beneficial attribute for the wrapper. When the first layer of the banded region 126 applied to the base web contains both calcium carbonate and starch, the presence of the banded region 126 is less evident when observed or examined from the side of the base web opposite to the side on which the banded region 126 is applied—the side opposite from the side where machine vision operates. In fact, as the calcium carbonate levels approach high levels Which are the subject of this disclosure, presence or existence of the banded region 126 becomes less visible to a consumer, and may actually become substantially invisible to an ordinary consumer.

Such visual masking is important because consumers of smoking articles are accustomed to products in which the wrapper exhibits a uniform, homogeneous appearance. The preferred arrangement for the layers 150, 152 (see FIG. 3) yields a further significant advantage to a smoking article manufactured using the wrapper of this disclosure.

Similarly, many types of calcium carbonate particles are contemplated as falling within the spirit and scope of this disclosure. Presently, however, calcium carbonate available from Solvay Chemicals, Inc., as SOCAL 31 is a suitable commercially available calcium carbonate. SOCAL 31 is an ultrafine, precipitated form of calcium carbonate having an average particle size of about 70 nm (nanometers). Larger particles of calcium carbonate have been observed to not function as well in this application when compared to the ultrafine, precipitated form of calcium carbonate, due at least in part to the tendency of larger particles to precipitate from solution more quickly and due at least in part to the need for greater quantities to attain the beneficial characteristics discussed herein.

The materials used for the regions of add-on material can be important in the IF and SE performance of a smoking article manufactured using the wrapper discussed herein, in one embodiment, the regions of add-on materiel may be printed with a starch solution that includes an anti-wrinkling agent. While an aqueous starch solution is presently preferred as the aqueous component is readily dried, use of a non-aqueous starch solution is also within the spirit and scope of this disclosure. In another embodiment, the regions of add-on material may be printed with a solution comprising a mixture of calcium carbonate (or chalk) particles, starch, and an anti-wrinkling agent. As with the starch and anti-wrinkling agent solution, the solution comprising a mixture of calcium carbonate (or chalk) particles, starch, and an anti-wrinkling agent preferably is applied as an aqueous solution, but a non-aqueous solution also falls within the spirit and scope of this disclosure.

Generally speaking, this disclosure contemplates that either (i) an anti-wrinkling agent or (i) a combination of anti-wrinkling agent and calcium carbonate will be added to a nominal aqueous starch solution to obtain the add-on solution to be used for printing.

As discussed in more detail above, incorporation of an anti-wrinkling agent in the starch solution permits the aqueous starch solution to be applied in a single printing step or layer to the underlying paper web. While an anti-wrinkling agent may also be used in a multilayer construction for a banded region applied in multiple printing steps or passes, the benefits of the anti-wrinkling agent flow from its use in the first layer applied to the base web.

Figure 11:
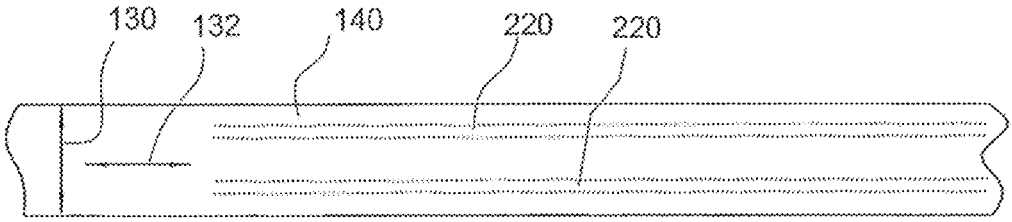
FIG. 11 is a schematic view of a wrapper having longitudinally extending, banded regions.

From the discussion above, it will now be apparent to those skilled in the art that many different patterns for the banded regions of wrapper fall within the spirit and scope of this disclosure. For example, a pattern comprising a plurality of solid transversely extending bands has been described (see FIG. 2). Solid bands may be either transversely extending, longitudinally extending 220 (see FIG. 11), or helical 222 (see FIG. 12). The description as being solid meaning, for purposes of this disclosure, that the regions of add-on material are applied in a single step.

The foregoing discussion also makes clear that the regions of add-on material may, if desired, be applied in two or more successive steps or applications. Gravure printing techniques, as well as other printing techniques, are well-suited to such successive steps, or multiple applications.

Improved SE Performance while Maintaining IP Performance

As noted above, it is desirable to achieve IP performance that meets and exceeds governmental requirements. Such is achievable with a solid band configuration such as that described with reference to FIG. 10. Moreover, as also previously noted, that desired IP performance often adversely impacts the SE performance of the smoking article. Stated differently, while the IP performance may meet or exceed the governmental requirements, that H performance is typically associated with a smoking article that will self extinguish when hand held by a smoker—an SE of 100%. Since smokers ordinarily prefer not to need to relight a smoking article improvement of SE performance while maintaining IP performance constitutes a highly desirable feature for improved wrappers. Applicants have discovered arrangements of the banded regions on wrapper that provide such improved SE performance while maintaining the IP performance. For example, the inclusion of chalk content in the embodiment described with reference to FIG. 10 contributes enhancement of SE performance amongst other attributes.

Figure 5:
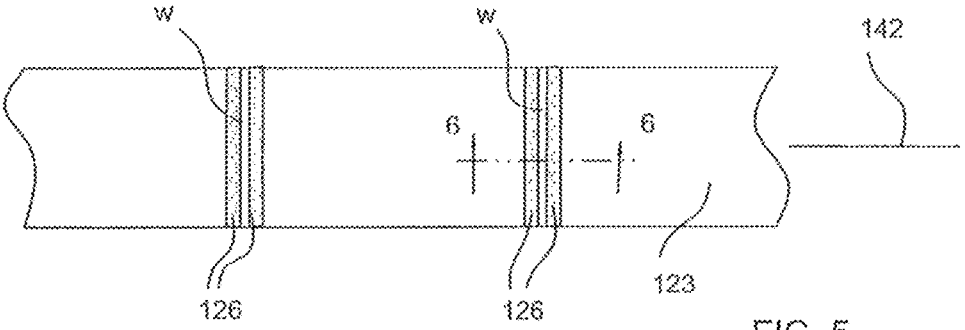
FIG. 5 is a schematic view of wrapper according to another embodiment of this disclosure.

In addition to or in lieu of applying chalk to improve SE performance, certain band configurations and patterns disclosed herein are useful in constructing smoking articles having both improved SE performance and desired IP performance. For example, a slit band configuration such as shown in FIG. 5 and others is capable of better sustaining smoldering during free burns, yet when placed adjacent a substrate, does not sustain smoldering.

Referring to Table V, wrapper A comprises a slit band arrangement, having three regions of about 2 mm each, for a total width of 6 mm for the printed banded region with add-on rates in the various regions ranging from about 3.5X to about 5.5X. An add-on rate of 5.5X results in about 8 g/m$^2$ to about 9 g/m$^2$ of add-on material on a dry weight basis, where the wrapper has a nominal basis weight of about 26.5 g/m$^2$. Lower add-on rates would be expected to provide proportionally adjusted values for the weight of the add-on material, measured on a dry weight basis. The width of the banded regions are typically measured in the longitudinal direction, and have a 27 mm phase (i.e., the spacing from the leading edge of a banded region to the leading edge of the next or subsequent banded region).

TABLE V

| Wrapper | Banded Region Configuration | Total Banded Region Width | Base Web Permeability |
|---|---|---|---|
| A | 2-2-2 | 6 mm | 33 CORESTA |
| B | 2.5-2-2.5 | 7 mm | 33 CORESTA |
| C | 2.5-2-2.5 | 7 mm | 60 CORESTA |
| D | 3-2-3 | 8 mm | 60 CORESTA |

In Table V, the "banded region configuration" is a shorthand description of the width of portions of the band, viewed in the direction which the coal advances in a burning tobacco rod. Thus, the 2.5-2-2.5 configuration (see FIG. 5) of the banded region 126 means that the first portion or zone 202 (see FIG. 6) of the total banded region width is 2.5 mm, the second portion or zone 203 of the total banded region width is 2 mm (and may be a space), and the third portion or zone 204 of the total banded region width is 2.5 mm. Here, the first portion 202 would be encountered first by the advancing coal of a burning tobacco rod, the second portion 203 would be encountered next by the advancing coal, and the third portion 204 would be encountered last by the advancing coal.

TABLE VI

| Details of Wrapper A | | | |
|---|---|---|---|
| | Zone 1 | Zone 2 | Zone 3 |
| Width | 2 mm | 2 mm | 2 mm |
| Layers of Add-on Material | 1 | 1 | 1 |
| Add-on Rate Per Layer | 5x | 3.5-4x | 5x |
| Total Add-on Material | 5x | 3.5-4x | 5x |

TABLE VII

| Details of Wrapper B | | | |
|---|---|---|---|
| | Zone 1 | Zone 2 | Zone 3 |
| Width | 2.5 mm | 2 mm | 2.5 mm |
| Layers of Add-on Material | 1 | 1 | 1 |
| Add-on Rate Per Layer | 5x | 3.5-4x | 5x |
| Total Add-on Material | 5x | 3.5-4x | 5x |

TABLE VIII

| Details of Wrapper C | | | |
|---|---|---|---|
| | Zone 1 | Zone 2 | Zone 3 |
| Width | 2.5 mm | 2 mm | 2.5 mm |
| Layers of Add-on Material | 1 | 1 | 1 |
| Add-on Rate Per Layer | 5x | 3.5-4x | 5x |
| Total Add-on Material | 5x | 3.5-4x | 5x |

TABLE IX

| Details of Wrapper D | | | |
|---|---|---|---|
| | Zone 1 | Zone 2 | Zone 3 |
| Width | 3 mm | 2 mm | 3 mm |
| Layers of Add-on Material | 1 | 1 | 1 |
| Add-on Rate Per Layer | 5x | 3.5-4x | 5x |
| Total Add-on Material | 5x | 3.5-4x | 5x |

Tables VI-IX show that the multizone banded region 126 (see FIG. 5) may be fashioned in a single pass printing operation with the application rates indicated in those tables. In each of wrappers A through D, the add-on material preferably included an aqueous solution containing starch, chalk or calcium carbonate, and 1,2 propylene glycol. A presently preferred mixture for that aqueous solution includes starch, chalk, and 1,2 propylene glycol in a weight ratio of about 100 (for starch), to about 40 to about 80 (for chalk), to about 100 (for 1.2 propylene glycol), in weight percent. The starch alone may be in the range of about 20% to about 24% in the aqueous solution.

Some changes in the relative proportions of constituents of the add-on material may change when the aqueous solution is applied to a base web and dried. For example, observations indicate that when 1,2 propylene glycol is used as the anti-wrinkling agent, about 50% to about 60% of the propylene glycol added to the solution remains in the add-on material when it has dried on the paper web. Some weight loss may also occur in other anti-wrinkling agents during the drying process. However, such weight loss has not been observed with respect to the starch and calcium carbonate constituents of the add-on material during the drying process.

Figure 7:
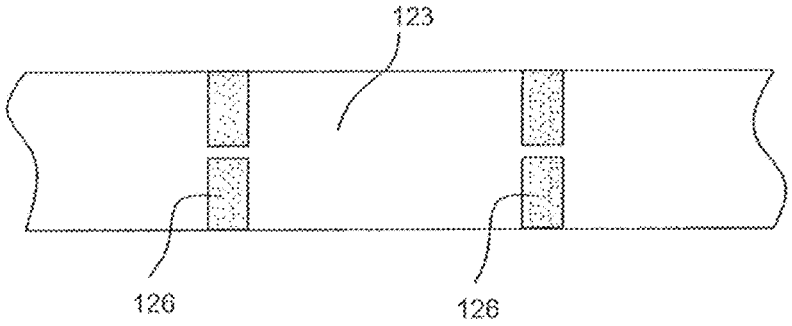
FIG. 7 is a schematic view of wrapper according to a flintier embodiment of this disclosure.
Figure 8:
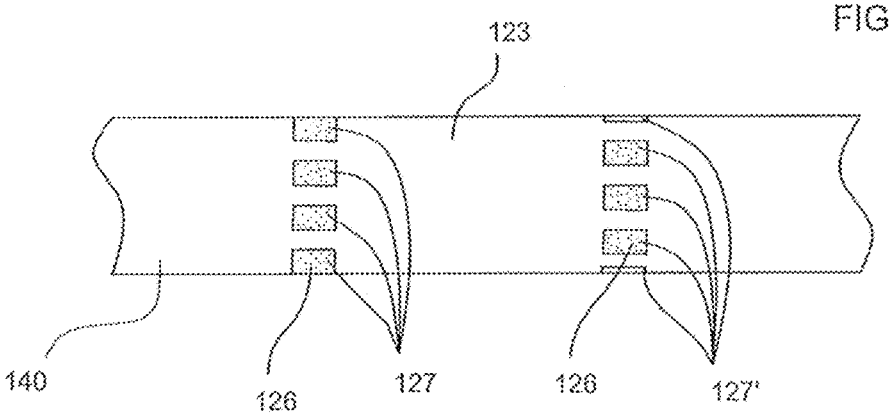
FIG. 8 is a schematic view of wrapper according to yet another embodiment of this disclosure.

The region 126 of add-on material may be substantially continuous transverse of the paper web, as shown (see FIG. 2), or may have one or more longitudinally extending separations so as to define a C-shaped region when formed into a wrapper into a tobacco rod (see FIG. 7), or may have several arcuately-shaped portions 127' (see FIG. 8) generally symmetrically positioned around the tobacco rad when viewed in cross section transverse to the longitudinal axis 114 of the tobacco rod 122.

In addition, the region 126 of add-on material on the wrapper 123 may be divided into two or more substantially ring-shaped portions (see FIG. 5) that are spaced from one another along the axis 142 by a distance, w, that typically does not exceed the width of the rings 126, when measured in a direction generally parallel to the axis 134 of the tobacco rod 122. Such a spacing feature provides a "slit" in the band structure.

It is also within the contemplation of this disclosure that the region 126 on the wrapper 123 may comprise a plurality of patches (see FIG. 8) disposed circumferentially around the tobacco rod 122, with patches 127' of an adjacent region 126 being circumferentially displaced from patches of other adjacent regions 126. In addition, the patches 127, 127' may be arranged according to a predetermined pattern such as taught in commonly assigned U.S. Patent Application Ser. No. 60/924,666, the entire contents of which are incorporated herein by this reference thereto.

Figure 9:
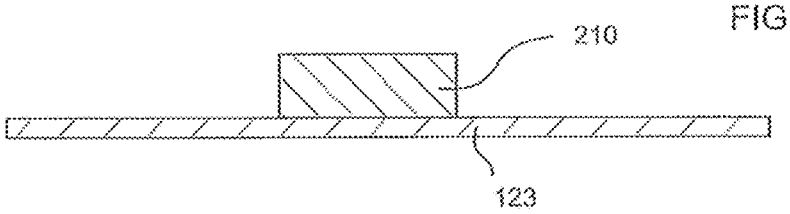
FIG. 9 is an enlarged schematic cross-sectional view taken along the line 9-9 of FIG. 2.

The regions of add-on material are preferably applied in a single layer 210 (see FIG. 9). It should be noted that the representation of the base web cross section in FIG. 9 is schematic. As discussed above, the actual cross section of a base web is a slice through the myriad of fibers which form the base web. In the case of cigarette wrapper, that thickness may be on the order of about 30 microns (i.e., $30\times10^{-6}$ meters or 30 μm). Actual thickness of the add-on material≤2 μm, and the add-on material tends to infiltrate and conform to the surface presented by the fibers of the base web. As a result, material build-up in the regions of add-on material can be schematically shown as boxes (as in FIGS. 3, 6, and 9), but actually are nearly imperceptible to the unaided eye. To that end, it will be appreciated that, if multiple layers are used to form the regions of add-on material, the resulting structure is nearly impossible to resolve into the individual layers. That resolution into individual, or separate, layers is further complicated when aqueous solutions are applied because subsequent layers tend to re-wet the previous layer and allow components such as chalk to settle through the material of the prior layer.

The application rate of the material in the preferred single layer (see FIG. 9) may be in the range of about 4X to about 6X. For these purposes, the "X" has been described above. Where the base web has a nominal CORESTA value of about 33, a presently preferred application rate of about 5X is believed to be appropriate. Where the base web has a nominal. CORESTA value of about 60, a presently preferred application rate of about 5.5X is believed to be appropriate.

Although the regions of add-on material are preferably applied in a single pass, application, or layer, this description also contemplates application of the add-on material in multiple applications steps, or layers (see FIG. 10). In this embodiment, after a first layer 210 is applied to the surface of the base web 123 at a first gravure printing station and dried, a second layer 212 (see FIG. 10) of add-on material may be applied to the wrapper, for example at a second printing station. If desired, a third or subsequent layer 214 can be applied at further printing stations. The second layer 212 may be arranged so as to be superposed on, and substantially co-extensive with, the first layer 210. Alternatively, the second layer 212 may cover only one or more portions of the first layer 210. The relative application rate of the layers need not be the same, and preferably is different. For example, one layer may be at least about 1.5 times to about 3 times the thickness of the other layer.

Figure 13:
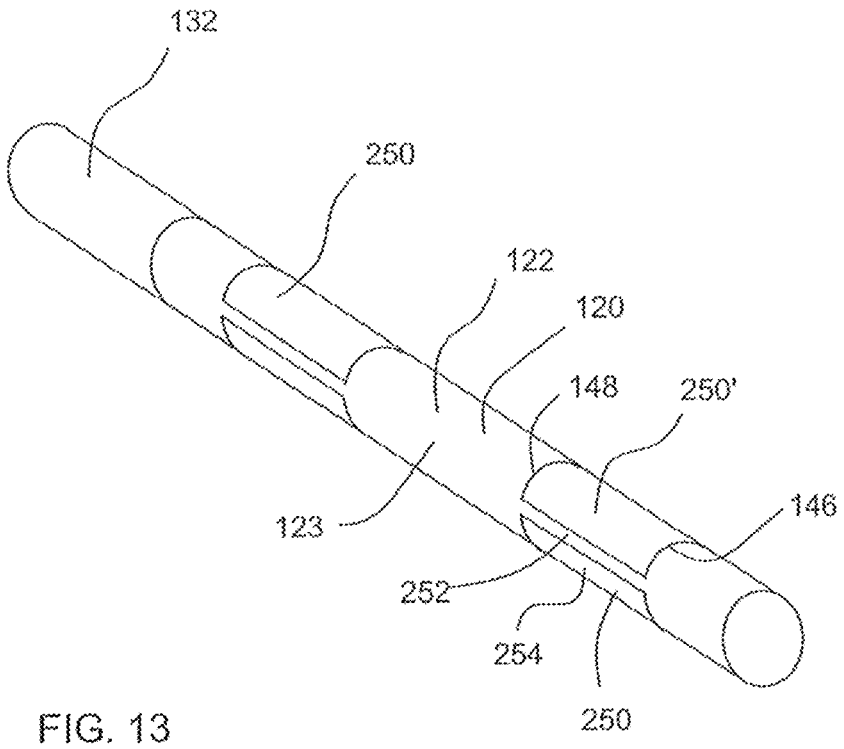
FIG. 13 is a perspective view of still another embodiment of a smoking article according to this disclosure.
Figure 15:
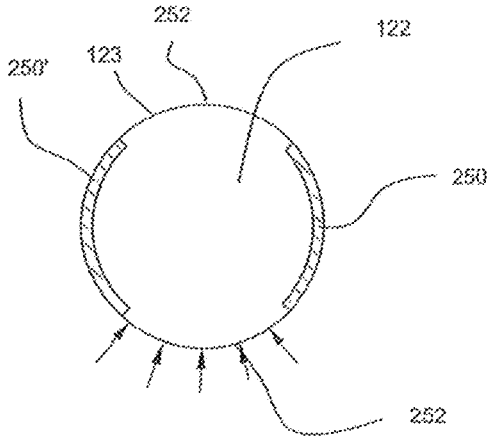
FIG. 15 is an enlarged cross sectional view of the smoking article removed from the substrate and illustrating airflow to a smoldering coal.

For example, the smoking article 120 (see FIG. 13) may include one Or more banded regions 250 that are axially spaced from one another along the axis of the smoking article 120. Each banded region 250 may include add-on material applied such that at least one longitudinally extending gap 252 exists between end portions 254 of the banded region 250. The embodiment of FIG. 13 show a single gap 252 in each of the banded regions 250; however, two or more gaps 252 may be provided around the circumference of the smoking article 120. Where more than one gap 252 is provided, the gaps are preferably generally parallel to one another and preferably are also substantially equally spaced from one another around the circumference of the smoking article 120. An embodiment of the smoking article having a pair of substantially diametrically opposed areas of add-on material may be seen in FIG. 15. As shown, the circumferential extent of the areas of add-on material 250, 250' may be substantially the same as the circumferential extent of the spaces or gaps 252 between those areas of add-on material 250, 250'.

Figure 14:
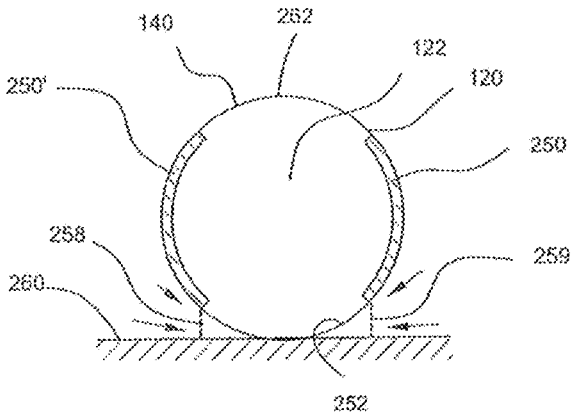
FIG. 14 is an enlarged cross-sectional view of the smoking article positioned substrate and illustrating airflow to a smoldering coal.

With the foregoing arrangement, when the smoking article 120 exists in free-burn condition (see FIG. 15), the regions of add-on material 250, 250' obstruct airflow to the burning, coal of the tobacco rod 122 by virtue of their reduced permeability. On the other hand, with the smoking article held in a substantially horizontal position, the bottom gap 252 of the wrapper 123 freely permits air to enter the side of the tobacco rod 122 to support combustion of the coal. A vastly different situation occurs when the smoking article 120 is placed on a substrate 260 (see FIG. 14). Under these conditions, the substrate 260 blocks the flow of air upwardly to the bottom portion or bottom gap 252 of the tobacco rod 122. The regions of add-on material 250, 250' and the substrate 260 cooperate to define much smaller areas 258, 259 through which air can be drawn through the base web 140 of the wrapper. More specifically, the vertical area 258 between the bottom of the region 250 and the substrate 260 and the vertical area 258 between the bottom of the region 250' and the substrate 260 present a substantial reduction in the area through which air can pass to reach the smoldering coal of the tobacco rod 122. As a result of deprivation of oxygen in the air, the smoldering coal of the smoking article 120 self-extinguishes when the burn line reaches opposed regions of add-on material positioned as depicted in FIG. 14. The condition of substantially reduced area for air to support burning of the coal also exists for rotational positions of the tobacco rod 122 between that position illustrated in FIG. 14 and other positions of the smoking article when rotated about its longitudinal axis.

However, when the smoking article 120 is placed on the substrate 260 such that one of the add-on regions 250, 250' contacts the substrate 260, the add-on regions still may sufficiently restrict the area through which air can pass to and through the base web 140, and there is a lesser degree of material cooperation between the substrate 260 and the add-on regions to effect a reduction in that area, in comparison to what occurs at the snuffer region 262. For purposes of this description, a snuffer region 262 is an area on the tobacco rod 122 which is operable to cause extinguishment of the burning coal when placed on a substrate 260.

In the foregoing example, the reduction in IP value is also associated with a reduction in SE value, and improved free-burn quality of a smoking article 120 having a wrapper with regions of add-on material such as those of FIG. 13. It will also be appreciated by those skilled in the art that the SE improvement of FIG. 15 occurs with the smoking article in a horizontal position (i.e., 0°). Similar SE improvements are also Observed at other SE evaluation positions of 45° and 90°. Where the smoking article 120 happens to be placed on a substrate 260 at one of three specific orientations, the orientations being spaced (off-set) 45° apart from each other around the axis of the smoking article, the self-extinguishing characteristics and desirable IP are also achieved. Naturally, the discussion, proceeded in this manner for the sake of brevity. It will be readily understood that a pattern according to this description can extinguish the smoking article, regardless of which side portion rests against a substrate 260 and without a need for applying film-forming compound to the paper to such an extent that a desirable free-burn quality in the smoking article is lost or such that carbon monoxide levels in the mainstream smoke become elevated. This may be understood by recognizing that opposing regions of film-forming compound need not appear at locations exactly 90° from the side portion in contact with the substrate 260. Those regions may be centered at a location that is closer to or farther from the side portion in contact with the substrate 260, for example, between about 60° and 120° from the side portion in contact with the substrate 260.

Additionally, for a particular chosen pattern, the ability to extinguish the smoking article may depend more on providing minimum lengthwise extent of add-on material (e.g., a film-forming compound), rather than a particular weight per area of film-forming compound at longitudinal locations. The length of a rectangular region, for example, may be no less than about 5.5 mm for a particular design, base web, and film-forming compound used. The amount of film-forming compound used may be increased to improve IP performance, usually without losing a free-burn quality and SE performance, and if desired, a burn accelerator may be applied to the paper to support even higher add-on levels.

Previously, it was thought that a permeability ratio of 3:1 between the base web and regions of add-on material was insufficient to extinguish the smoking article because there an insufficient reduction in the permeability of the paper at the longitudinal position of the snuffer region. However, that permeability ratio, over a portion of the circumference of the smoking article, may be sufficient to extinguish the smoking article when there is an underlying substrate 260 and when the add-on material is located at sides of the smoking article 120 not in contact with the substrate 260.

Figure 16:
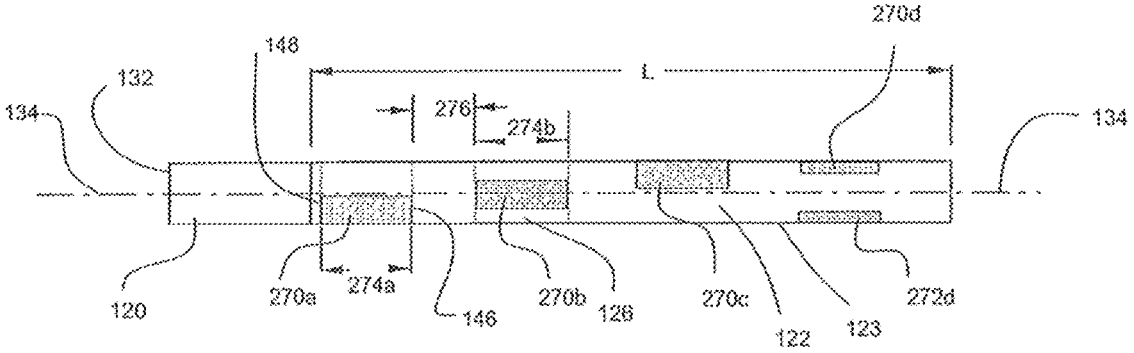
FIG. 16 is a perspective view of a smoking article in accordance with another embodiment.

Another embodiment of a smoking article which makes use of the interaction between longitudinal spaces between opposed regions of add-on material and a substrate is shown in FIG. 16. Here, a series of longitudinally spaced snuffer regions are spaced along the axis 134 of the smoking article 120. Each pair of areas of add-on material in a snuffer region may be referred to as patches for quick reference.

Figure 17:
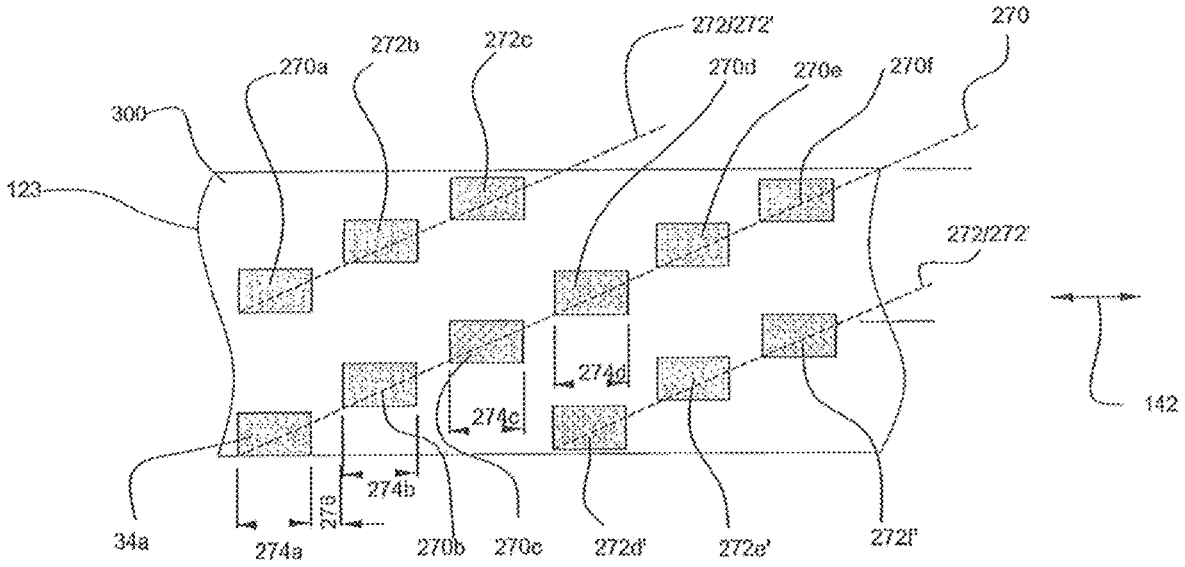
FIG. 17 is an enlarged plan view of an unwrapped portion of wrapper used in t construction of the smoking article of FIG. 16.

With reference to FIG. 17, the paper wrapper 123 further comprises pairs of add-on material zones at spaced locations along the tobacco rod 122 in FIG. 16 (such as the opposing pair of zones 270*d*, 272*d*).

Each pair of rectangular zones (for example, 270*a* and 272*a*—the latter not being visible in FIG. 16) define a circumferential region 274 (for example the region 274*a*). The "width" of the banded region 274*a* is measured from a leading edge 146 of the region 274*a* (it being closest to an approaching coal) to the trailing edge 148 (it being most remote from an approaching coal). Preferably the width of the regions, e.g., 274*a*, lies in, the range of about 5.5 to about 12 mm, more preferably, about 7 to about 10 mm, and most preferably about 8 to about 9 mm. Moreover, at each circumferential region, such as region 274*a*, the zones 270*a* and 272*a* are circumferentially spaced apart such that they are disposed in mutually opposing relation along opposite sides of the wrapper 123 when formed on a tobacco rod 122. Preferably each zone 270*a*, 272*a* extends circumferentially (i.e., in cross-measure relative to the paper web) in the range of about 5 to about 9 mm in cross-measure, more preferably, about 6 to about 7 mm in cross-measure.

It is further noted that the area 276 of base web 140 between adjacent regions 274*a*, 274*b* and the areas between opposing zones within each zone (such as between the opposing zones 270*b*, 272*b* of the Zone 274*b*) are preferably essentially free of add-on material comprising the zones (e.g., zones 270*b*, 272*b*).

The longitudinal distance between adjacent regions (such as between zones 274*a*, 274*b* is referenced as band spacing 276, which is preferably about 4 to about 12 mm, and more preferably about 6 to about 8 mm.

Preferably, the respective opposing zones 270, 272 of each region 274 are offset from those of a preceding tow or region to a degree (in accordance with teachings which follow) and a sufficient number of regions 274 are established along a given tobacco rod (by selection of band-region width and width of band-region spacing) such that, when the smoking article is placed op on a substrate, at least one location 101 exists along the tobacco rod 122 where the respective pair of regions 270 are oriented substantially alongside the tobacco rod 122, such as the opposing pair of zones 250, 250' in FIG. 14. It is at or about this location OP the tobacco rod 122 where self-extinguishment is most likely to occur. The location along the tobacco rod 122 where this orientation most closely occurs is hereinafter referenced as the "oriented snuffer region."

Because the smoking article 120 might be laid upon a substrate differently from the position shown in FIG. 16 and/or because its pattern of zones may differ, it is to be realized that the oriented snuffer zone may occur at different longitudinal positions along the tobacco rod 122 for different rotational positions of the tobacco rod 122. The pattern of zones and the and spacing 276 may be selected such that more than one oriented snuffer zone may occur along the tobacco rod 122.

Preferably, each zone 270, 272 and 272' includes sufficient add-on material to reduce the permeability of the wrapper at each zone to about 0 to about 42 CORESTA, more preferably about 7 CORESTA or less.

For purposes of this description, a pattern of add-on material is applied to the wrapper 123 to obtain improved IP characteristics and also to obtain improved SE characteristics.

As presently understood, the staggered zones of add-on material according to this description permit a smoking article 120 (see FIG. 16) to be designed with an advantageous combination of desired low IP values and desired low SE values. The patterns of low permeability regions of add-on material provide areas of film-forming compound along the length of the tobacco rod 122 that can cooperate with a substrate to extinguish the lit smoking, article 120 when it is placed on that substrate, yet these areas of add-on material (such as a film-forming compound) cause the smoking article 120 to self-extinguish at statistically fewer occurrences when the smoking article 120 is held by a smoker in a free-burn condition. Thus, the smoking article 120 can exhibit a reduced ignition proclivity while retaining a desirable free-burn quality or low SE value by applying a pattern of film-forming compound to the base web according, to this description.

To achieve desirable IP and SE characteristics of the smoking article, a pattern 300 (see FIG. 17) is applied to the base web 123 of the wrapper, preferably while the base web 123 is in an unfolded condition, such as shown in FIG. 17, or when the base web comprises a roll of cigarette paper that has yet to be slit into bobbins. An object of this description is to provide wrappers which, when formed into a tobacco rod 122, exhibit IP values no greater than 25 and SE values no greater than 50. Even more preferred, is an IP value for the resulting smoking article no greater than about 15; and the most preferred IP value for the resulting smoking article is no greater than about 10. Lower SE values are also desired. In this connection, a more preferred SE value is less than about 25; while the most preferred SE value is less than about 10.

Referring specifically to FIG. 17, the transverse dimensions of the wrapper 123 are selected based on the diameter of the finished smoking article (about 7 to about 10 mm) and allowing for overlapping material at a longitudinal seam of about 1 to about 2 mm. For example, allowing for 1 mm overlapping seams, the wrapper-paper cross-web dimension may be about 27 mm for a smoking article having a circumference of about 25.6 mm.

Preferably, the pattern 300 is applied to the base web 140 such that a plurality of circumferentially extending regions 274*a*, 274*b*, 274*c*, 274*d* (defined by broken lines in FIG. 17) are disposed at spaced locations along the tobacco rod 122 (see arrow 142, in FIG. 17). The add-on material can be applied to one or to both sides of the base web. Preferably, three to six, and most preferably four to six or more, of the regions 274 occur in the nominal length of the tobacco rod 122. Each of the circumferential regions 274*a*, 274*b*, 274*c*, 274*d* has a longitudinal pitch along the tobacco rod 122 (i.e., length measured along the tobacco rod from the beginning of one region to the beginning of the adjacent region) which is less than the nominal length of the tobacco rod 122. By selecting the longitudinal pitch length at about 25% of the nominal length, four regions will be provided on each tobacco rod 122.

Within each circumferential region, e.g., 274*a*, at least two zones, e.g., 270*a*, 272*a*, of add-on material are provided. Note that the zones of add-on material in all of the figures are identified with stippling to aid identification of them however, in a smoking article 120 or wrapper 123 for such a smoking article, these zones of add-on material may, or may not, be visually identifiable. Each of these zones is preferably spaced circumferentially such that the zones will be opposed to one another in the finished tobacco rod 122. Moreover, for each triplet of zones, e.g., 274*a*, 274*b*, 274*c*, the zones 270*b*, 272*b* of the second region 274*b* preferably are circumferentially offset from the zones 270*a*, 272*a* of the first region. Furthermore, the zones 270*c*, 272*c* of the third region 274*c* preferably are circumferentially offset from the zones 270*b*, 772*b* of the second region 274*b*, and even further offset circumferentially form the zones 270*a*, 272*a* of the first region 274*a*.

As depicted in FIG. 17, the add-on zones of each region in this embodiment are laterally offset in a circumferential direction from the add-on zones of an adjacent region by a distance that is a function of the transverse dimension of the add-on zones. Each zone has a width measured along the tobacco rod 122 and a transverse cross-measure dimension in the circumferential sense of direction of the tobacco rod 122. For this embodiment, the zone width is less than the longitudinal pitch of the associated region. As seen in FIG. 17, the longitudinal pitch length may be greater than the corresponding zone width of the corresponding region. The add-on zones of successive regions along the tobacco rod 122 are preferably offset from the add-on zones of the adjacent regions, thereby defining a pattern 300 of regions which cover portions of the base web along lines inclined relative to the edge of the base web. Furthermore, the pattern of add-on zones may repeat itself at least partially along the length of the base web.

In the illustrated embodiment (FIG. 17), each zone is placed on the wrapper 123 so that the zone is centered upon one of three paths 270, 277, and 277', which paths are represented by corresponding broken lines 270, 272 and 272'. Thus, for example, path 270 passes through the corresponding geometric features of six zones 270*a*, 270*b*, 270*c*, 270*d*, 270*e*, 270*f*. Each zone is spaced from the other zones, but the zones could, alternatively, contact one another. The paths 270, 272 and 270' are parallel to each other and oriented at an acute angle Φ relative to the side edge of the wrapper 123. It is to be realized that zones 272' are preferably the same as zones 272 and result from progression through the pattern 300 shown in FIG. 17 where, as zones 270 disappear along one edge, zones 270' appear along the opposite edge. Each pair of cross-web aligned zones, e.g., zones 270*a*, 272*a*, car zones 270*b*, 272*b*, may cover up to about 33% of the total surface area of the corresponding region 274*a*, 274*b*. For rectangular zones, each zone is preferably in the range of about 8 to about 10 mm in the longitudinal direction or width, and about 5 to about 7 mm in the circumferential cross-measure direction.

Longitudinal spacing 276 between the zones preferably lies in the range of 4 to about 12 mm, and more preferably in the range of about 6 to about 8 mm. The circumferential spacing of the zones of add-on material is preferably in the range of about 3 to about 20 mm, more preferably in the range of about 5 to about 8 mm, and most preferably in the range of about 5.5 to about 7.0 mm.

When wrapper 123 is formed about tobacco to make a tobacco rod 122, zones of add-on material at any longitudinal location are preferably spaced about 180° from each other. Moreover, the ratio of the area occupied by zones of add-on material to the total area, the total area being the sum of (i) the corresponding region 274*d* and (ii) the annular area be adjacent regions on one side (that ratio here being defined as the "zone area ratio") is substantially less than one. Preferably, that zone area ratio lies in the range of less, than about 20% to less than about 50%, and more preferably in the range of less than about 20% to less than about 35%. More particularly, in some embodiments the zone area ratio for zone-occupied area to total area may be less than 30%, and even less that 25%. Generally speaking, it is desirable to keep the zone area coverage ratio low because high values (i.e., closer to 1) are believed to increase carbon monoxide concentration in mainstream smoke where low permeability (i.e., low CORESTA) wrapper is used for the tobacco rod.

When the wrapper 123 is formed to make the tobacco rod 122, the paths 270, 272, 272' describe a first helical path 272/272' (zones 272 and 272' in FIG. 17 combine to form a helical path 272/272') and a second helical path 270 (comprising helically aligned zones 270) both of which extend lengthwise, around axis 134, and over the length of the tobacco rod 122, as illustrated in FIGS. 16-17. The helical paths 272/272' and 270 (as seen from FIG. 17) have a helix angle Φ and do not intersect one another. Preferably, both helical paths may follow one of a counterclockwise and clockwise rotation about the tobacco rod 122. As illustrated, both paths 270, 272' follow a clockwise path, starting at the filter end of the tobacco rod 122, when viewed from the lit end and looking towards the filter end.

The zones of the pattern 300 may be formed by applying one or more layers of an aqueous film-forming composition to the base web of the wrapper to reduce the permeability of the paper those zones. Incorporation of an anti-wrinkling agent into the film-forming composition permits the pattern to be applied in two passes if desired or a single layer if additional drying capacity is established. Alternatively, a cellulosic material may also be used to form die zones. Where a film-forming composition is used, that film-forming composition preferably may include water and a high concentration of an occluding; agent, e.g., 20% to about 50% by weight. The film-forming compound can include one or more occluding agents such as starch, alginate, cellulose or gum and may also include calcium carbonate as a filler. Where starch is the film-forming compound, a concentration of about 24% may be advantageous. The film-forming, composition may be applied to the base web of the wrapper 123 using gravure printing, digital printing, coating or spraying using a template, or any other suitable technique. For example, the film-forming compounds and methods for applying film-forming compounds described in U.S. application Ser. No. 11/500,918, which is hereby incorporated herein in its entirety by this reference thereto, may be chosen for applying a pattern to the base web of the wrapper, if desired, the zones of add-on material can be formed by printing multiple, successive layers, e.g., two or more successive layers registered or aligned with one another. Furthermore, when layers are used to form the zones of add-on material, the material in layers may be the same of different. For example, one layer may be starch while the next layer may be starch and calcium carbonate (or vice versa).

Figure 18:
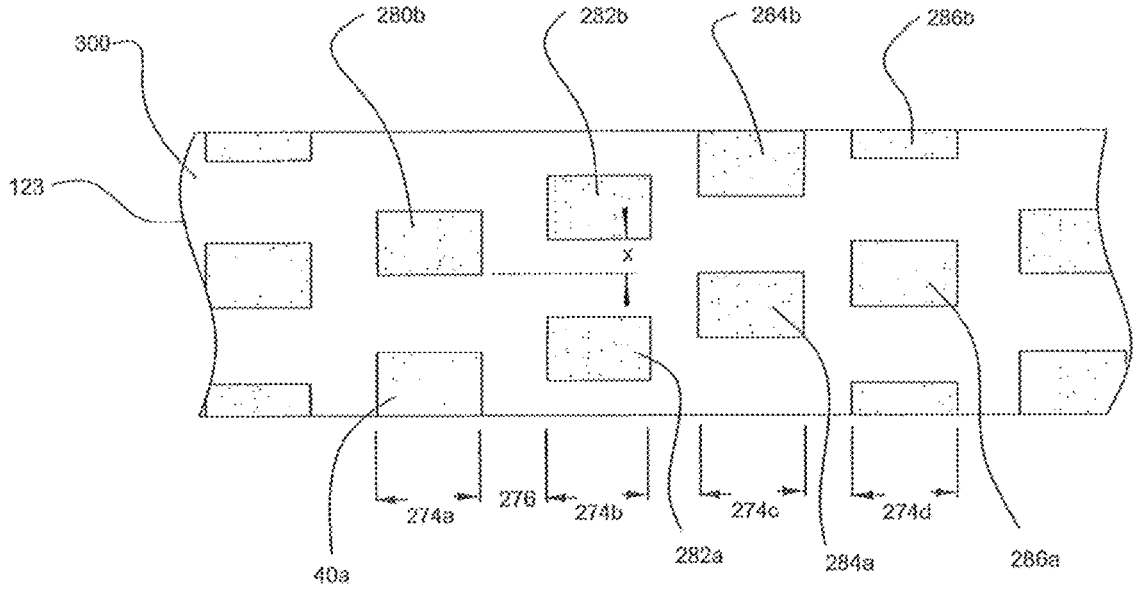
FIG. 18 is an enlarged plan view of a wrapper for the smoking article illustrating, another quadrilateral pattern.

The presently preferred embodiment for the pattern 300 of zones of add-on material is illustrated in FIG. 18. Like the embodiment of FIG. 17, the zones of add-on material in FIG. 18 are quadrilateral, specifically, generally rectangular. Preferably, at least two zones, e.g., 280*a*, 280*b*, of add-on material are applied in each region 274*a*, 274*b*, 274*c*, 274*d* so as to be circumferentially spaced in the finished smoking article. The circumferential dimension of each zone 280*a*, 280*b* is preferably selected to be less than about 50% of the cross-measure of the base web 123 when unwrapped, and most preferably about 25% of the cross-measure of that base web 123 or of the circumference of the tobacco rod 122. The circumferential dimension of each zone 280*a*, 280*b*, when added to the circumferential spacing of between the zones 280*a*, 280*h*, preferably is about 50% of the circumferential cross-measure of the base web 123.

The longitudinal length of the zones 280*a*, 280*b* plus the longitudinal spacing 276 between the zones 280*a*, 280*b*, and zones 282*a*, 282*b*, (i.e., the longitudinal pitch length) is preferably selected so that three or four regions 274*a*, 274*b*, 274*c*, 274*d* will occur in the nominal length of the tobacco rod 122 of the smoking article and such that add-on zones of adjacent regions are spaced from one another longitudinally. Preferably, the longitudinal expanse or "width" of the zones, e.g., 280*a*, 280*b* (i.e., the zone width or region width as previously defined) lies in the range of about 8 to about 10 mm. The circumferential offset, x, between (i) the zones 282*a*, 282*b* of the region 274*b* and (ii) the zones 280*a*, 280*b* of the region 274*a* preferably lies in the range of about 10% to about 35% of the total, unwrapped cross-measure of the base web 123. More preferably, the circumferential offset, x, lies in the range of about 12% to about 35% of the total, unwrapped cross-measure of the base web 123. Most preferably, the circumferential offset, x, is about half the circumferential dimension or cross-measure of the add-on zone 280*a*, 280*b*. The zones of add-on material in other regions, 274*c*, 274*d*, are likewise further offset circumferentially by the same offset, x, with respect to each other. It will be noted that, for example, in region 274*d* one of the zones 286*a*, 286*c* of add-on material gets split between the two edge portions of the base web 123 when the base web is in an unwrapped condition.

The pattern 300 applied in regions 274*a*-274*d* preferably repeats along, the length of the base web 123. Clearly, if the circumferential offset, x, is less than 12.5% of the cross-directional width of the base web, more than four regions will define a complete cycle or phase length for the pattern 300. Conversely, if the circumferential offset, x, is greater than 12.5%, leas than four regions will define a complete cycle length for the pattern 300 (as in the case of the FIG. 17 pattern).

Figure 19:
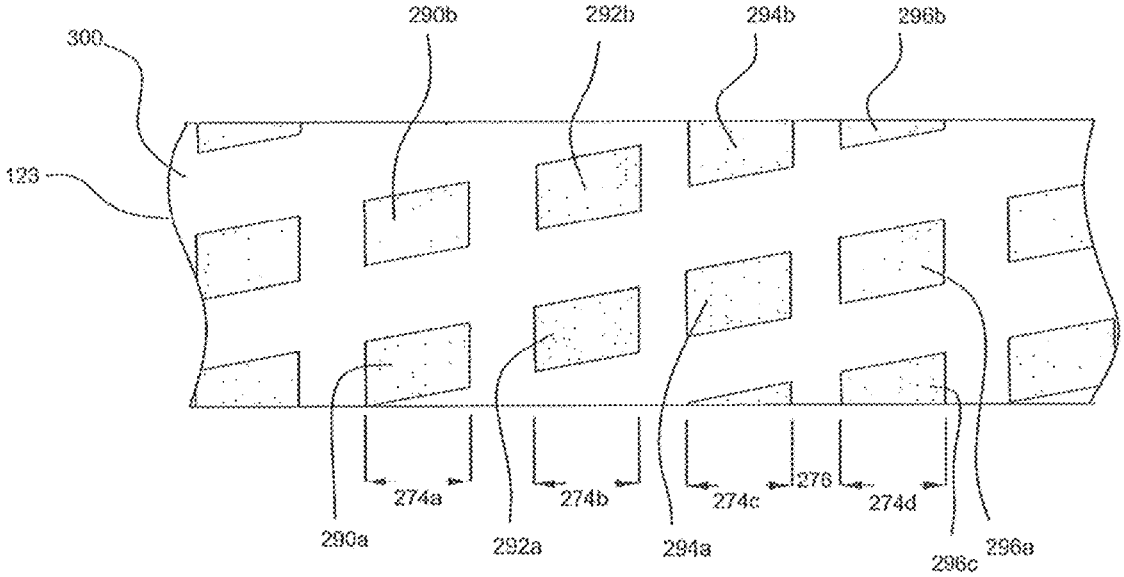
FIG. 19 is an enlarged plan view of a wrapper for the smoking article illustrating a further quadrilateral pattern.

A further embodiment of the pattern 300 (see FIG. 19) uses quadrilateral zones 290*a*, 290*b* of add-on material, namely substantially parallelogram-shaped zones. While the zones 290*a*, 292*a* are arranged so as to be in general helical alignment with one another when the wrapper is formed into a tobacco rod 122, the configuration of the parallelogram shapes 290, 292, 294, 296 may be selected as desired. For example, the mirror images of the shapes (mirrored about the longitudinal direction) could be used, even though the general helical impression might be lost. Likewise, the skewness of the parallelogram zones may be changed as may be desired. Generally, however, the circumferential dimensions, circumferential spacing or offset, longitudinal dimensions, and longitudinal spacing or offset of the zones 290, 292, 294, 296 and the regions 31*a*-31*d* in this embodiment may be selected as described in other embodiments.

Figure 20:
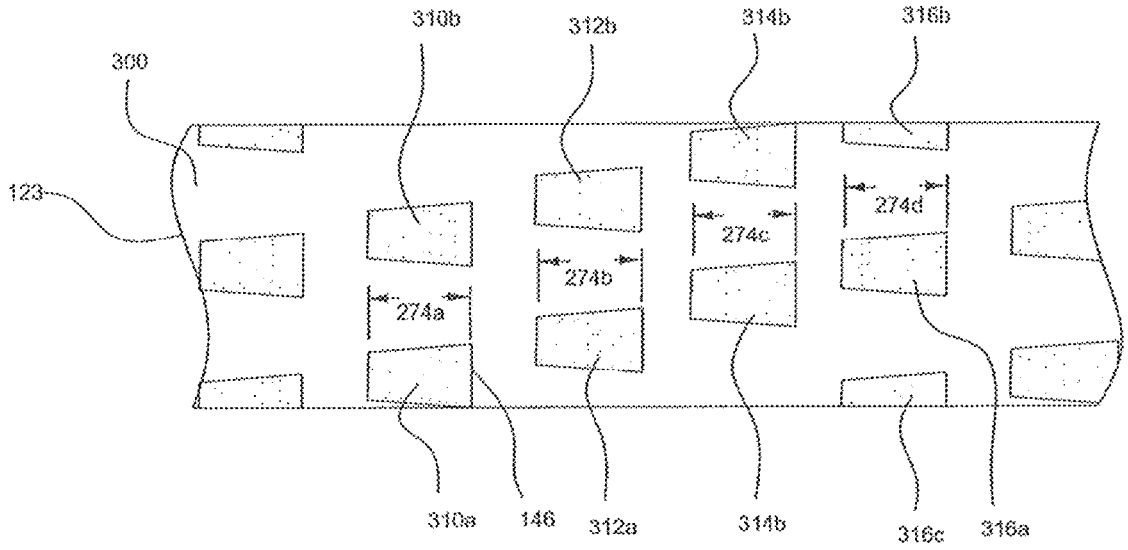
FIG. 20 is an enlarged plan view of a wrapper for the smoking article, illustrating a still another quadrilateral pattern.

Still another embodiment of the pattern 300 (see FIG. 20) uses quadrilateral zones 310, 312, 314, 316 of add-on material, namely substantially trapezoidal zones. Here again, the generally trapezoidal zones 310*a*, 312*a* may be arranged so as to be in general helical alignment with one another when the wrapper is combined into a tobacco rod 122. In addition, the actual shape of the trapezoidal zones 310, 312, 314, 316 may be selected as desired. For example, the skewness of the trapezoidal zones, and the proportions of the trapezoidal zones may be changed as may be desired. Generally, however, the circumferential dimensions, circumferential spacing or offset, longitudinal dimensions, and longitudinal spacing or offset of the zones 310, 312, 314, 316 and the regions 274*a*-274*d* in this embodiment may be selected as described in other embodiments. It is preferred that the leading edge 146 be the longer of the two parallel edges of the zones 310.

Figure 21:
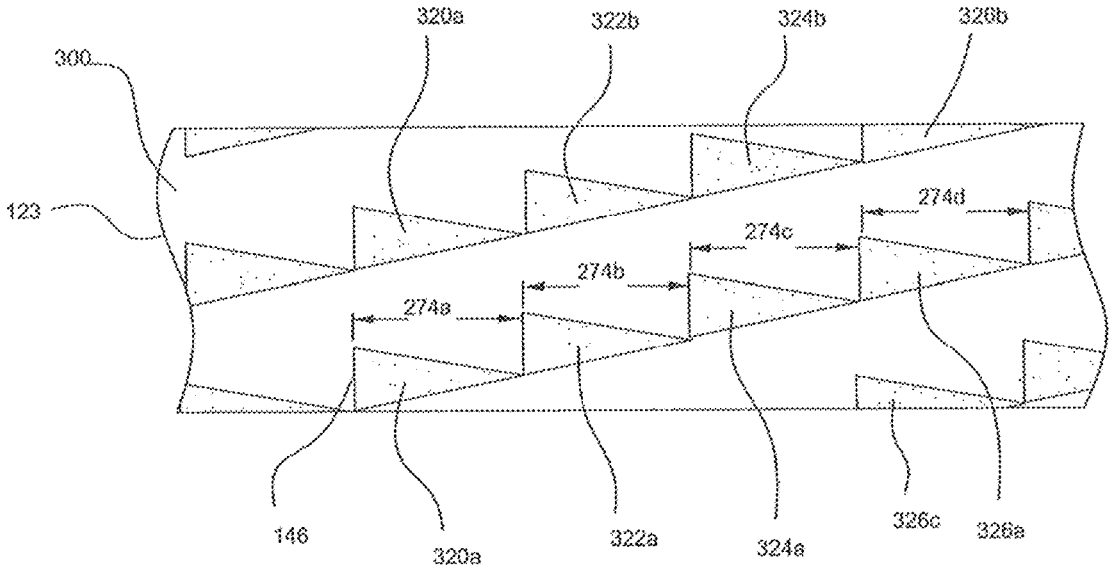
FIG. 21 is an enlarged plan view of a wrapper fix the smoking article, illustrating a triangular pattern.

Yet another embodiment of the pattern 300 (see FIG. 21) uses generally triangular zones 320, 322, 324, 326 of add-on material. The generally triangular zones 320*a*, 320*b* of region 274*a* may be constructed and arranged so as to touch the corresponding generally triangular zones 322*a*, 322*b* of the next adjacent region 274*b*. If the IP and SE characteristics desired require it, the generally triangular zones 320*a*, 320*b* of the first region 274*a* may be longitudinally spaced from the triangular zones 322*a*, 322*b* of the adjacent region 274*b*. Depending on the characteristics required for the smoking article design, it is also contemplated that the generally triangular regions may be oriented so that the burning coal of a smoldering smoking article encounters the triangular apex and gradually increasing cross-directional dimension of the generally triangular zones (i.e., from right-to-left in FIG. 21), or such that the burning coal of a smoldering smoking article encounters the base of the triangular zones and an abrupt increase in the lower permeability zones (i.e., from left-to-right in FIG. 21). Circumferential spacing of the triangular zones 320, 322, 324, 326 and the size of those triangular zones may be determined in accordance with the preferred ranges set out elsewhere in this description. Moreover, the triangular zones may be isosceles triangles as depicted, or equilateral triangles, or right triangles, or any other desired triangular shape that may be desired. Generally, however, the circumferential dimensions, circumferential spacing or offset, longitudinal dimensions, and longitudinal spacing or offset of the zones 320, 322, 324, 326 and the regions 274*a*-274*d* in this embodiment may be selected as described in other embodiments. Preferably, the triangular forms of the zones 320 are oriented so that a leading edge 146 (closest to an approaching coal) is established.

Figure 22:
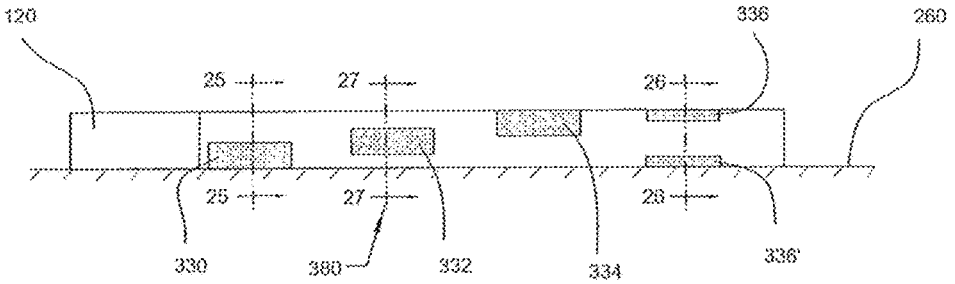
FIG. 22 is a side view of the smoking article using the wrapper of FIG. 18 with the smoking article on a substrate and oriented so that a first side portion of the smoking article contacts a substrate.
Figure 23:
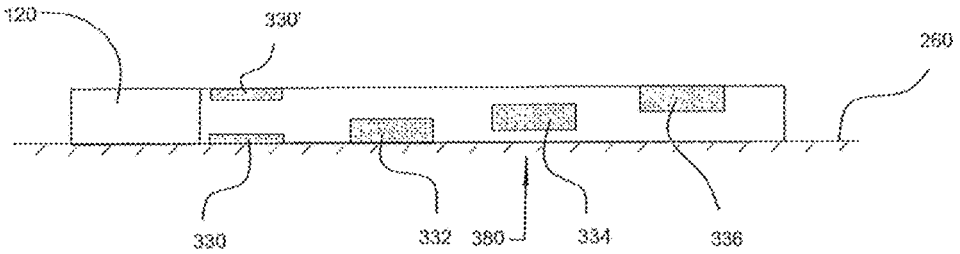
FIG. 23 is a side view of the smoking using the wrapper of FIG. 18 with the smoking article on a substrate and oriented so that a second side portion of the smoking article contacts the substrate.
Figure 24:
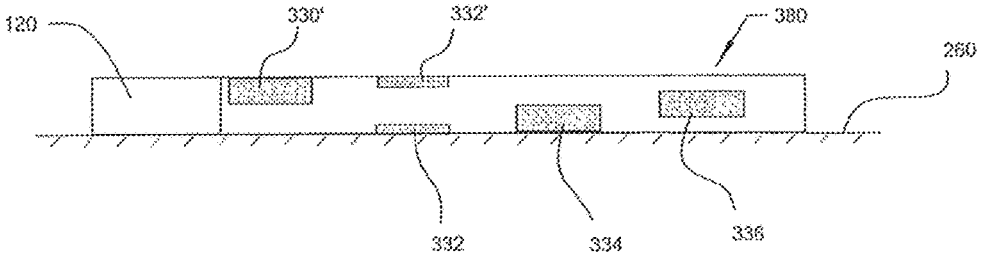
FIG. 24 is a side view of the s noting article using the wrapper of FIG. 18 with the smoking article on the substrate and oriented so that a third side portion of the smoking article contacts the substrate.

The operation of these embodiments for the wrapper pattern 300 is best understood by consideration of FIGS. 22-24. These figures illustrate three different positions of the smoking article 120 resting on the substrate 260 and are illustrative of the cooperation which occurs between the zones of low permeability add-on material and the substrate 260. One position (see FIG. 22) illustrates a side view of the smoking article 120 according to this description. Rotation of the smoking article through a 45° angle about its longitudinal axis (clockwise from the left end of FIG. 22) results in an elevation similar to that Shown in FIG. 23. Similarly, further rotation of the smoking article 120 through another 45° angle (also clockwise from the left end of FIG. 22) results in an elevation to that illustrated in FIG. 24. In each of FIGS. 22-24 it can be seen that at least one pair of zones of add-on material are positioned n the sides of the smoking article at a location along the length of the tobacco rod 122, e.g., zones 332, 332' of FIG. 22, zones 324, 324' of FIG. 23, and zones 326, 326' of FIG. 24. At those locations where the zones 332, 332' of add-on material are positioned substantially on the sides of the smoking article 120 (FIG. 26), the zones 332, 332' are substantially upright or generally perpendicular to the surface of the substrate 260. That orientation of the zones 337, 332' is best illustrated in FIG. 27, where the opposed zones 332, 332' are located on corresponding opposed sides of the smoking article 120 when viewed in cross section, substantially symmetrically positioned relative to a diameter of the tobacco rod 122, which diameter is substantially parallel to the surface of the substrate 260.

Figure 25:
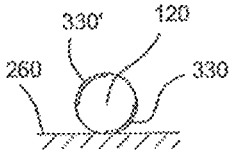
FIG. 25 is a cross-sectional view of the smoking article taken along line 25-25 of FIG. 22.
Figure 26:
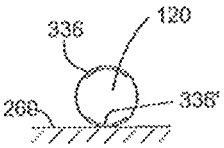
FIG. 26 is a cross-sectional view of the smoking article taken along line 26-26 of FIG. 22.
Figure 27:
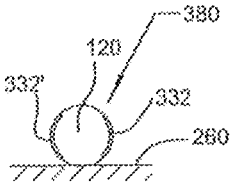
FIG. 27 is a cross-sectional view of the smoking article taken along line 27-27 of FIG. 22.

Orientation of the zones of add-on material at other longitudinal locations along the smoking article 20 are shown in FIGS. 25 and 26. In FIG. 25, the zones 330, 330' of add-on material are positioned such that one zone 330 touches the substrate 260. The zones 334, 334' of the smoking article 120 in FIG. 22 would also be positioned as in FIG. 25, when viewed from the right end of FIG. 22. In FIG. 26, one zone 336' contacts the substrate 260, but the other opposed zone 336 is located at the top of the smoking article 120. From consideration of FIGS. 22-24, it will be appreciated that regardless of the angular position of a smoking article 120 having the pattern of zones of add-on material described, at least one pair of opposed zones of add-on material are positioned as shown in FIG. 25, or FIG. 27, or a rotated position between those positions. This position has been referred to above as the oriented snuffer region.

Accordingly it is seen that the spirally rotated position of the opposed zones of add-on material creates a situation where, regardless of which side portion of the wrapper is placed against the substrate 260, there will always be at least one longitudinal location having film-forming compound at side portions not in contact with the substrate 98 yet having a sufficient add-on amount and geometry that the zones can cooperate with the substrate 260 to self-extinguish the smoking article when the burn line reaches that longitudinal location. This fact results in improved IP performance of the smoking article and permits a smoking article to be designed with an IP value no greater than 25%. Nevertheless, in the absence of a substrate 260, the smoking article does not self-extinguish yet maintains a free-burn, such as when the smoking article is held by a smoker. This fact results in improved SE performance of the smoking article and permits a smoking article to be designed with an SE value no greater than 50%, that SE value may be the SE average value. SE values at 0° may be much lower that the SE average value and may be less than 25%.

In the embodiments described above, the smoking article has a generally circular cross section. Therefore, it is possible for any side portion of the smoking article to rest against the substrate 260. However, a pattern as taught herein can be such that the burn characteristics described above (IP values no greater than 25% and SE values no greater than 50% in relation to FIGS. 14 and 15 can be realized, regardless of which side portion of the smoking article happens to rest against the substrate 260. Preferably, the pattern is selected so that when the base web is wrapped around a tobacco rod 122, zones of film-forming compound appear at opposing sides not in contact with the substrate

260 at one or more (preferably at least two) longitudinal locations along the tobacco rod 122.

If desired, the zones of add-on material may also comprise other geometric shapes other than quadrilaterals including, for example, ovals, other polygons, or the like. Furthermore, the helix angle Φ described above may be increased while keeping the dimensions of zones the same as in the illustrated embodiments. That change can place the zones in overlapping pattern (or at least place zones in close proximity to one another). Alternatively, a stepped helical pattern may be thrilled by increasing the cross-directional dimension of the zones or patches while the helix angle is the same as in FIG. 17 and/or a zone of equal size to that shown in FIG. 17 may be placed between each patch and along paths 270, 272, 272" (so that there are 12, instead of 6 patches along a path 270).

Slit Bonded Regions

Other patterns for the regions of add-on material are also, of course, within the scope of this disclosure. Moreover, the inclusion of an anti-wrinkling agent in the aqueous solutions used to form the banded regions allows intricate patterns to be effected.

For example, in another embodiment, the banded region can comprise first, second and third zones of add-on material, which may be applied by any of the methods disclosed herein, wherein the second zone includes perforations which preferably are filled with an occluding material which melts or is evaporated when the burning coal approaches the banded region to thereby provide the second zone with increased permeability.

Thus, a wrapper of a smoking article is disclosed comprising a base web and at least one transverse banded region with first, second and third zones. The first and third zones comprise add-on material, which reduces permeability of the wrapper. The first and third zones each have a width such that if either of said first or third zone were applied separately to wrappers of smoking articles, the smoking articles would exhibit statistically significant occurrences of total burn through and statistically few or no occurrences of self-extinguishment under free burn conditions (e.g., after testing a batch of 20 to 50 cigarettes). The sum of the widths of the first and third zones is such that if the zones were applied to wrappers of smoking articles as a single continuous band (without a slit or other discontinuity), the smoking articles would exhibit statistically few or no occurrences of total burn through and statistically significant occurrences of self-extinguishment under free burn conditions. The first and third zones are separated by the second zone. The wrapper has greater permeability along the second zone than along the first and third zones. The second zone has a width less than either width of the first and third zones (which can have equal or unequal widths), so that lit smoking articles comprising the first, second and third zones exhibit statistically reduced occurrences of self-extinguishment under free burn conditions, as compared to smoking articles comprising wrappers whereon the first and third zones are applied as a single continuous band, while maintaining statistically few or no occurrences of total bit through. Preferably, the first and third zones are of uniform add on material across the first and third zones. Optionally, the second zone may have a width essentially equal to the first and third zones.

Total weight of add-on material for the banded region preferably lies in the range of 0.5 to 15 grams per square meter ("gsm"). Conventional cigarette paper is permeable, with the permeability commonly designated its CORESTA, which measures paper permeability in terms of volumetric flow rate (i.e., $cm^3$/sec) per unit area (i.e., $cm^2$) per unit pressure drop (i.e., cm of water). Permeability of the cigarette paper normally exceeds 20 CORESTA and preferably, the cigarette paper has a permeability of about 33 to about 60 CORESTA and a basis weight of about 22-30 gsm. However, permeability through the banded regions and the underlying cigarette paper preferably lies in the range of 0 to 15 CORESTA. The reduction in permeability preferably restricts air flow needed to support combustion of the cigarette coal in the vicinity of the banded region.

The first and third zones preferably have a greater basis weight in grams per square meter than the intermediate second zone; for example, the basis weight in grams per square meter of the first and third zones may be at least twice the basis weight in grams per square meter of the second zone. The second zone may comprise a gap. As used herein, the term "gap" refers to a discrete area of a banded region, between the first and third zones, lacking any permeability reducing add-on material (i.e., containing no layers of permeability reducing add-on material). In order to aid combustion in the second zone, the wrapper may comprise iron oxide at the location of the second zone. The second zone preferably has a greater permeability than the first and third zones.

The at least one transverse banded region preferably comprises a first printed layer contacting the base web and a second printed layer, preferably having an equal or greater basis weight in grams per square meter than the first printed layer, on the first printed layer. However, the second and/or subsequent layers may be less in basis weight than the first layer. For example, the basis weight in grams per square meter of the second printed layer may be at least twice the basis weight in grams per square meter of the first printed layer. In an embodiment, the second zone may comprise a single printed layer and the first and third zones may each comprise at least two printed layers (more preferably three or more layers). Alternatively, the first and third zones may each comprise at least three or four printed layers, and the second zone may comprise only one or two or no printed layers.

Non-banded areas of the base web preferably do not comprise permeability reducing add-on material. As described below with reference to FIG. 30, the transverse banded region may comprise greater than three zones. For example, the transverse banded region may comprise, for example, five zones, with the second and fourth zones separating the first, third and fifth zones and the wrapper having greater permeability along, the second and fourth zones than along the first, third and fifth zones.

Also provided is a wrapper of a smoking article comprising a base web and a transverse banded region of add-on material. The transverse banded region is designed to cause extinguishment of smoking articles comprising the transverse banded region when left upon a substrate. The wrapper further comprises a more permeable, intermediate zone along the transverse banded region such that the occurrences of self-extinguishments of smoking articles comprising the wrapper is statistically reduced over those without the intermediate zone.

In a further embodiment, a wrapper of a smoking article comprises a base web and at least one transverse banded region comprising first, second and third zones on the base web. The at least one transverse banded region can be free of fillers and optionally at least one of the zones is formed at least in part from an add-on material which includes a filler. The add-on material is preferably uniform across the first and third zones. The first and third zones are outward of the second zone, and the overall wrapper structure at the second zone has a greater permeability compared to the overall wrapper structure at the first and third zones.

Additionally provided is a wrapper of a smoking article comprising a base web and at least one transverse banded region comprising first, second and third zones on the base web. The first and third zones are outward of the second zone, the second zone has a greater permeability compared to the first and third zones, and the second zone and the first and third zones comprise add-on material.

Moreover, provided is a method of making a banded wrapper of a smoking article comprising supplying a base web and forming at least one transverse banded region comprising first, second and third zones on the base web. The first and third zones are outward of the second zone, the second zone has a greater permeability compared to the first and third zones, and at least the first and third zones are formed from an add-on material free of fillers. Optionally at least one of the zones is formed at least in part from an add-on material which includes a filler. The add-on material is preferably uniform across the first and third zones.

Furthermore, provided is a method of making a banded wrapper of a smoking article comprising supplying a base web and forming at least one transverse handed region comprising first, second and third zones on the base web. The first and third zones are outward of the second zone, the second zone has a greater permeability compared to the first and third zones, and the second zone and the first and third zones are formed from an add-on material. Optionally at least one of the zones is firmed at least in part from an add-on material which includes a filler. The add-on material is preferably uniform across the first and third zones.

Figure 28:
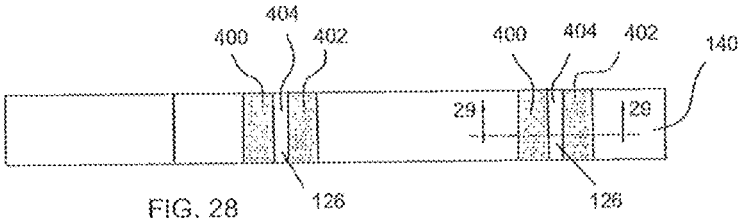
FIG. 28 is an embodiment with axially slit banded regions.
Figure 29:
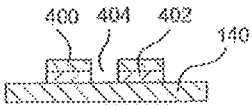
FIG. 29 is a partial cross sectional view taken along the line 29-29 of FIG. 28.

FIGS. 28-33 illustrate smoking articles comprising, slit banded paper as described herein. Specifically, FIG. 28 illustrates a smoking article having two banded regions 126, each comprising first and third zones of add-on material 400, 402 separated by a second zone 404, which may be in the form of a gap or may be in the form of a zone of reduced add-on material. The first and third, zones of add-on material 400, 402 may each be, for example, about 2-5 mm wide, and the second zone 404 may be, for example, about 1-2 mm wide. More specifically, the first and third zones of add-on material 400, 402 may each be, for example, about 3 mm wide, and the second zone 404 may be, for example, about 1.5 or 2 mm wide. The first and third zones of add-on material 400, 402 preferably comprise multiple layers of add-on material, such as, for example, two, three or four layers of add-on material. The add-on material is preferably uniform across the first and third zones 400, 402.

Figure 30:
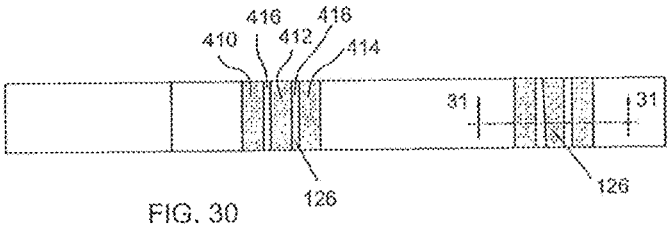
FIG. 30 is an embodiment with two axial slits in the banded regions.
Figure 31:
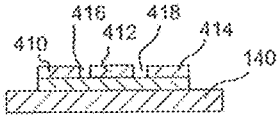
FIG. 31 is a partial cross-sectional view taken along the line 31-31 of FIG. 30.
Figure 38:
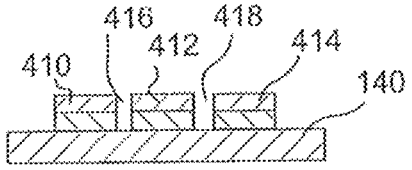
FIG. 38 is an enlarged partial, cross-sectional view of an alternative embodiment, similar to FIG. 31.

FIG. 30 illustrates a smoking article having two banded regions 126, each comprising first, third and fifth zones of add-on material 410, 412, 414 separated by second and fourth zones 416, 418, which may be in the form of gaps (see FIG. 31) or in the form of reduced levels of add-on material (see FIG. 38). The first, third and tin zones of add-on material 410, 412, 414 may each be, for example, about 2-3 mm wide, and the second and fourth zones 416, 418 may each be, for example, about 1-2 mm wide. More preferably, the first, third and fifth zones of add-on material 410, 412, 414 may each be, for example, about 2 mm wide, and the second and fourth zones 416, 418 may each be, for example, about 1 mm wide or less. The first, third and fifth zones of add-on material 410, 412, 414 preferably comprise multiple layers of add-on material, such as, for example, two, three or four layers of add-on material. The add-on material is preferably uniform across the first, third and fifth zones 410, 412, 414.

Figure 32:
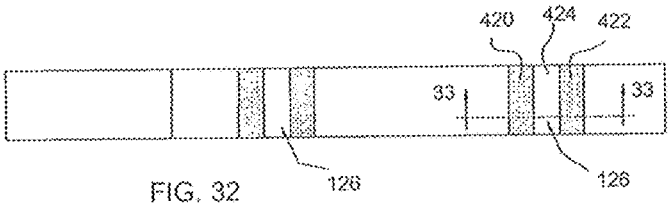
FIG. 32 is an embodiment with an axially slit banded region.
Figure 33:
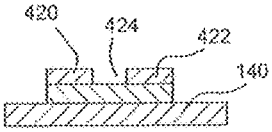
FIG. 33 is a partial cross-sectional view taken along the line 33-33 of FIG. 32.
Figure 34:
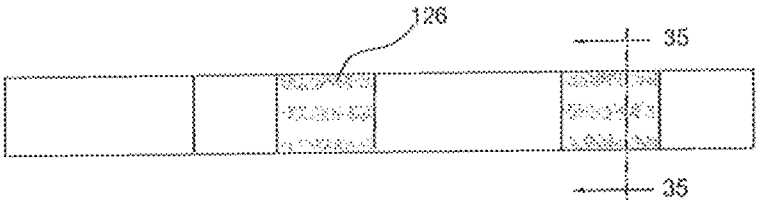
FIG. 34 is a side elevation view of another embodiment f a smoking article according to this disclosure.
Figure 35:
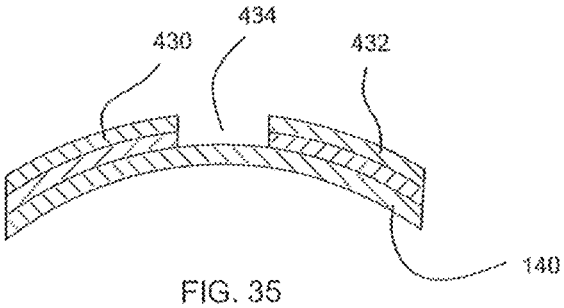
FIG. 35 is an enlarged partial cross-sectional view taken along the line 35-35 of FIG. 34.
Figure 36:
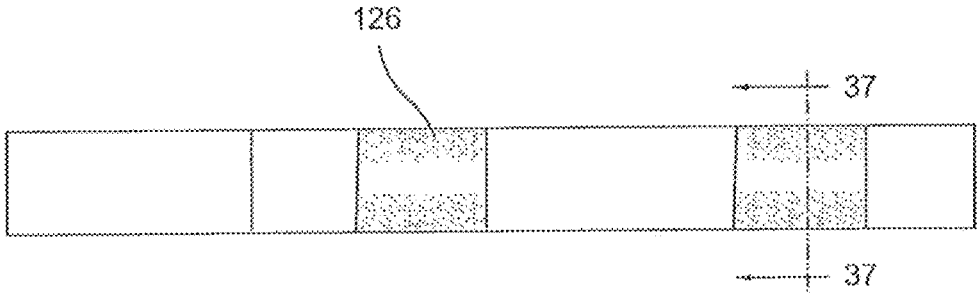
FIG. 36 is a side elevation view of a further embodiment of a smoking article according to this disclosure.
Figure 37:
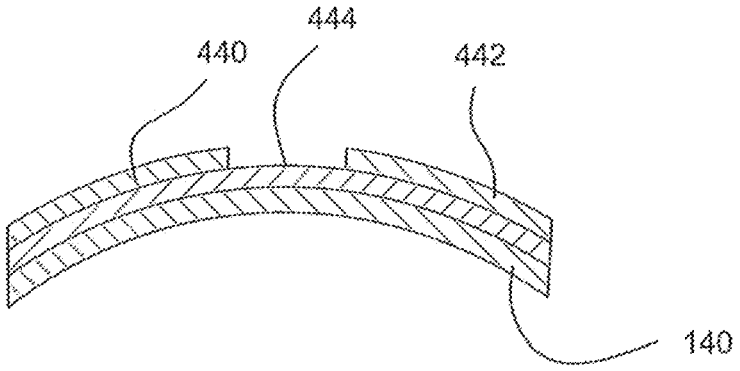
FIG. 37 is an enlarged partial cross-sectional view taken along line 37-37 of FIG. 36.

FIG. 32 illustrates a smoking article having two banded regions 126, each comprising first and third zones of add-on material 420, 422 separated by a second zone 424 of less add-on material. The first and third zones of add-on material 420, 422 may each be, for example, about 2-3 mm wide, and the second zone of less add-on material 424 may be, for example, about 1-2 mm wide. More preferably, the first and third zones of add-on material 420, 422 may each be, for example, about 3 mm wide, and the second zone of less add-on material 424 may be, for example, about 2 mm wide or less. The first and third zones of add-on material 420, 422 preferably comprise multiple layers of add-on material, such as, for example, two, three or four layers of add-on material, while the second zone of less add-on material 424 may comprise, for example, one or two layers of add-on material. The add-on material is preferably uniform across the first and third zones 420, 422. Although second zones 424 are operative at a 1 mm width, the embodiment performs better at a 1.2 mm width or greater.

Referring to FIGS. 28-33, slit banded paper facilitates use of wrappers of lower permeability for a given level of CO than prior designs of banded paper. For example, it was found that a tobacco rod comprising paper having a permeability of 33 CORESTA and a CO (FTC) delivery of 11 mg would produce 15 mg of CO (FTC) if previous versions of bands were applied without further change. In order to counteract his increase, the permeability of the wrapper would have to be raised to about 46 CORESTA. Such changes create a multitude of consequence in cigarette design, such as, for example, impacting puff count, possibly lessening machineability of the paper, and the like, in contrast, the slit banded paper having a permeability of 33 CORESTA provided 12 mg CO (FTC). Thus, the slit banded technology described herein facilitates application of bands with a lesser impact on CO levels (FTC).

Referring to FIGS. 34-37, further embodiments may include banded regions wherein the zones extend longitudinally instead of circumferentially. More specifically, FIG. 34 corresponds to banded region configuration of FIG. 30 with the zones extending longitudinally instead of circumferentially, and FIG. 36 corresponds to banded region configuration of FIG. 32 with the zones extending longitudinally instead of circumferentially.

In a preferred embodiment, the first layer of each banded region is preferably formed using an aqueous occlusive composition, which extends completely across the banded region. The successive layer (or layers) of each banded region may be formed by using the same aqueous film-forming composition or different aqueous compositions. For example, multiple layers may all comprise layers containing exclusively starch or multiple layers may comprise one or more layers containing exclusively starch and one or more layers containing calcium carbonate (in any order). During gravure printing, the occlusive composition is preferably heated to a temperature where its viscosity lies within the range of viscosities suitable for gravure printing. When the heated occlusive composition is applied, the occlusive composition is cooled or quenched and may be gelatinized. Thus, a portion of the free water in the occlusive composition becomes bound and unavailable to soak or migrate into underlying fibers of the base web. That binding of free water inhibits formation of waviness, cockling, and/or wrinkling in the base web. Successive layers of the banded regions preferably have increased thickness relative to the first layer. The banded regions provide a reduction in permeability to the underlying base web, which preferably restricts air flow needed to support combustion of the cigarette coat in the vicinity of the banded region.

The occlusive composition iced in the occlusive composition may be selected from the group consisting of starch, alginate, carrageenan, guar gum, pectin, and mixtures thereof. Preferably, the occlusive composition comprises starch, mare preferably oxidized starch, such as, for example, tapioca starch, more specifically oxidized tapioca starch. In these embodiments, the occlusive composition preferably does not contain fillers, such as, for example, calcium carbonate, which would increase the burn rate through the banded region. In a preferred embodiment, the occlusive composition used for printing comprises water and about 20% to about 50%, by weight, of the occlusive composition. At higher concentrations of the occlusive composition in the composition, the composition may experience gelatinization when its temperature is rapidly reduced. Thus, the binding of free water into the printed banded region may occur.

At too n temperature (about 23° C.), the high-solids-content occlusive composition has a viscosity exceeding about 200 centipoises (cP) and is unsuitable for gravure printing; however, at a temperature in the range of about 40° to about 90° C., the viscosity of the occlusive composition is decreased sufficiently for use as a gravure printing composition. For gravure printing, the upper limit of suitable viscosity is about 200 cP. Most preferably, the occlusive composition has a viscosity of about 100 cP at a temperature in the range of 40° C. to 90° C. so that the composition can be quenched on contact with the paper after gravure printing at that temperature. The viscosity of the composition at room temperature is also important. The high viscosity at room temperature is needed so that the occlusive composition gels at room temperature.

Preferably, the banded regions are applied to the wrapper using a successive gravure printing process. Gravure printing operations are capable of precise registry of successive printing operations. Accordingly, gravure printing can be used to effectively print not only the first layer of the banded regions, but also the optional successive layers.

EXAMPLES

The following examples are intended to be non-limiting and merely illustrative. Cigarettes with five different wrappers (i.e., wrappers with five different banded region configurations), were tested for ignition propensity ("IP") and self-extinguishment ("SE") at 0° (horizontal). The base web of each of the wrappers had a permeability of 33 CORESTA and basis weight of 25 gsm.

TABLE X

| Wrapper | Banded Region Configuration* | Total Banded Region Width | IP Run 1 | IP Run 2 | IP Run 3 | IP Avg. | SE @ 0° |
|---|---|---|---|---|---|---|---|
| A | control | 6 mm | 0% | 0% | 0% | 0% | 95% |
| B | 3-1-3 | 7 mm | 0% | 2.5% | 0% | 0.8% | 60% |
| C | 3-2-3 | 8 mm | 0% | 0% | 5% | 1.7% | 25% |
| D | 2-2-2 | 6 mm | 2.5% | 0% | 0% | 0.8% | 45% |
| E | 2-1-2-1-2 | 8 mm | 2.5% | 2.5% | 2.5% | 2.5% | 20% |

*Numbers refer to zone widths in mm (see Tables XI-XV below)

Referring to Table X, wrapper A was a control, comprising a continuous, solid 6 mm printed banded region, having an add-on rate of 5.5X. As used herein, an add-on rate of 5.5X results in 8-9 gsm of add-on material on a dry weight basis, and a basis weight of 26.5 gsm for 6 min banded regions with a 27 mm phase (i.e., the spacing from the leading edge of a banded region to the leading edge of the next banded region) applied to a base web with a basis weight of 25 gsm.

TABLE XI

Details of Wrapper B

| | Zone 1 | Zone 2 | Zone 3 |
|---|---|---|---|
| Width | 3 mm | 1 mm | 3 mm |
| Layers of Add-on Material | 2 | 1 | 2 |
| Add-on Rate Per Layer | 1.5x/4x | 1.5x/0 | 1.5x/4x |
| Total Add-on Material | 5.5x | 1.5x | 5.5x |

TABLE XII

Details of Wrapper C

| | Zone 1 | Zone 2 | Zone 3 |
|---|---|---|---|
| Width | 3 mm | 2 mm | 3 mm |
| Layers of Add-on Material | 2 | 1 | 2 |
| Add-on Rate Per Layer | 1.5x/4x | 1.5x/0 | 1.5x/4x |
| Total Add-on Material | 5.5x | 1.5x | 5.5x |

TABLE XIII

Details of Wrapper D

| | Zone 1 | Zone 2 | Zone 3 |
|---|---|---|---|
| Width | 2 mm | 2 mm | 2 mm |
| Layers of Add-on Material | 2 | 2 | 2 |
| Add-on Rate Per Layer | 1.5x/4x | 1.5x/2x | 1.5x/4x |
| Total Add-on Material | 5.5x | 3.5x | 5.5x |

TABLE XIV

Details of Wrapper E

| | Zone 1 | Zone 2 | Zone 3 | Zone 4 | Zone 5 |
|---|---|---|---|---|---|
| Width | 2 mm | 1 mm | 2 mm | 1 mm | 2 mm |
| Layers of Add-on Material | 2 | 1 | 2 | 1 | 2 |
| Add-on Rate Per Layer | 1.5x/4x | 1.5x/0 | 1.5x/4x | 1.5x/0 | 1.5x/4x |
| Total Add-on Material | 5.5x | 1.5x | 5.5x | 1.5x | 5.5x |

As compared to control wrapper A, wrappers B-E exhibited the desired reduction in SE while maintaining IP (i.e., without significantly increasing IP). In particular, wrapper B exhibited an improvement over control wrapper A, as evidenced by the decrease in SE average from 9 to 60%. Further, comparing wrappers B and D, it can be seen that by increasing the width of the second zone from 1 mm to 2 mm, the SE average decreased from 60% to 25% (while approximately maintaining the IP value). Thus, the width of the second zone is preferably greater than 1 mm, preferably about 1.5 mm or about 2 mm. While good results were also shown by wrapper c, which exhibited an SE average of 45% the best results were shown by wrapper E, which exhibited an SE average of 20%.

It should be noted that wrapper E, having a banded region comprising first, second, third, fourth and fifth zones and which showed the best results, had 1 mm, second and fourth zones of greater permeability. In contrast wrapper B, having a banded region comprising just first, second and third zones, with a 1 mm second zone of a greater permeability, did not perform as well. Thus, wrappers having banded regions comprising just first, second and third zones preferably have wider zones of greater permeability (i.e., about 1.5 mm or about 2 mm) than the zones of greater permeability of wrappers having banded regions comprising first, second, third, fourth and fifth zones.

Moreover, a method of making a handed wrapper of a smoking article may comprise supplying a base web and forming at least one transverse banded region comprising first, second and third zones on the base web. The first and third zones are outward of the second zone, the second zone has a greater permeability compared to the first and third zones, and at least the first and third zones are formed from an add-on material free of fillers. Optionally at least one of the zones is formed at least in pan from an add-on material which includes a filler. The add-on material is preferably uniform across the first and third zones.

Furthermore, a method of making a banded wrapper of a smoking article may comprise supplying a base web and forming at least one transverse banded region comprising first, second and third zones on the base web. The first and third zones are outward of the second zone, the second zone has a greater permeability compared to the first and third zones, and the second zone and the first and third zones are formed from an add-on material. Optionally at least one of the zones is formed at least in part from an add-on material which includes a filler. The add-on material is preferably uniform across the first and third zones.

In a preferred embodiment, the first layer of each banded region is preferably formed using an, aqueous occlusive composition, which extends completely across the banded region. The successive layer for layers) of each banded region may be formed by using the same aqueous film-forming composition or different aqueous compositions. For example, multiple layers may all comprise layers containing exclusively starch or multiple layers may comprise one or more layers containing exclusively starch and one or more layers containing calcium carbonate (in any order). During gravure printing, the occlusive composition is preferably heated to a temperature where its viscosity lies within the range of viscosities suitable for gravure printing. When the heated occlusive composition is applied, the occlusive composition is cooled or quenched and may be gelatinized. Thus, a portion of the free water in the occlusive composition becomes bound and unavailable to soak or migrate into underlying fibers of the base web. That binding of free water inhibits formation of waviness, cockling, and/or wrinkling in the base web. Successive layers of the banded regions preferably have increased thickness relative to the first layer. The banded regions provide a reduction in permeability to the underlying base web, which preferably restricts air flow needed to support combustion of the cigarette coal in the vicinity of the handed region.

In embodiments which include a layer of add-on material that includes calcium carbonate, that layer is preferably applied as an upper layer for a banded region intended for the outside of the wrapper or adjacent the wrapper for a handed region or the inside of the wrapper so as to maximize its favorable effect on appearance of the smoking article.

The occlusive composition of the banded regions may be selected from the group consisting of starch, alginate, carrageenan, guar gum, pectin, and mixtures thereof. Preferably, the occlusive composition comprises starch, more preferably oxidized starch, such as, for example, tapioca starch, more specifically oxidized tapioca starch. In embodiments, the occlusive composition preferably does not contain fillers, such as, for example, calcium carbonate, which would increase die burn rate through the banded region. In a preferred embodiment, the occlusive composition used for printing comprises water and about 20% to about 50%, by weight, of the occlusive composition. At higher concentrations of the occlusive composition in the composition, the composition may experience gelatinization when its temperature is rapidly reduced. Thus, the binding of free rater into the printed banded region may occur.

At room temperature (about 23° C.), the high-solids-content occlusive composition has a viscosity exceeding about 200 centipoises (cP) and is unsuitable for gravure printing; however, at a temperature in the range of about 40° C. to about 90° C., the viscosity of the occlusive composition is decreased sufficiently for use as a gravure printing composition. For gravure printing, the upper limit of suitable viscosity is about 200 cP. Most preferably, the occlusive composition has a viscosity of about 100 cP at a temperature n the range of 40° C. to 90° C. so that the composition can be quenched on contact with the paper after gravure printing at that temperature. Such an occlusive composition may comprise 24% by weight starch. Alternatively, the occlusive composition may comprise 20% by weight starch, which has a viscosity of about 10-40 cP at room temperature, and low viscosity at higher temperatures. The viscosity of the composition at room temperature is also important. The high viscosity at room temperature is needed so that the Occlusive composition gels at room temperature.

Figure 39:
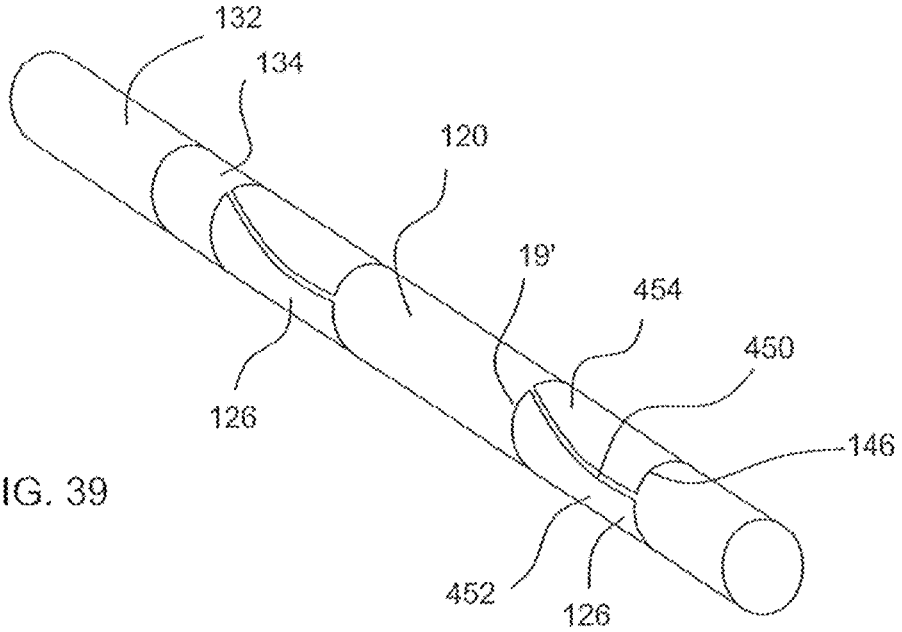
FIG. 39 is a perspective view of another embodiment of a smoking article according to this disclosure.
Figure 40:
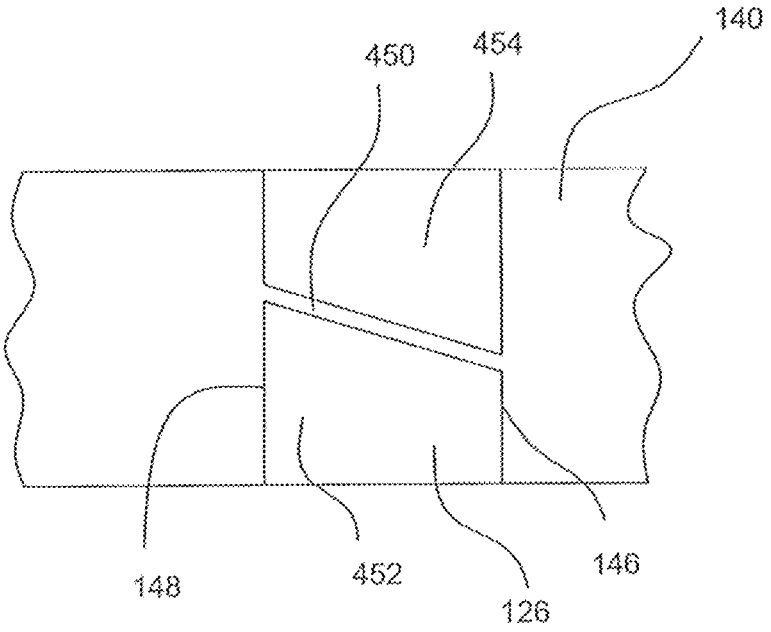
FIG. 40 is a partial plan view of the wrapper of another embodiment.
Figure 41:
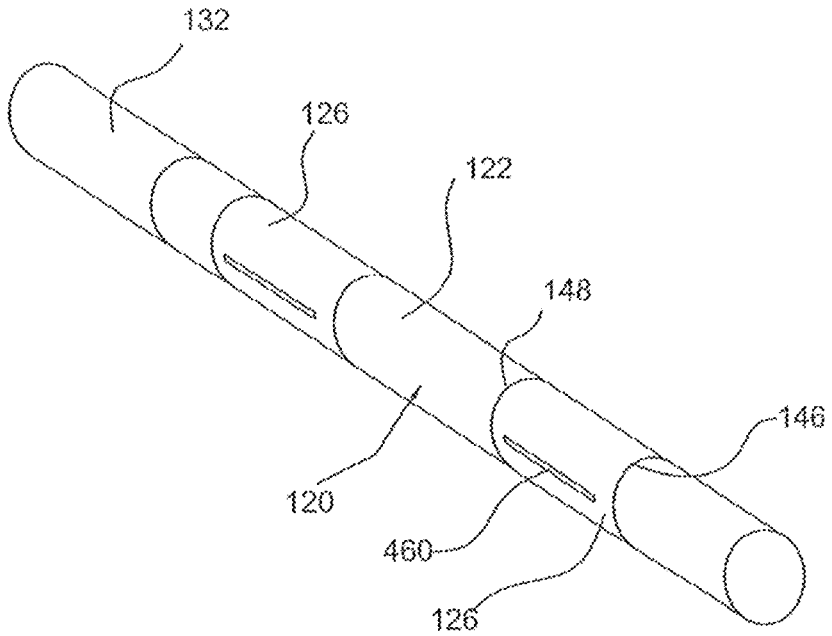
FIG. 41 is a perspective view of a further embodiment of a smoking article according to this disclosure.

FIG. 39 is a perspective view of a smoking article 120 having banded regions with angulated slits 450. FIG. 40 is an exemplary representation of angulated slits on an unfolded wrapper 140. FIG. 41 is a perspective view of a smoking article 120 having banded regions 126 with one or optionally two longitudinal slits 460 that terminate short of the leading edge 146 and the trailing edge 148 of the banded region 126.

Figure 42:
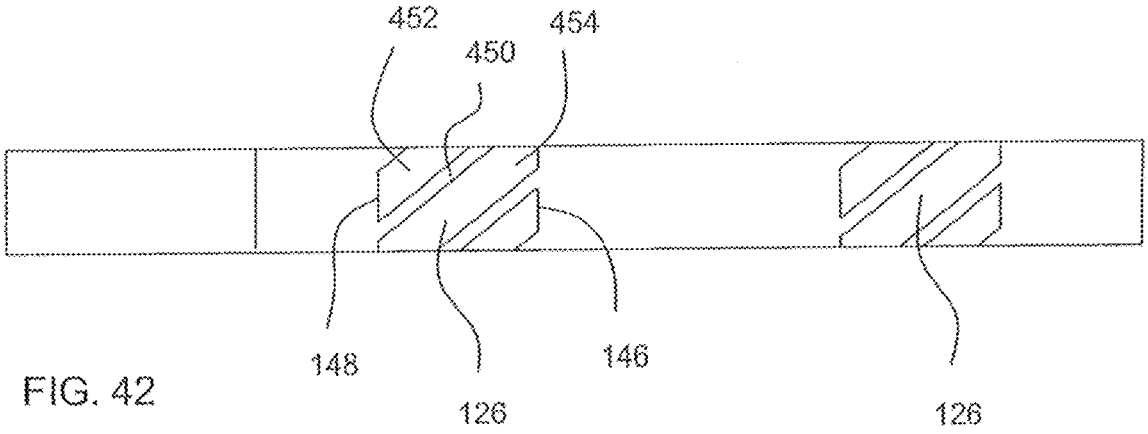
FIG. 42 is a side elevation view of a still another embodiment of a smoking article according to this disclosure.

FIG. 42 is a side view of a smoking article comprising banded paper with banded regions having angulated slits as depicted in FIG. 39. In contrast to FIG. 39, however, the angulated slits 450 are inclined in the opposite direction to the slits of FIG. 39.

Figure 43:
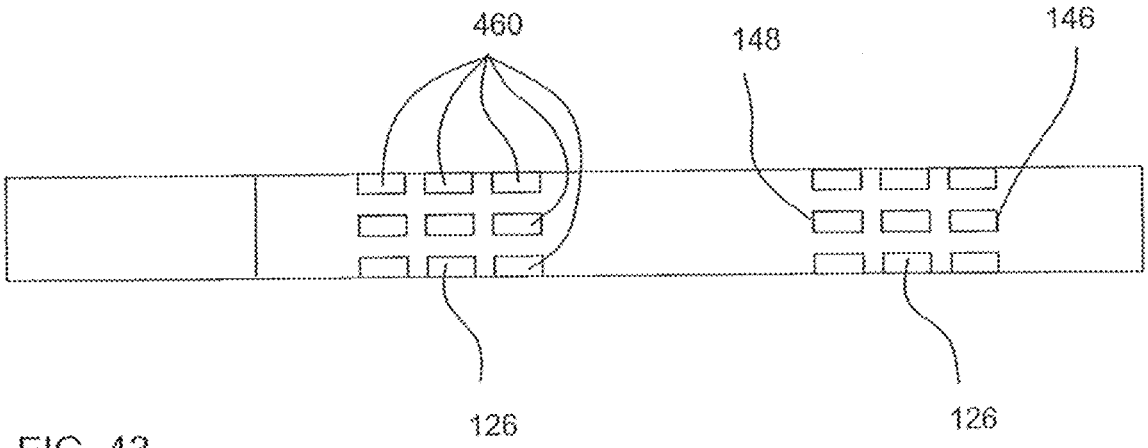
FIG. 43 is a side elevation view of a yet still another embodiment of a smoking article according to this disclosure.

Another embodiment contemplates the use of circumferential slits in both the circumferential and longitudinal directions (see FIG. 43). The resulting pattern of add-on material resembles spaced-apart regions 126 having a plurality of patches 460 therein.

Figure 44:
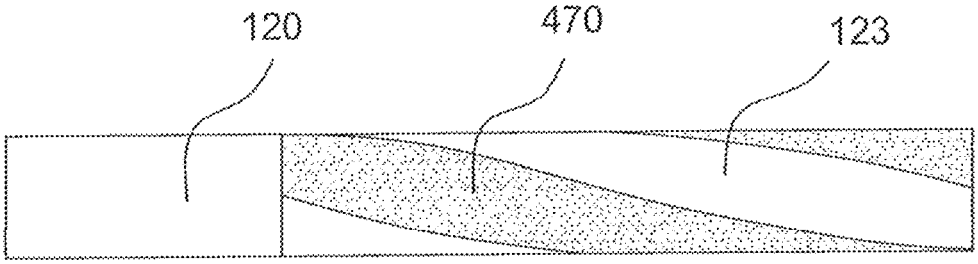
FIG. 44 illustrates an embodiment of a smoking article comprising helical longitudinally banded regions and a helical angle β of about arctangent (2 I/C), where I is the length of the tobacco rod and C is the circumference of the smoking article as described herein.
Figure 45:
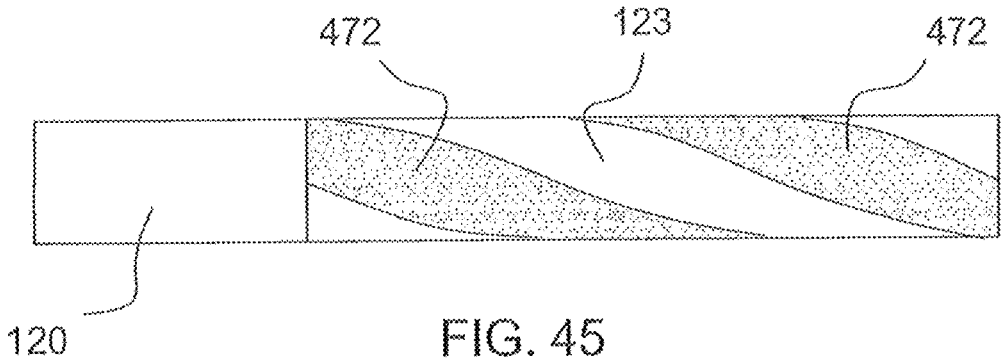
FIG. 45 illustrates an embodiment of a smoking article comprising helical longitudinally banded regions and a helical angle β of about arctangent (4 I/C) as described herein.
Figure 46:
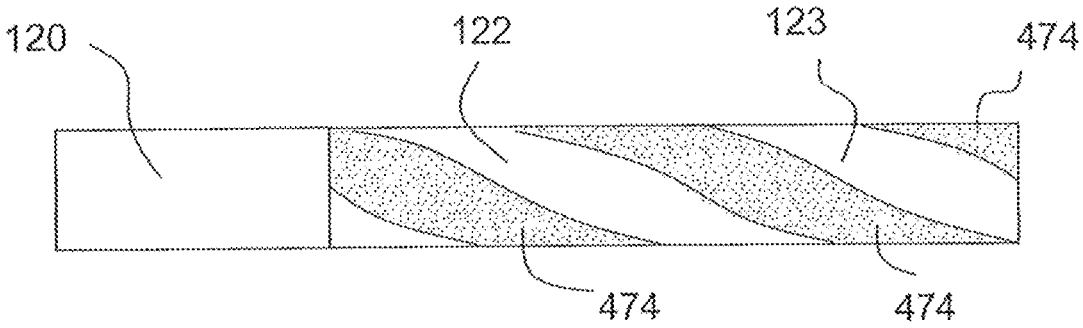
FIG. 46 illustrates an embodiment of a smoking article comprising helical longitudinally banded regions and a helical angle β of about arctangent (I/C) as described herein.

In other embodiments, the longitudinally banded regions 470 are helically wound about the length of the smoking article 120 (see FIGS. 44-46). These helical arrangements are well-suited for generally circular cigarettes. When the smoking article 120 experiences free burn conditions, the opposed helically wound longitudinally banded regions only obstruct airflow to the burning coal of the tobacco rod by virtue of their reduced permeability. However, the unobstructed portions of the wrapper permit the smoking article to have consistent, and favorable, conditions to support combustion in the advancing coal of the smoking article. On the other hand, a vastly different situation occurs when the smoking article is placed on a substrate. The substrate blocks flow of air upwardly to the bottom portion of the tobacco rod. The opposed helically wound longitudinally banded regions and the substrate cooperate to define much smaller areas through which air can be delivered to the base web as previously discussed.

FIG. 44 illustrates a smoking article 120 including helical longitudinally banded regions 470 that preferably extend the length of the wrapper. It should be understood that the circumferential width of these helical bands 470 is preferably selected so that the helical bands 470 cover no more that about 33% of the surface area of the wrapper 123 surrounding the tobacco rod. The helical angle β (see FIG. 12) of the helical longitudinally banded regions 470 is equal to arctangent (2l/c), where l is the length of the tobacco rod and c is the circumference of the smoking article. With die starting position of the helical longitudinally banded regions 470 as shown in FIG. 44, the smoking article 120 has one location along its length where the helical longitudinally banded regions 470 are n opposing relationship on a diameter of the smoking article which is parallel to a substrate when the smoking article 120 is placed on the substrate during testing.

Figure 12:
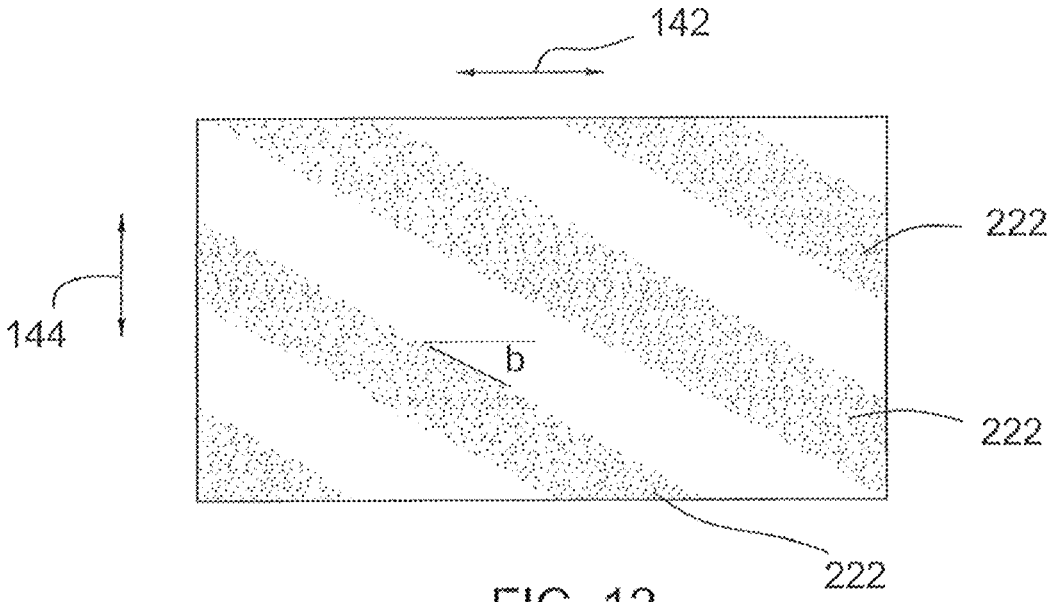
FIG. 12 illustrates a plan view of a wrapper for making a tobacco rod with helical, longitudinal, banded regions.

Preferably the helical angle β of the helical longitudinally banded regions is selected such that at least one location along the tobacco rod exhibits the configuration shown in FIG. 12, regardless of the rotational position of the smoking article about its longitudinal axis. More preferably, the helical angle β is selected to lie between about arctangent (2l/c) and about arctangent (l/c) such that at least two locations along the tobacco rod exhibit the FIG. 12 arrangement, regardless of rotational position of the smoking article about its longitudinal axis. If desired, the helical angle β can be selected with even smaller values than arctangent (l/c) so that even more occurrences of the FIG. 12 condition occur throughout the length of the tobacco rod.

Such embodiments preferably assure that, independently of the angular position of the smoking article upon the substrate, the smoking article will have at least one location, and preferably two, three, four, or more locations, along its length where the helical longitudinally banded regions are positioned such that, in cross-section, the banded regions are substantially symmetrically disposed at the ends of a major dimension of the cross-section positioned parallel to an underlying substrate, the cross-sectional view being similar to FIG. 12. Preferably, the longitudinally banded regions cover 25% or less of the surface area of the smoking article and/or are less than or equal to about 6 mm wide in the circumferential direction. Preferably, each longitudinally banded region includes sufficient add-on material to reduce the permeability of the wrapper at each longitudinally banded region to about 0.0 to about 12 CORESTA, more preferably about 7 CRESTA or less.

Figure 48:
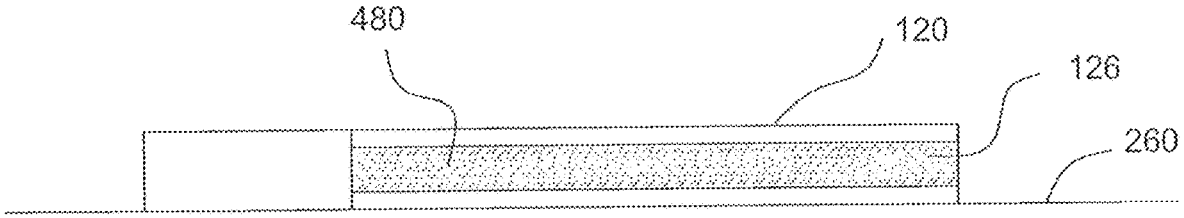
FIG. 48 illustrates an embodiment of a smoking article comprising longitudinally banded regions parallel to a longitudinal axis of the smoking article as described herein.
Figure 47:
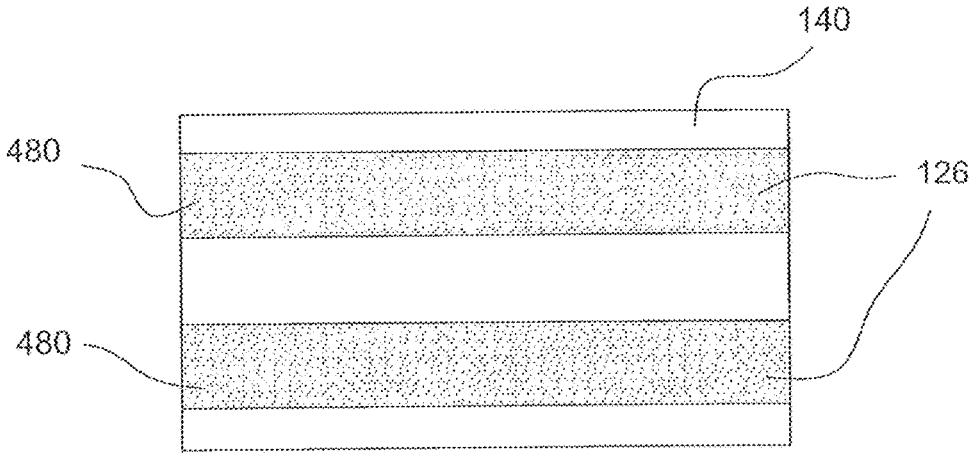
FIG. 47 illustrates a plan view of a wrapper for making a tobacco rod with longitudinally handed regions.

When the angle β approaches 0, the banded regions 126 become longitudinal stripes 480 (see FIG. 48) positioned generally parallel to the axis of the smoking article 120.

Figure 49:
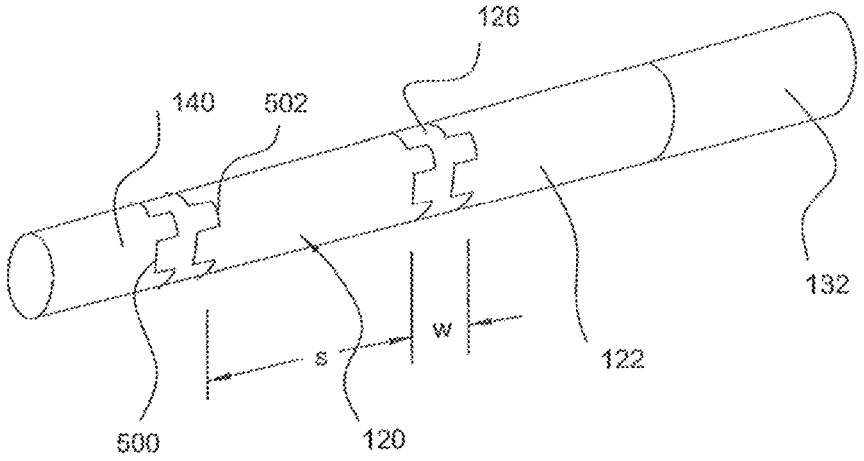
FIG. 49 is a perspective view of a smoking article according to this disclosure.

A wrapper for a smoking article may also comprises a base web 140 (see FIG. 49) having a nominal permeability and a plurality of banded regions 126 with sufficient add-on material such that the wrapper has a permeability at the banded region less than the nominal permeability of the base web. A leading edge 500 of each banded region 126 may be crenellated. Optionally, a trailing edge 502 of the banded region may also be crenellated.

While various arrangements of the crenellated regions may occur to those skilled in the art, several such arrangements are illustrated in the appended figures. For example (see FIG. 50), the banded region 12 may have a leading edge 500 in which the crenels 504 are disposed between merlons 506. In this embodiment, the merlons 506 have a dimension in the transverse direction of the base web 140 which is substantially the same as the dimension in the transverse direction of the crenels 504. As depicted, the merlons 506 and associated crenels 504 may be generally rectangular. If desired, however, the merlons 506 and crenels 504 may have other geometric shapes including, without limitation, quadrilaterals, trapezoids, triangles, hexagons, and other regular or irregular geometric configurations. The distance between the top of a merlon 506 and the bottom of an adjacent crenel 504 may lie in the range of about 2 mm to about 5 mm, and preferably may be about 3 mm. At the trailing edge of the banded region 126, a similarly crenellated arrangement may also be provided.

Figure 50:
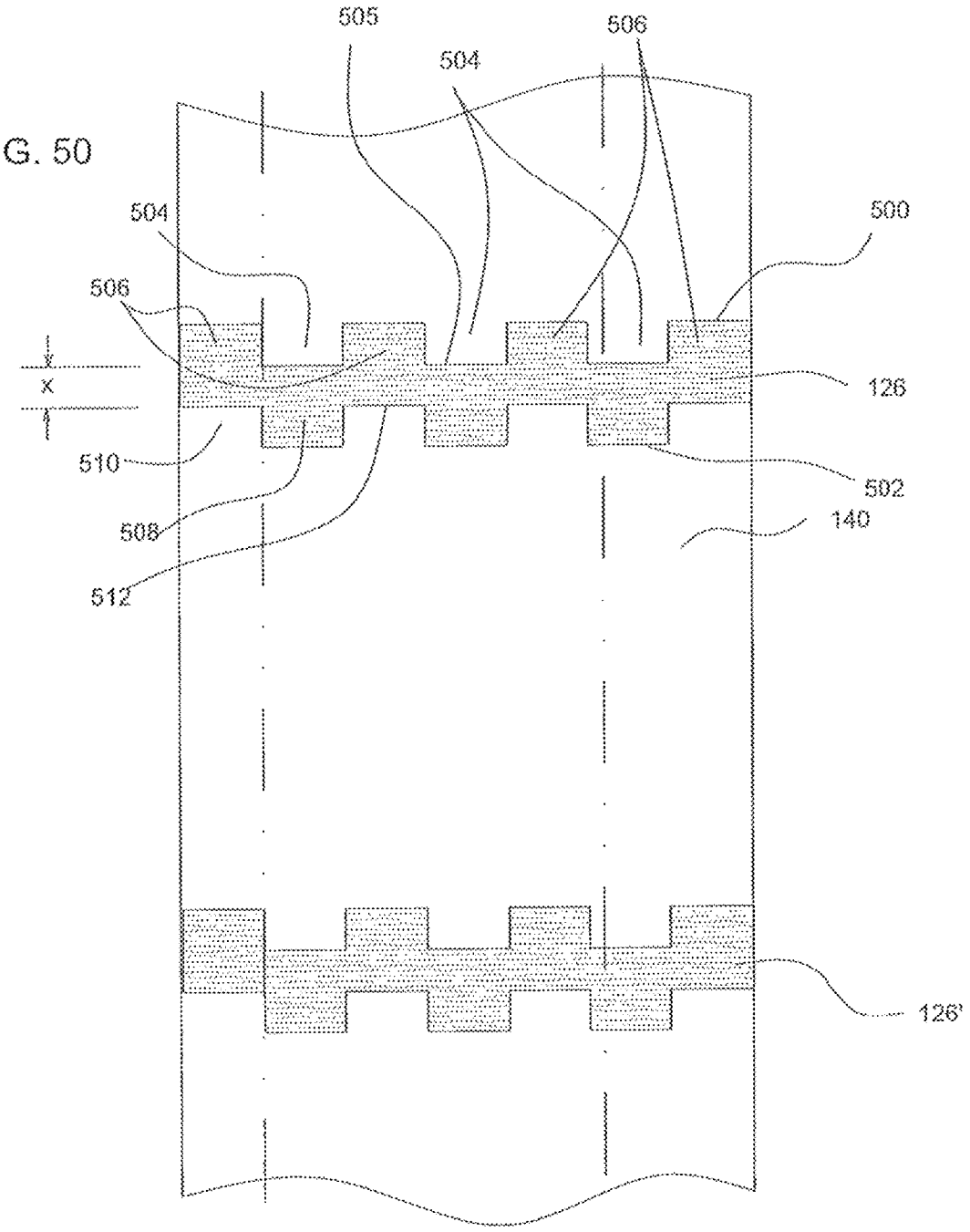
FIG. 50 is a schematic view of a wrapper having a crenellated banded region.
Figure 51:
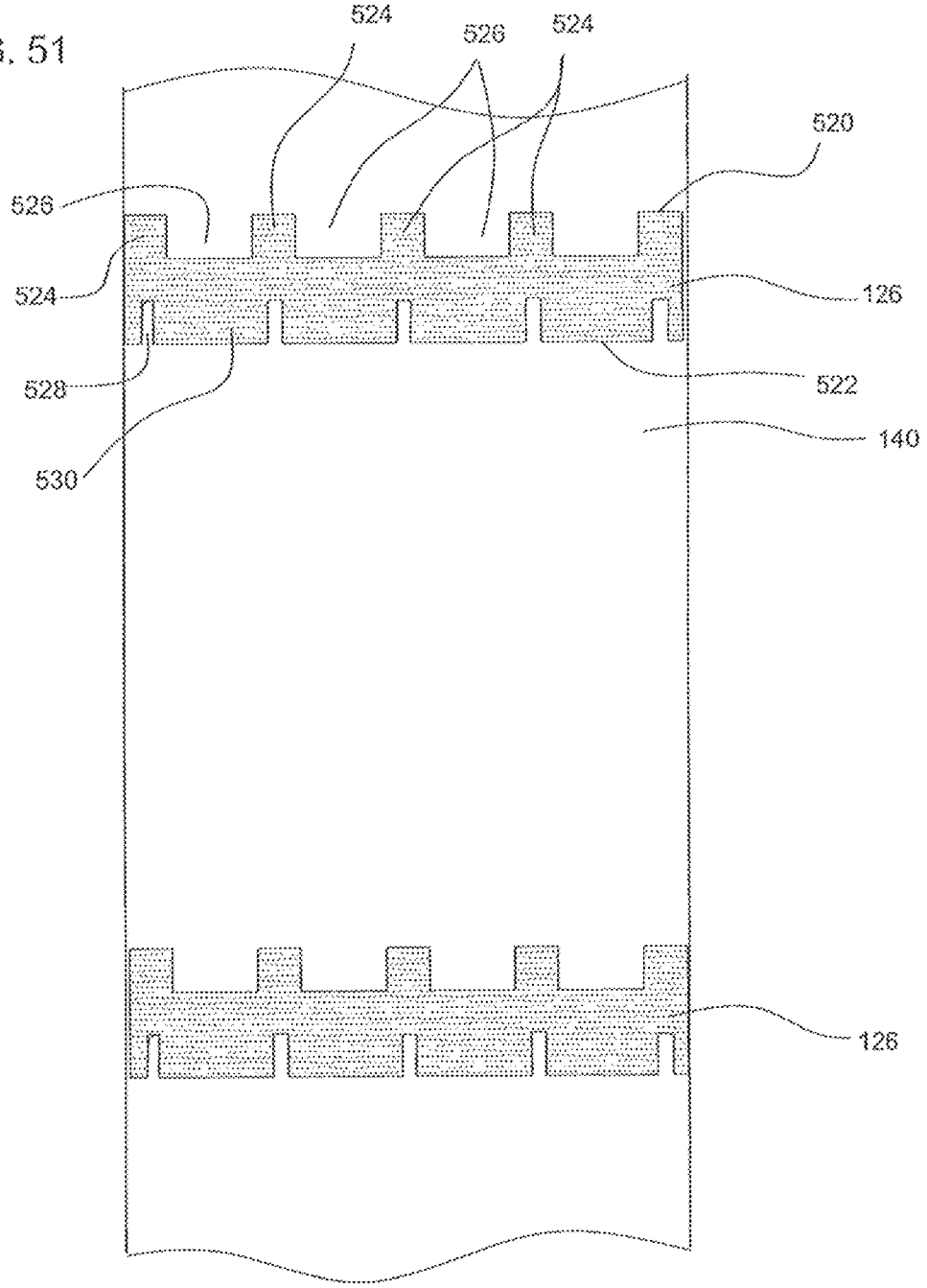
FIG. 51 is a schematic view of a wrapper having another embodiment of a crenellated banded region.

Turning to FIG. 51, the proportions of the merlons 524 and the crenels 526 of the leading edge 520 are different from the arrangement of FIG. 50. In FIG. 51 the merlons 524 may have a cross-web dimension of about half the cross-web dimension of the associated crenel 526. Nevertheless, an integral number of pairs of merlons 524 and crenels 526 corresponds to the nominal circumference of smoking article, as discussed above. The height of the merlons 524, or depth of the crenels 526 preferably lies in the same range of values as discussed in connection with FIG. 59. At the trailing edge of the embodiment of FIG. 51, the cross-web dimensions of the trailing edge merlons 530 and the trailing edge crenels 528 are different from the cross-web dimensions of the leading edge merlons and the leading edge crenels.

Figure 52:
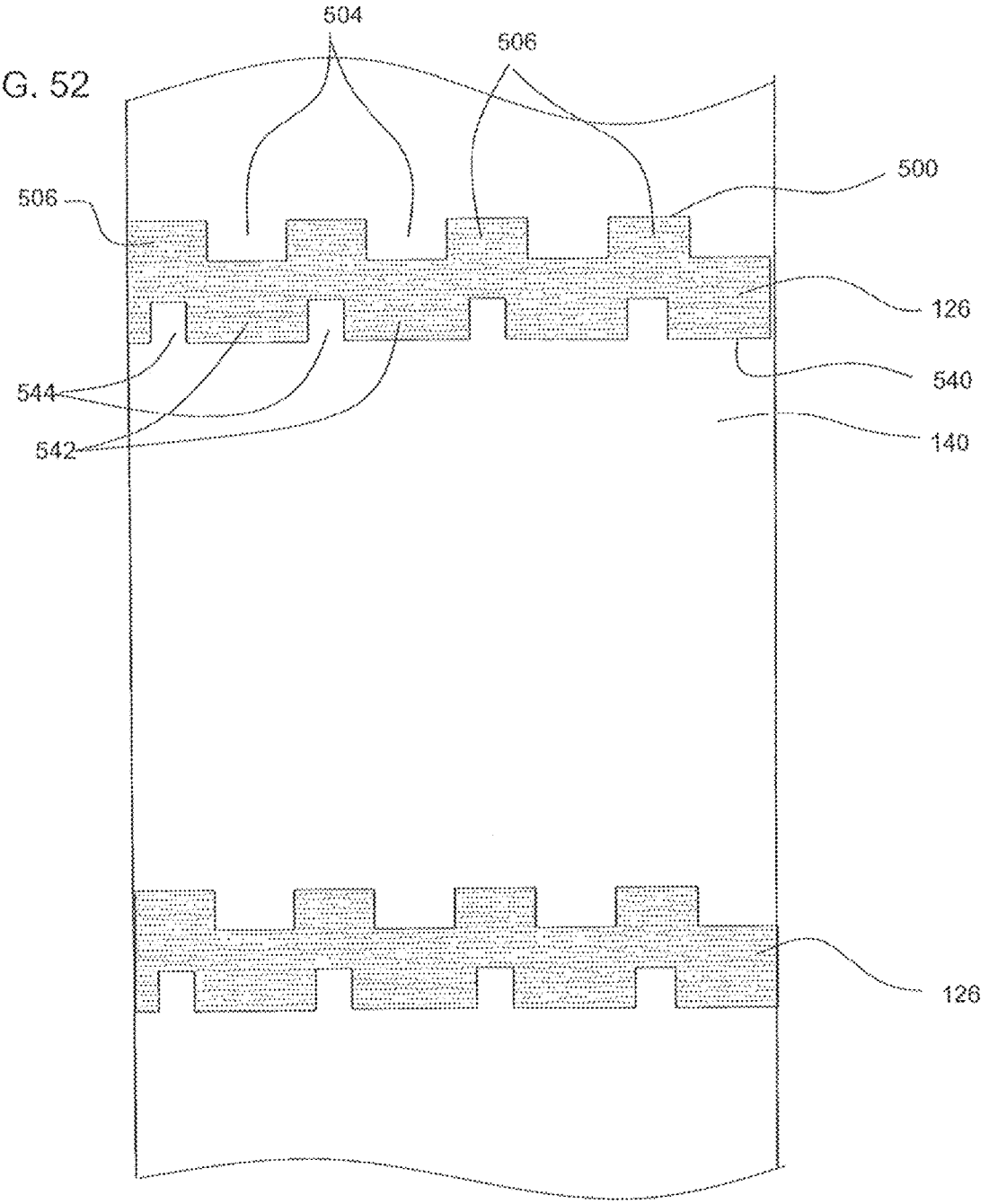
FIG. 52 is a schematic view of a wrapper having a farther embodiment of a crenellated banded region.

Turning to FIG. 52, the leading edge of the banded region 126 may have substantially the same characteristics discussed above in connection with FIG. 50. However, the trailing edge 540 may have merlons 542 having cross-web dimensions substantially greater than the cross-web dimensions of the opposed crenels 504 of the leading edge, while the cross-web dimensions of the trailing edge crenels 544 are substantially less than the cross-web dimensions of the corresponding opposed merlons 506 of the leading edge.

Figure 53:
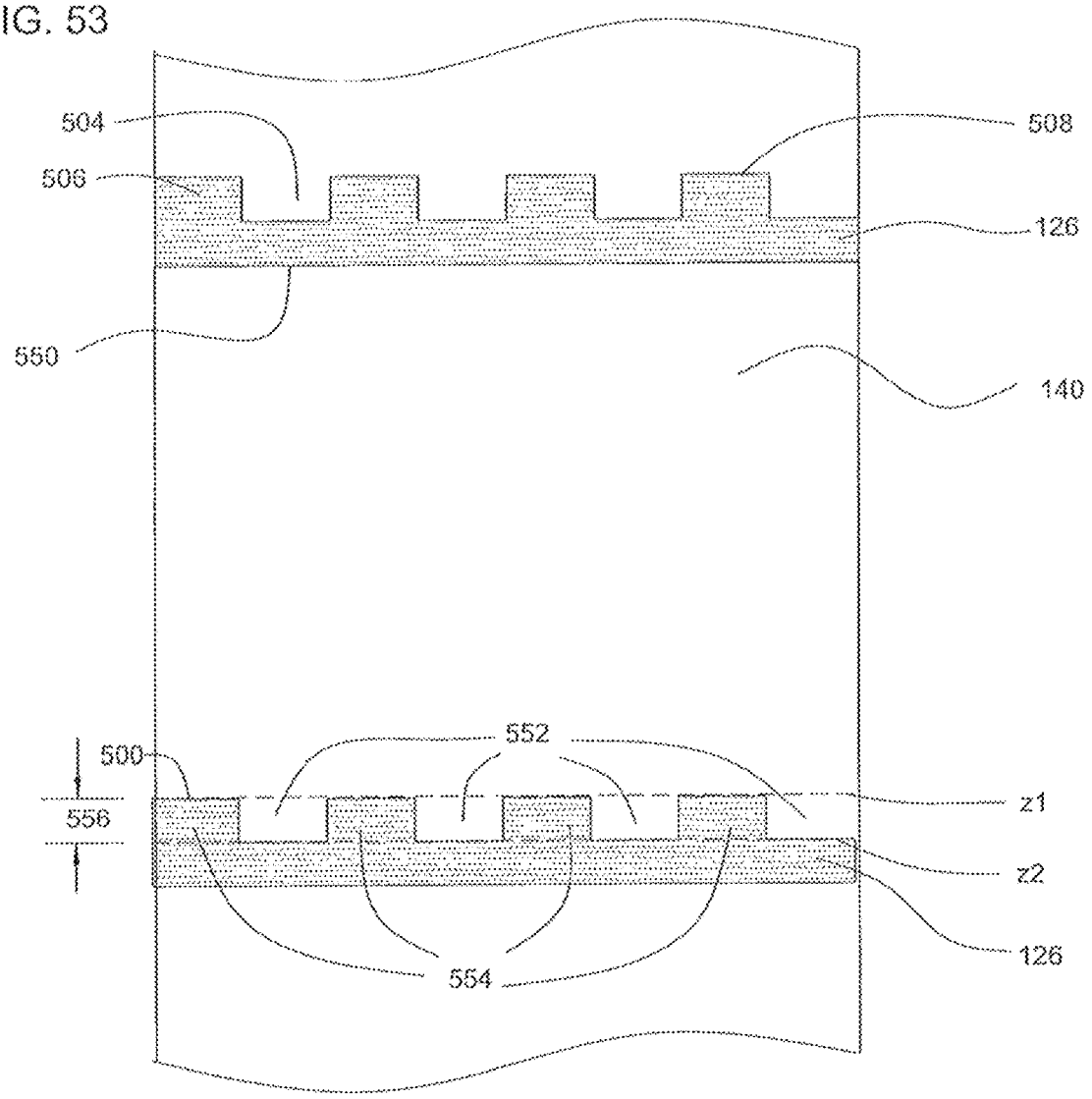
FIG. 53 is a schematic view of a wrapper having a yet another embodiment of a crenellated banded region.

FIG. 53 illustrates yet another embodiment of the crenellated banded regions in accordance with this disclosure. In this embodiment, the leading edge 500 may have the characteristics described above in connection with FIG. 50. In this embodiment, however, the trailing edge 550 of the crenellated banded region 126 may be straight.

Figure 54:
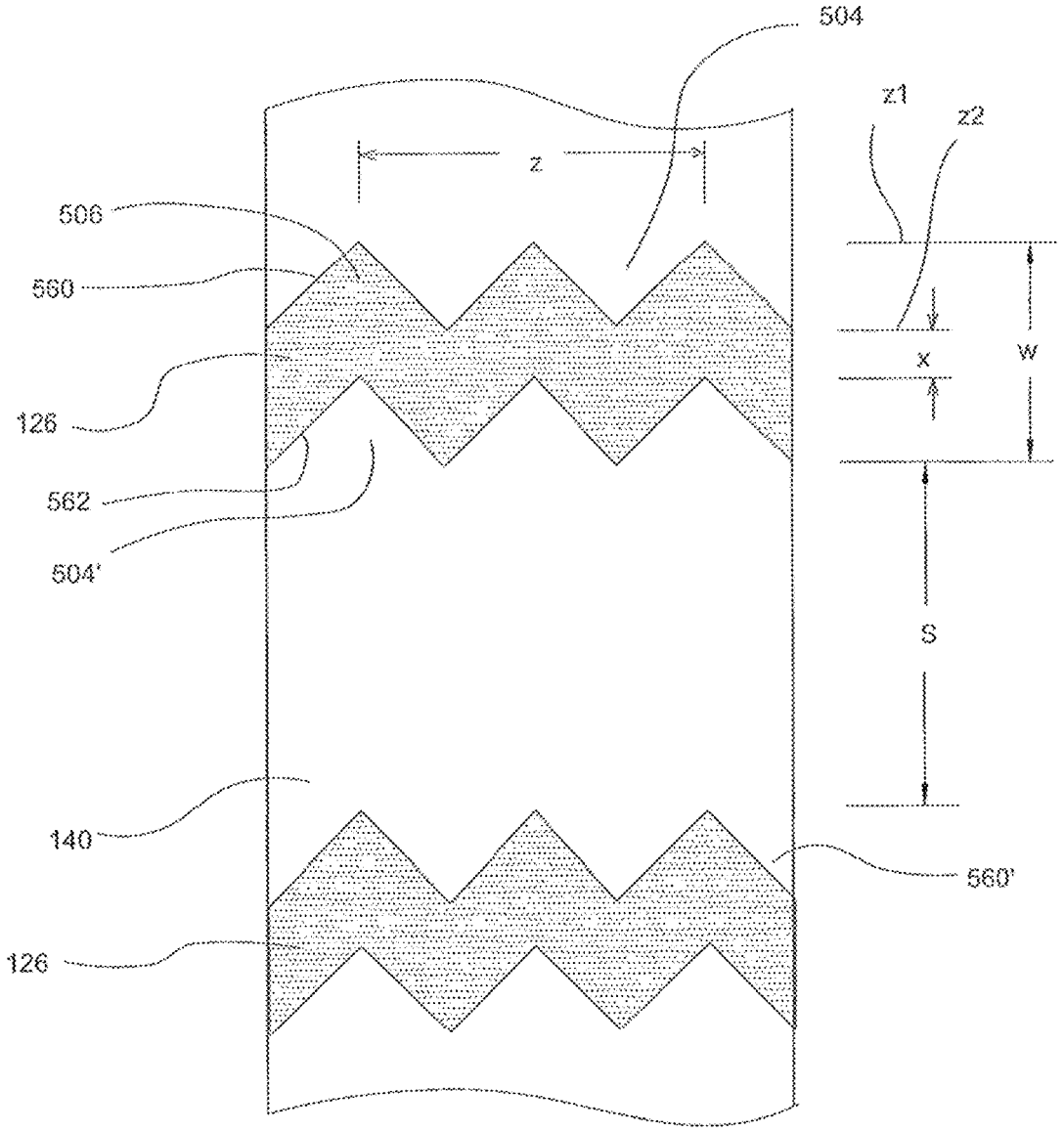
FIG. 54 is a schematic view of a wrapper having a still further embodiment of a crenellated banded region.

While the foregoing embodiments depict crenellated edges have a traditional notched shape, the crenellated band 126 of FIG. 54 has a different shape for the crenellated edges 560. More particularly, the crenellated edge 560 has merlons 506 that are substantially triangular separated by substantially triangular crenels 504. If desired, the trailing edge 562 of the band may be straight. Preferably, however, the trailing edge 562 of the band 126 may also have the triangular crenellation configuration described above in connection with the leading edge 80.

Figure 55:
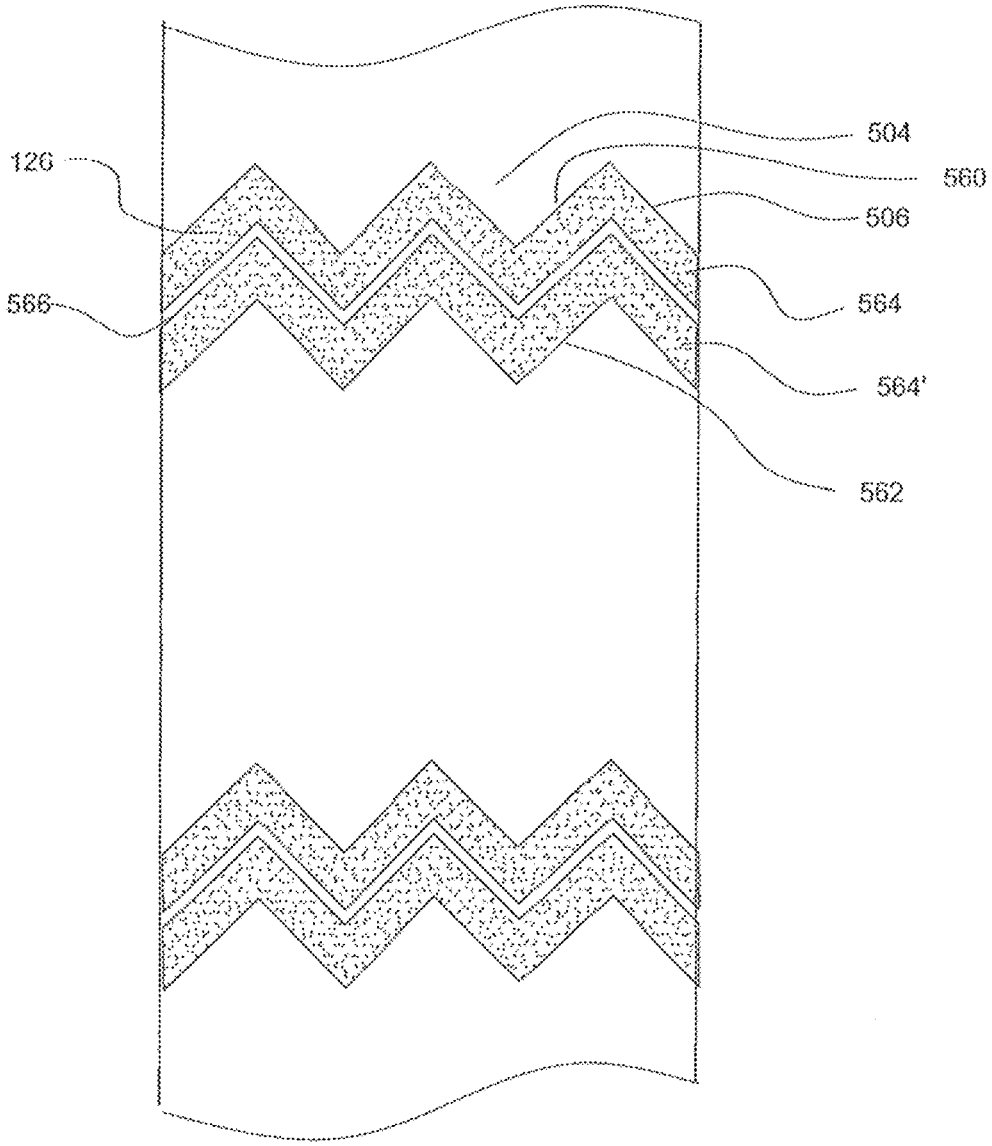
FIG. 55 is a schematic view of a wrapper having another embodiment of a crenellated banded region.
Figure 56:
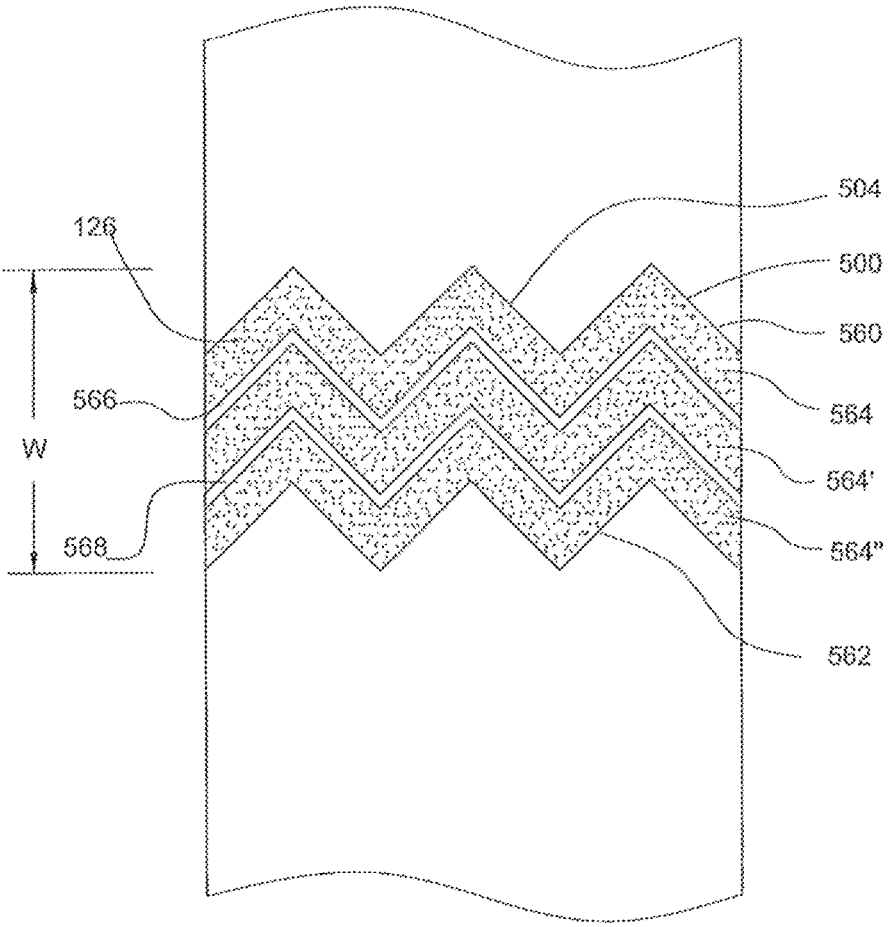

Similar to the crenellated band of FIG. 54, the crenellated band 126 of FIG. 55 has a crenellated edge 80 having merlons that are substantially triangular, separated by, and defining, substantially triangular crenels. While, the trailing edge 562 of the band may be straight, in FIG. 55, the trailing edge 562 of the band also has the same triangular crenellation configuration as the leading edge 560. As further illustrated in FIG. 55, the band may be divided into two band portions 564, 56' that are spaced from one another by a "slit" 566. The slit 81 typically does not exceed the widths of the individual band portions as measured in a direction generally parallel to the axis of a smoking article having the bands. The spacing feature provides a "slit" 566 (or discontinuity) in the band structure where there is a lesser amount of or no add-on material, FIG. 56 shows crenellated bands similar to that of FIG. 55, but with the band divided into three band portions 564, 564'. 564" that are spaced from one another along the axis of a smoking article by a pair of slits 566, 568.

Figure 57:
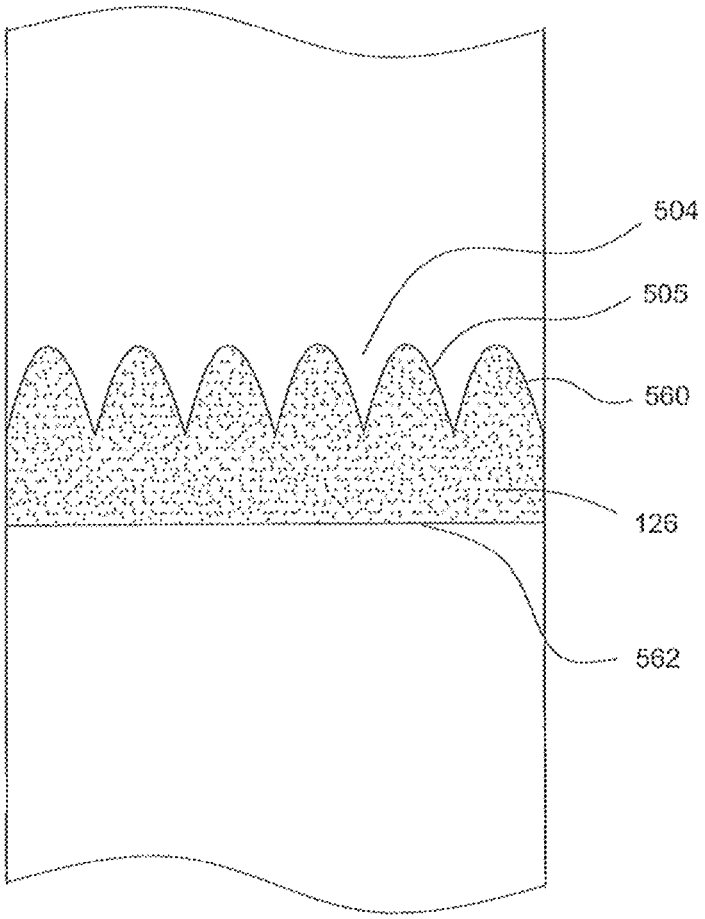
FIG. 57 is a schematic view of a wrapper having a another embodiment of a crenellated banded region.
Figure 58:
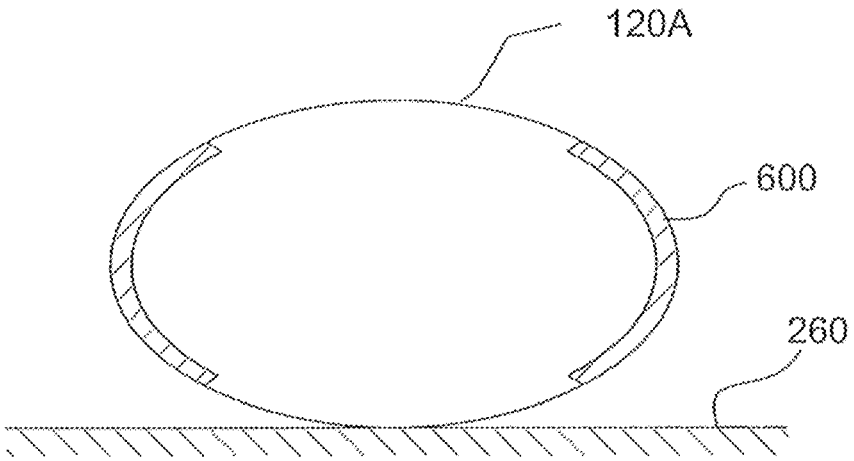
FIG. 58 is a cross-sectional view of a smoking article comprising another embodiment of longitudinally banded regions as described herein.

In an embodiment shown in FIG. 57, the band 126 has a different shape for the crenellated edges 560. In particular, the leading, edge that is crenated (i.e., cut into rounded scallops). The scallops 505 (i.e., circle segments or angular projections) can have variable or uniform widths and/or lengths. The trailing edge 562 of the band can be straight, crenellated (in accordance with any of FIGS. 49-56), or crenated. It is contemplated that the crenated band of FIG. 57 can further include a "slit" in the band structure, as illustrated in FIGS. 55-56. In addition, while not illustrated, a band structure can comprise a crenulated (i.e., having an irregularly wavy or serrate outline) leading and/or trailing edge, the band optionally featuring one or more "slits".

The geometry of the smoking article 120 may also be designed to aid in achieving a preferred orientation for purposes of IP reduction. For example, the opposed longitudinally banded regions 600 (see Fla 58) may be located at the edges of the major axis of a substantially elliptical smoking article 120A, where the major axis of the substantially elliptical smoking article 120A naturally rests in a position substantially parallel to the substrate 260 an which the smoking article is placed.

Such a smoking article 120A is also known as an oval smoking article. The base web for wrapper used in such an oval smoking article preferably has applied to it longitudinally banded regions of a film-forming compound (the constituents of which may be the same as discussed elsewhere in this description. Those longitudinally banded regions may be two parallel, longitudinal stripes extending longitudinally along side portions of the smoking article. Stated differently, the stripes may be provided on the base web so that, when the paper is wrapped around the tobacco rod, the stripes are spaced about degrees apart from one another. A smoking article 120 may include longitudinally extending banded regions (or stripes) that preferably extend the length of the wrapper or tobacco rod. Preferably, the banded regions are mutually opposed along opposing sides of the smoking article.

Due to the nature of an ellipse, it can be appreciated that regardless of how an oval smoking article is placed on the substrate 260, the smoking article 120A will eventually rest in one of two stable positions, with either the tipper or lower side resting against the substrate. Therefore, even if longitudinally banded regions of add-on material are formed only along the side portions of the generally elliptical article where there is a maximum curvature, film-forming compound will always be present on those side portions of the smoking article 120A that do not contact the substrate 260. Moreover, cooperation between those longitudinally banded regions and the substrate 260 in the stable positions appears to function to restrict airflow into the tobacco rod and leads to self-extinction and a low IP value, regardless of how the smoking article 120 is initially placed on the substrate 230.

The predetermined pattern of add-on material is typically applied to a base web having a permeability lying in the range of about 20 to about 80 CORESTA units. When dry, the add-on material often forms a film on the base web that is effective to locally reduce permeability to values lying in the range of 0 to about 12 CORESTA units, more preferably, 0 to about 10 CORESTA units. In some applications, the add-on material is applied as an aqueous solution including starch.

Printing Processes

Preferably, the banded region is applied to the wrapper using a gravure printing process. Gravure printing operations are capable of precise registry of successive printing operations. Accordingly, gravure printing can be used to effectively print not only the first layer of the banded regions, but also the optional successive layers.

In a successive gravure printing process, preferably after the first layer is applied to die base web it is allowed to dry thereon using suitable arrangements, prior to being advanced to a second gravure printing station where a second layer is applied to the first layer using conventional successive-pass gravure printing equipment. Preferably, the second layer is coextensive with the first layer in both width and length; however, the second layer may have a different basis weight in grams per square meter than the first layer. The occlusive composition of the second layer gels on the cooler first layer—and free water does not migrate or became absorbed by the paper. Preferably, the second layer is allowed to dry using suitable arrangements prior to being advanced to successive gravure printing station(s) where successive layer(s) are applied. Preferably, the successive layer(s) are coextensive with the previous layer(s) in both width and length (i.e., the layers do not have a stepped appearance); however, the successive layer(s) may have different basis weight in grams per square meter than the previous layer(s) or may comprise different add-on compositions. Preferably, successive layer(s) are preferably allowed to dry after the printing of each successive layer in accordance with well-known gravure printing techniques and conventional gravure printing systems.

The gravure printing process can be used immediately following paper manufacture, i.e., at a printing station at a location near the end of the paper making machine. Alternatively, the gravure printing process can be used in connection with reels carrying the wrapper onto which the banded regions are to be printed. For example, a reel of wrapper having a selected permeability and a selected basis weight is mounted so that the wrapper can be unspoiled from the reel as a continuous base web.

The base web advances or passes through a first gravure pinning station where the first layer of each banded region is printed on the paper. The printing process may be applied to the felt side or the wire side of the paper, or both. Next, the wrapper passes through a second gravure printing station where a second layer of each banded region is printed on the corresponding first layer. Additional layers are applied in a similar manner as described. Finally, the wrapper with the printed banded regions is wound up on a collection reel. The collection reel is then cut into bobbins. The bobbins are then used during manufacture of the desired smoking article in conventional tobacco rod making machines.

The apparatus at each of the gravure printing stations is essentially the same its material aspects. Accordingly, it will suffice to describe one of the gravure printing stations in detail, it being understood that the Other gravure printing stations have common features, unless otherwise noted. A single pass technique can be used to make the banded paper instead of a multi-pass technique.

At the first gravure printing station, the apparatus includes a gravure cylinder or roller generally mounted for rotation around a horizontal axis. The generally cylindrical surface of the roller is patterned (i.e., with dots, lines, cells, etc.) in a suitable process to define a negative of the first layer of banded regions. Conventional engraving (etching), chemical engraving, electronic engraving, and photo etching can be used to pattern the surface of the gravure cylinder. The circumference of the roller is determined such that it is an integral multiple of the sum of the nominal distance between banded regions plus the banded region width. Thus, for each revolution of the roller, that integral number of first layers of the handed regions is printed on the wrapper.

With gravure printing, while each layer of add-on material n av be applied uniformly, each layer of add-on material need not be applied uniformly. For example, a layer of add-on material may be applied such that discrete portions of the layer have differing gsm weights than other areas of the layer. This may be accomplished, for example, by printing a discrete portion of the layer having a differing basis weight than other areas of the layer in a separate printing stage using add-on material having a differing basis weight. Alternatively, a layer of add-on material may be applied such that discrete portions of the layer have differing depths than other areas of the layer. This may be accomplished, for example, by patterning the gravure cylinder or roller so as to provide a discrete portion, of the layer having a differing depth than other areas of the layer.

The multiple zones, for example, first, second and third zones, of the banded regions described herein may be applied in a single printing stage or multiple printing stages. When applied in multiple printing stages, each zone which contains add-on material may be applied in a separate printing stage. For example, for a banded region containing first, second and third zones, wherein only the first and third zones contain add-on material, the first zone may be applied in a first printing stage and the third zone may be applied in a second printing stage. Alternatively, when applied in a single printing stage, the zones containing add-on material are applied using an appropriately patterned gravure cylinder or roller. For example, for a banded region containing first, second and third zones, wherein only the first and third zones contain add-on material, the gravure cylinder or roller is patterned so as to apply add-on material only in the first and third zones.

An impression cylinder is mounted for counter-rotation on an axis parallel to the axis of the roller. In some applications, the impression cylinder includes a nonmetallic resilient surface. The impression cylinder is positioned between the roller and a backing roller, which is also mounted for rotation on an axis parallel to the axis of the roller and which counter-rotates relative to the impression cylinder. One of the functions provided by the backing roller is stiffening the central portions of the impression cylinder so that the uniform printing pressure is attained between the roller and the impression cylinder. The gravure cylinder or roller and the impression cylinder cooperate to define a nip through which the base web advances during the printing process. That nip is sized to pinch the base web as it moves between the gravure cylinder and the impression cylinder. The nip pressure on the base web ensures the correct transfer of the composition from the cylinder to the paper.

A reservoir contains the occlusive composition discussed above for forming banded regions on the wrapper. The reservoir communicates with a suitable pump which is capable of handling the viscous occlusive composition. The occlusive composition may then flow to a suitable heat exchanger where the temperature of the occlusive composition is elevated so that it lies in the range of about 40° to about 90° C. so that the viscosity of the occlusive composition is adjusted to a level which is suitable for gravure printing. As discussed above, viscosity for gravure printing usually needs to be less than about 200 cP. Preferably, the temperature of the occlusive composition is selected so that the viscosity is less than about 100 cP. For example, the occlusive composition may have a viscosity of about 10-40 cP at room temperature.

While a separate heat exchanger is disclosed, it may be desirable to provide thermal conditioning of the occlusive composition in the reservoir itself. For example, heating elements and stirring, apparatus may be included in the reservoir to maintain the elevated temperature for the occlusive composition. Placement of the thermal conditioning in the reservoir has the advantage of making pump selection and operating requirements simpler since the pump need not handle the occlusive composition at the higher viscosity associated with lower temperatures because the occlusive composition would already be heated and, therefore, at the lower viscosity. Whether thermal conditioning occurs in the reservoir or in a separate heat exchanger, it is important that the thermal conditioning step occur at a temperature selected to avoid scorching the occlusive composition. Scorching can cause discoloration of the occlusive composition, and can affect the occlusive characteristics of the composition. Thus, scorching is to be avoided while the occlusive composition is subjected to thermal conditioning.

Regardless of where the thermal conditioning step occurs, the heated occlusive composition is delivered to a suitable applicator that spreads the occlusive composition along the length of the gravure cylinder. That spreading step may be effected by pouring or spraying the occlusive composition onto the gravure cylinder, or simply by delivering the liquid occlusive composition to a bath of occlusive composition that collects at the bottom of the gravure cylinder, between the gravure cylinder and a collector. The cylinder may be heated to prevent premature cooling of the composition.

Generally, the collector extends vertically around the gravure roller to a height sufficient to collect the bath, but to a height well below the top of the gravure cylinder. When the bath reaches the top of the collector, occlusive composition can flow through a drain at the bottom of the apparatus back into the reservoir. Thus, the occlusive composition circulates through the printing station and can be maintained at suitable printing viscosity by the thermal conditioning apparatus discussed above.

As the gravure cylinder rotates through the applicator and/or the bath, the occlusive composition adheres to the surface of the gravure cylinder, including in the impressions provided therein to define the banded regions. Further rotation of the gravure cylinder toward the nip moves the cylinder surface past a suitable doctor blade. The doctor blade extends along the length of the gravure cylinder and is positioned so that is wipes the surface of the gravure cylinder. In this way, those portions of the gravure cylinder that define the nominal spacing between adjacent banded regions is essentially wiped clean of the occlusive composition, while engraved portions of the gravure cylinder that define the banded regions themselves advance toward the nip hill of the occlusive composition.

As the wrapper and the surface of the gravure cylinder move through the nip, the occlusive composition is transferred to the surface of the wrapper. The linear speed or velocity of the wrapper matches the tangential surface speed of both the gravure cylinder and the impression cylinder as the wrapper passes through the nip. In that way, slippage and/or smearing of the occlusive composition on the wrapper are avoided.

The thickness of the multilayer banded regions preferably is less than about 20% of the thickness of the base web, and may be less than 5% of the thickness of the base web. The thickness of the first layer of the banded region applied in the first gravure printing station, preferably is less than 4% of the base web thickness, and may be less than 1% of the base web thickness. Thus, it is seen that the thickness of the first layer is small in relation to the thickness of the underlying base web.

Figure 59:
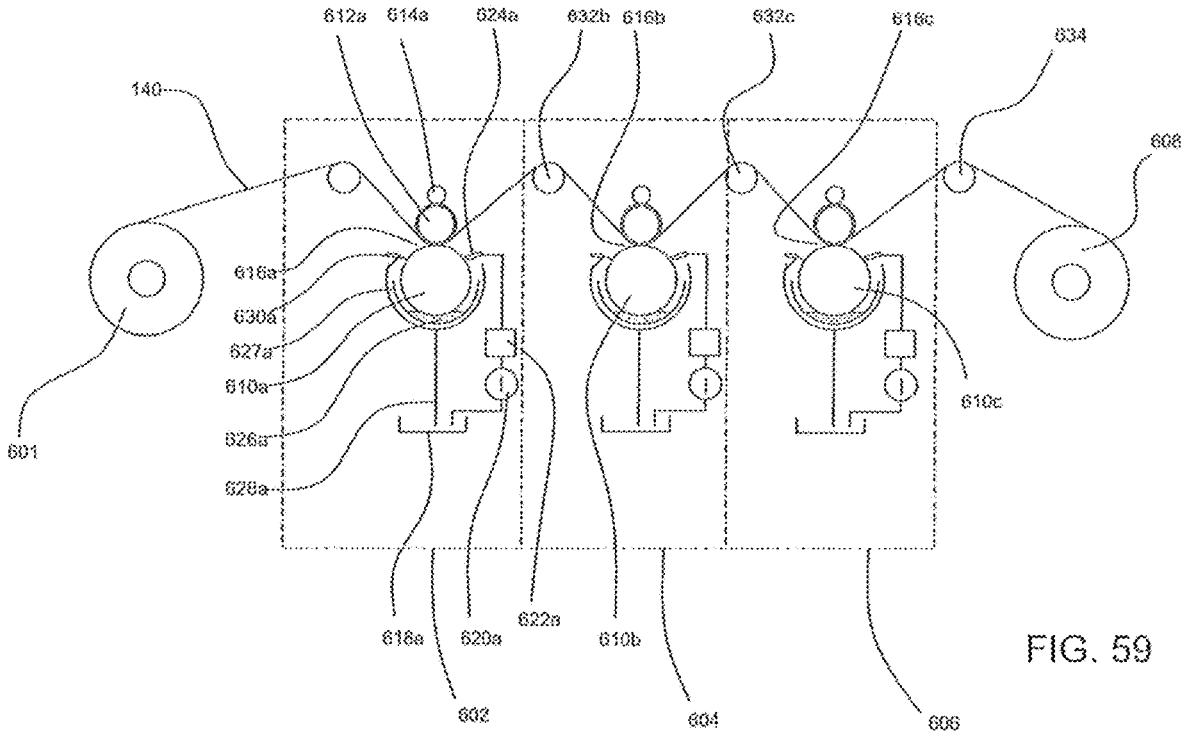
FIG. 59 is a schematic view of a gravure printing process suitable for producing embodiments of print banded wrapper as disclosed herein.

FIG. 59 is a schematic view of a multiple stage printing apparatus. With reference to the above-description for multiple stage printing. FIG. 59 illustrates a reel 600, first gravure printing station 602, second gravure printing station 604, third gravure printing station 506, collection reel 608, rollers 510, impression cylinder 612, backing roller 614, nips 615, reservoir 618, pump 620, heat exchanger 622, applicator 624, bath 626, collector 627, drain 628, doctor blade 630, adjustment cylinders 632, and idler roller 634. In FIG. 59, features of the first gravure printing station 602 contain reference numerals with the suffix "a", corresponding features of the second gravure printing station 604 contain the same reference numeral with the suffix "b", and corresponding features of the third gravure printing station 606 contain the same reference numeral with the suffix "c".

As an alternative to printing, the banded regions may comprise a slurry of highly refined fibrous cellulose (e.g., fibers, fibrils, microfibrils, or combinations thereof) or other add-on material applied using various spray or coating techniques, including application techniques that utilize a moving orifice applicator at the forming section of a papermaking machine as described in commonly owned U.S. Pat. Nos. 5,997,691 and 6,596,125, the contents of which are hereby incorporated by reference in their entirety.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

The terms and phases used herein are not to be interpreted with mathematical or geometric precision, rather geometric terminology is to be interpreted as meaning approximating or similar to the geometric terms and concepts. Terms such as "generally" and "substantially" are intended to encompass both precise meanings of the associated terms and concepts as well as to provide reasonable latitude which is consistent with form, function, and/or meaning.

It will now be apparent to those skilled in the art that this specification describes a new, useful, and nonobvious smoking article. It will also be apparent to those skilled in the art that numerous modifications, variations, substitutes, and equivalents exist for various aspects of the smoking article that have been described in the detailed description above. Accordingly, it is expressly intended that all such modifications, variations, substitutions, and equivalents that fall within the spirit and scope of the invention, as defined by the appended claims, be embraced thereby.

What is claimed is:

1. A wrapper for a smoking article, the wrapper comprising:

a base having a first permeability, the base including a first base side and a second base side, the first base side parallel to the second base side;

a first banded layer having a second permeability, the second permeability being less than the first permeability, the first banded layer including, a first anti-wrinkling agent adjacent to the first base side; and a second banded layer having a third permeability, the third permeability being less than the first permeability and same as or different from the second permeability, the second banded layer including, a second anti-wrinkling agent adjacent to the second base side, and the second anti-wrinkling agent being same as or different from the first anti-wrinkling agent, at least one of the first banded layer and the second banded layer including 0.36 grams per square meter to 0.90 grams per square meter of the respective first or second anti-wrinkling agent.

2. The wrapper of claim 1, wherein the first banded layer includes, a first layer adjacent to the first base side, and a second layer disposed adjacent to an exposed surface of the first layer;

the first layer includes a first starch, a first chalk, the first anti-wrinkling agent, or any combination thereof;

the second layer includes a second starch, a second chalk, the first anti-wrinkling agent, or any combination thereof;

the first starch is same as or different from the second starch; and the first chalk is same as or different from the second chalk.

3. The wrapper of claim 1, wherein the first banded layer includes, a first layer adjacent to the first base side, a second layer adjacent to an exposed surface of the first layer, and a third layer adjacent to an exposed surface of the second layer;

the first layer includes a first starch, a first chalk, the first anti-wrinkling agent, or any combination thereof;

the second layer includes a second starch, a second chalk, the first anti-wrinkling agent, or any combination thereof;

the third layer includes a third starch, a third chalk, the first anti-wrinkling agent, or any combination thereof;

the first starch is same as or different from the second starch;

the second starch is same as or different from the third starch;

the third starch is same as or different from the first starch;

the first chalk is same as or different from the second chalk;

the second chalk is same as or different form the third chalk; and the third chalk is same as or different from the first chalk.

4. The wrapper of claim 1, wherein the second banded layer includes, a first layer adjacent to the second base side, and a second layer adjacent to an exposed surface of the first layer;

the first layer includes a first starch, a first chalk, the second anti-wrinkling agent, or any combination thereof;

the second layer includes a second starch, a second chalk, the second anti-wrinkling agent, or any combination thereof;

the first starch is same as or different from the second starch; and the first chalk is same as or different from the second chalk.

5. The wrapper of claim 1, wherein the second banded layer includes, a first layer adjacent to the second base side, a second layer adjacent to an exposed surface of the first layer, and a third layer adjacent to an exposed surface of the second layer;

the first layer includes a first starch, a first chalk, the second anti-wrinkling agent, or any combination thereof;

the second layer includes a second starch, a second chalk, the second anti-wrinkling agent, or any combination thereof;

the third layer includes a third starch, a third chalk, the first anti-wrinkling agent, or any combination thereof;

the first starch is same as or different from the second starch;

the second starch is same as or different from the third starch;

the third starch is same as or different from the first starch;

the first chalk is same as or different from the second chalk;

the second chalk is same as or different form the third chalk; and the third chalk is same as or different from the first chalk.

6. The wrapper of claim 1, wherein the first permeability ranges from 25 CORESTA to 100 CORESTA.

7. The wrapper of claim 1, wherein the anti-wrinkling agent includes glycerin, propylene glycol, 1,2-propylene glycol, or any combination thereof.

8. The wrapper of claim 1, wherein the first banded layer further comprises chalk, the first banded layer including 0.64 grams per square meter to 1.2 grams per square meter of the chalk.

9. The wrapper of claim 1, wherein the second banded layer further comprises chalk, the first banded layer including 0.64 grams per square meter to 1.2 grams per square meter of the chalk.

10. The wrapper of claim 1, wherein the first banded layer further comprises 1.5 grams per square meter of a starch.

11. The wrapper of claim 1, wherein the second banded layer further comprises 1.5 grams per square meter of a starch.

12. The wrapper of claim 1, wherein the first banded layer includes a first pattern, the first pattern including first repeating units in a longitudinal direction.

13. The wrapper of claim 12, wherein the second banded layer includes a second pattern, the second pattern including second repeating units in the longitudinal direction.

14. The wrapper of claim 13, wherein the second repeating units are different from the first repeating units.

15. The wrapper of claim 1, wherein the base includes flax, wood pulp, cellulose fiber, or any combination thereof.

16. The wrapper of claim 1, wherein the base has a first length and a first width, and the first banded layer has a second length and a second width, the second length of the first banded layer being perpendicular to the first length of the base.

17. The wrapper of claim 16, wherein the second banded layer has a third length and a third width, the third length being perpendicular to the first length.

18. A wrapper for a smoking article, the wrapper comprising:

a base having a first permeability, the base including a first base side and a second base side, the first base side parallel to the second base side;

a first banded layer having a second permeability, the second permeability being less than the first permeability, the first banded layer including, a first anti-wrinkling agent adjacent to the first base side; and a second banded layer having a third permeability, the third permeability being less than the first permeability and same as or different from the second permeability, the second banded layer including, a second anti-wrinkling agent adjacent to the second base side, and the second anti-wrinkling agent being same as or different from the first anti-wrinkling agent, at least one of the first banded layer and the second banded layer further including 0.64 grams per square meter to 1.2 grams per square meter of a chalk.

19. A wrapper for a smoking article, the wrapper comprising:

a base having a first permeability, the base including a first base side and a second base side, the first base side parallel to the second base side;

a first banded layer having a second permeability, the second permeability being less than the first permeability, the first banded layer including, a first anti-wrinkling agent adjacent to the first base side; and a second banded layer having a third permeability, the third permeability being less than the first permeability and same as or different from the second permeability, the second banded layer including, a second anti-wrinkling agent adjacent to the second base side, and the second anti-wrinkling agent being same as or different from the first anti-wrinkling agent, at least one of the first banded layer and the second banded layer further including 1.5 grams per square meter of a starch.

* * * * *